US007575305B2

(12) United States Patent
Akahane et al.

(10) Patent No.: US 7,575,305 B2
(45) **Date of Patent: *Aug. 18, 2009**

(54) LIQUID EJECTION HEAD HAVING IMPROVED EJECTION PERFORMANCE

(75) Inventors: Fujio Akahane, Nagano (JP); Nagamitsu Takashima, Nagano (JP); Kazushige Hakeda, Nagano (JP); Ryoji Uesugi, Nagano (JP); Yasunori Koike, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 151 days.

This patent is subject to a terminal disclaimer.

(21) Appl. No.: 11/751,449

(22) Filed: May 21, 2007

(65) Prior Publication Data

US 2007/0216736 A1 Sep. 20, 2007

Related U.S. Application Data

(63) Continuation of application No. 11/031,353, filed on Jan. 10, 2005, which is a continuation-in-part of application No. PCT/JP02/08738, filed on Jul. 9, 2003.

(30) Foreign Application Priority Data

Jul. 9, 2002 (JP) ..... P2002-200087
Aug. 5, 2002 (JP) ..... P2002-227546

(51) Int. Cl.
*B41J 2/045* (2006.01)

(52) U.S. Cl. ..... 347/68; 347/70

(58) Field of Classification Search ..... 347/20, 347/40, 47, 54, 56, 67, 68, 70, 71, 92–94
See application file for complete search history.

(56) References Cited

U.S. PATENT DOCUMENTS 5,896,146 A 4/1999 Kitahara et al.
7,219,983 B2 * 5/2007 Akahane et al. ..... 347/68

FOREIGN PATENT DOCUMENTS

| | | | |
|---|---|---|---|
| EP | 1020292 | A2 | 7/2000 |
| EP | 1 323 532 | A2 | 7/2003 |
| JP | 55-14283 | A | 1/1980 |
| JP | 56-11130 | A | 2/1981 |
| JP | 61-232028 | A | 10/1986 |
| JP | 6-226975 | A | 8/1994 |
| JP | 2000-263799 | A | 9/2000 |
| JP | 2001-71044 | A | 3/2001 |

* cited by examiner

*Primary Examiner*—Juanita D Stephens
(74) *Attorney, Agent, or Firm*—Sughrue Mion, PLLC

(57) ABSTRACT

An object is to provide a fine forging method for forming partitions of recesses precisely and forming recess shapes for pressure generation chambers etc. with high accuracy as well as a liquid ejection head that is produced by using the fine forming method. A fine forging method for forming groove-shaped recesses that are arranged at a prescribed pitch. After groove-shaped recesses are formed tentatively in a material plate by a first punch in which tentative forming punches are arranged, finish forming is performed on the tentatively formed groove-shaped recesses by using a second punch in which finish forming punches are arranged. An end portion of a projection strip is formed with slant faces or a slant face, whereby an end portion of each groove-shaped recess is formed precisely. A liquid ejection head produced by the above method exhibits stable liquid ejection characteristics and its manufacturing cost can be reduced by virtue of simplified working of forging.

19 Claims, 24 Drawing Sheets

LIQUID EJECTION HEAD HAVING IMPROVED EJECTION PERFORMANCE

CROSS-REFERENCE TO RELATED APPLICATION

This is a continuation application of Ser. No. 11/031,353 filed Jan. 10, 2005, which is a continuation-in-part application of PCT/JP03/08738 filed on Jul. 9, 2003, both of which are incorporated by reference herein in their entirety.

BACKGROUND OF THE INVENTION

The present invention relates to a fine forging method that can be used for manufacture of such components as a liquid ejection head, a manufacturing method of a liquid ejection head, and a liquid ejection head.

Liquid ejection heads for discharging ejects of pressurized liquid from nozzle orifices are known that deal with various liquids. Such liquid ejection heads are mainly used as recording heads for image recording apparatus such as printers and plotters. In recent years, by making use of their feature that they can correctly supply very small amounts of liquid to prescribed locations, they have come to be applied to various manufacturing apparatus as, for example, colorant ejection heads for manufacturing apparatus for manufacture of color filters of liquid crystal displays etc., electrode material ejection heads in manufacturing apparatus for formation of electrodes of organic EL (electroluminescence) displays, FEDs (field emission displays) etc., bioorganic material ejection heads in manufacturing apparatus for manufacture of biochips. Recording heads eject liquid ink and colorant ejection heads eject colorant solutions of E (red), G (green), and B (blue). Electrode material ejection heads eject a liquid electrode material and bioorganic ejection heads eject a solution of a bioorganic material.

Ink jet recording heads are typical examples, and an ink jet recording head will be described below as a conventional technique.

Among various kinds of ink jet recording heads (hereinafter referred to as recording heads), what is called an on-demand recording head which is now widely spread have a plurality of channels that correspond to respective nozzle orifices and extend from a common ink chamber to the nozzle orifices via pressure generation chambers. To satisfy the requirement of downsizing, the pressure generation chambers need to be formed at a fine pitch that corresponds to a recording density. Therefore, partitions of the adjoining pressure generation chambers are very thin. To efficiently convert ink pressure fluctuation in the pressure generation chamber to ejection force of ink droplets, the width of ink supply holes through which the pressure generation chambers communicate with the common ink chamber is smaller than the width of the pressure generation chambers. To form those minute pressure generation chambers and ink supply holes with high dimensional accuracy, the conventional recording head employs a silicon substrate preferably. More specifically, a crystal face is exposed by silicon anisotropic etching and pressure generation chambers and ink supply holes are formed on the crystal face.

To meet the requirements of high workability etc., a nozzle plate that is formed with nozzle orifices is made of a metal plate. Diaphragm portions for changing the volumes of pressure generation chambers are formed on an elastic plate. The elastic plate has a double-layer structure that a resin film is bonded to a metal support plate and portions of the support plate facing the respective pressure generation chambers are removed.

Incidentally, in the above-described conventional recording head, because the partitions are very thin, it is difficult to correctly obtain the recess shape of the pressure generation chambers and to set the liquid accommodation volume of the pressure generation chambers etc. In particular, the recess shape is long and narrow. To finish the partitions sharply, it is important to precisely determine the shapes of the end portions, in the longitudinal direction, of the recess shape.

Further, because of a large difference between the linear expansion coefficients of silicon and the metals, it is necessary that the silicon substrate, the nozzle plate, and the elastic plate be bonded to each other at a relatively low temperature by spending a long time. This makes it difficult to increase the productivity and is a cause of increase of the manufacturing cost.

In view of the above, to increase the productivity and for other purposes, in the above type of liquid ejection head, attempts have been made to form liquid channels in a metal pressure generation plate (e.g., patent documents 1 and 2). That is, these patent documents disclose methods for forming, by plastic working (e.g., face pushing or press working) on a metal plate, supply holes through which a reservoir and pressure chambers communicate with each other, recessed grooves to serve as the pressure chambers, and communication holes through which the pressure chambers and nozzle orifices communicate with each other.

However, since, for example, the pressure generation chambers are very fine and the channel width of needs to be smaller than the width of the pressure generation chambers, problems arise that the working is difficult and it is difficult to increase the production efficiency.

On the other hand, this type of liquid ejection head is required to discharge very small amounts of liquid ejects. This is because, in the case of ink jet recording heads, the use of very small amounts of ink ejects can increase the number of dots to reach a unit area and hence makes it possible to record high-quality images with low graininess. In the case of colorant ejection heads, decreasing the amounts of ejects can reduce the area of each pixel and hence makes it possible to manufacture high-resolution displays (or filters). In the case of electrode material ejection heads, decreasing the amounts of an electrode material makes it possible to form very narrow conductors in a desired pattern.

The above-mentioned patent documents 1 and 2 are Japanese Patent Publication No. 55-14283A (page 2 and FIG. 6) and Japanese Patent Publication No. 2000-263799A (pages 6-9 and FIGS. 4-14), respectively.

However, it has been found that several problems arise when it is attempted to produce, by the methods of the above patent documents, a liquid ejection head capable of satisfying current requirements. One of those problems relates to bubble ejection performance.

To produce a liquid ejection head capable of discharging very small amounts of liquid ejects, the width of the groove-shaped recesses to serve as the pressure chambers necessarily becomes very small. Further, the groove-shaped recesses need to be arranged close to each other in the groove width direction. However, it is difficult for the methods of the above patent documents to form all the communication holes at one ends, in the longitudinal direction, of the groove-shaped recesses. For example, as shown in FIG. 25A, there is no other way than forming each communication hole 34 at a position that is separated, in the groove longitudinal direction, from a longitudinal end face (recess end face) 70 of a groove-shaped recess 33. This is because of a positional variation of the recess end faces 70.

In this case, forming the groove-shaped recesses 33 by press working causes a variation of the positions of the recess end faces 70 among the groove-shaped recesses 33. Therefore, if it is attempted to form the communication holes 34 right adjacent to the groove-shaped recesses in the longitudinal direction as shown in FIG. 25B, part of punches may act on the thick portion of a metal plate. Since the punches are very thin, punches acting on the thick portion may bend or buckle. Therefore, in forming the communication holes 34, it is necessary that all the punches be positioned with proper margins so as to go into the groove-shaped recesses 33 completely. As a result, the punches are separated from the respective recess end faces 70 and hence the communication holes 34 are also formed so as to be separated from the respective recess end faces 70.

If in this manner the communication holes 34 are formed so as to be separated from the respective recess end faces 70, flat portions 71 are formed between the recess end faces 70 and the communication holes 34. The flat portions 71 are a cause of stay of bubbles, that is, a factor of hindering removal of bubbles. That is, the presence of the flat portions 71 causes stagnation in the liquid flowing through each pressure chamber, and bubbles in the liquid stay in the stagnant portion and are hard to remove. Further, if such bubbles grow large, they may influence the liquid jet discharge characteristics (e.g., the flying speed and the amount of discharge) or hinder a liquid flow.

As described above, forming pressure generation chambers by plastic working on a metal substrate has the problem that turbulence occurs in ink or bubbles pile up depending on the shapes of the inner surfaces of each pressure generation chamber formed and the shapes of the portions close to each of the communication holes through which the pressure generation chambers communicate with the nozzle orifices, which may adversely affect the liquid ejection characteristics.

The present invention has been made in view of the above circumstances, and a first object of the invention is to allow ink to flow smoothly in the pressure generation chambers and prevent the stay of bubbles by precisely forming the partitions including both end portions thereof by performing highly accurate working to form recess shapes for the pressure generation chambers etc. That is, the first object of the invention is to improve the bubble ejection performance by improving the shapes of the end portions of the groove-shaped recesses.

A second object of the invention is to precisely form the partitions including both end portions thereof by performing highly accurate working to form recess shapes for the pressure generation chambers etc.

SUMMARY OF THE INVENTION

To attain the above objects, the present invention provides a fine forging method for forming recesses that are arranged at a prescribed pitch, characterized in that after recesses are formed tentatively in a material plate by a first punch in which tentative forming punches are arranged, finish forming is performed on the tentatively formed recesses by using a second punch in which finish forming punches are arranged.

That is, this is a fine forming method in which after recesses are formed tentatively in a material plate by a first punch in which tentative forming punches are arranged, finish forming is performed on the tentatively formed recesses by using a second punch in which finish forming punches are arranged.

First, tentative forming by the first punch forms a material plate to such a stage that a final shape has not been obtained. Subsequently, finish forming is performed by using the second punch. Since plastic working is performed sequentially, that is, gradually, by using the first punch and the second punch, a desired formed shape can be obtained correctly even if it is minute without causing any problems, that is, without producing an abnormal shape or causing a crack in the material plate. In general, anisotropic etching is employed to form such minute structures. However, anisotropic etching requires a large number of working steps and hence is disadvantageous in manufacturing cost. In contrast, the above-described fine forging method greatly decreases the number of working steps and hence is very advantageous in cost. Further, capable of forming recesses having uniform volumes, the above-described fine forging method is very effective in, for example, stabilizing the discharge characteristics of a liquid ejection head in, for example, a case of forming pressure generation chambers of the liquid ejection head.

In the fine forging method according to the invention, partitions that are provided between the recesses may be formed by gap portions between the tentative forming punches that are arranged in the first punch and gap portions between the finish forming punches that are arranged in the second punch. In this case, first, tentative forming by the first punch forms a material plate to such a stage that a final shape of each partition has not been obtained. Subsequently, finish forming is performed by using the second punch. Since plastic working is performed sequentially, that is, gradually, by using the first punch and the second punch, a desired formed shape can be obtained correctly even if the partitions are thin without causing any problems, that is, without producing an abnormal shape or causing a crack in the material plate.

In the fine forging method according to the invention, a depth of digging of the second punch into the material plate in the finish forming may be greater than that of the first punch into the material plate in the tentative forming. In this case, since the digging depth of the second punch in the finish forming is greater than that of the first punch in the tentative forming, the finish forming can reliably deform a shape that has been formed tentatively by the first punch and hence a desired shape can be obtained reliably.

The fine forging method according to the invention may be such that the tentative forming punches of the first punch and the finish forming punches of the second punch are parallel projection strips and the recesses are formed as parallel groove-shaped recesses by the projection strips. In this case, various dimensions such as the width, length, and depth and the shape of long and narrow groove-shaped recesses can be obtained precisely by the tentative forming by the first punch and the finish forming by the second punch.

In the fine forging method according to the invention, the projection strips of the first punch may be approximately the same as those of the second punch in width and length. In this case, since the finish forming by the second punch, which is performed subsequent the tentative forming by the first punch, is performed by the projection strips that are approximately the same as those of the second punches in width and length, the finish forming can reliably be performed, without causing abnormal deformation, on a shape that has been formed by the tentative forming and hence precise groove-shaped recesses can be obtained finally.

In the fine forging method according to the invention, an end portion, in a longitudinal direction, of each of the projection strips of the first punch may be formed with slant faces having chamfering shapes of different angles. In this case, a formed shape of the end portion of each groove-shaped recess can be obtained correctly by optimizing the amount and the range of the material that is caused to flow by the end portion, in the longitudinal direction, of each projection strip by properly setting the angles of the slant faces. The material flow is such that the material flow component in the width direction of each groove-shaped recess is greater around the end portion of the groove-shaped recess, whereby around the end portion of the groove-shaped recess the partitions can be formed sharply in a sense that their thickness is included.

The fine forging method according to the invention may be such that the slant faces are a first slant face that is close to a tip portion of the projection strip and a second slant face that is distant from the tip portion of the projection strip, and that an inclination angle, with respect to a pressing direction of the first punch, of the first slant face is set larger than that of the second slant face. In this case, the first slant face having the larger inclination angle is dug into the material plate at a position that is distant from the end of the groove-shaped recess being formed, whereby initial formation of the groove-shaped recess is started in a state that the influence of a flow of the material on the end portion of the groove-shaped recess is small. Therefore, at this initial stage, around the end portion of the groove-shaped recess, the degree of movement of the material in the longitudinal direction is low and instead the movement of the material is promoted in the width direction of the groove-shaped recess.

As the first slant face is further dug into the material plate, the second slant face having the smaller inclination angle and being closer to the end of the groove-shaped recess being formed comes to be dug into the material plate. Therefore, this time, the material is moved toward the end portion of the groove-shaped recess more than in the width direction of the groove-shaped recess. At this time, since the inclination angle of the second slant face is small, the amount of material that is moved in the longitudinal direction of the groove-shaped recess is made as small as possible and the amount of material moved is reduced around the end portion of the groove-shaped recess, whereby the end portion of the groove-shaped recess is formed sharply. That is, also at the stage that the second slant face is dug, the material flow component in the width direction of the groove-shaped recess is greater around the end portion of the groove-shaped recess, whereby around the end portion of the groove-shaped recess the partitions can be formed sharply in a sense that their thickness is included.

The fine forging method according to the invention may be such that an end portion, in the longitudinal direction, of each of the projection strips of the second punch is formed with a finish slant face having a chamfering shape, and that an inclination angle, with respect to a pressing direction of the second punch, of the finish slant face is set smaller than that of the second slant face. In this case, since the inclination angle of the finish slant face is small, the material movement toward the end portion of the groove-shaped recess at the stage of a finish pressing stroke is minimized. Therefore, the amount of material that is moved in the longitudinal direction of the groove-shaped recess is reduced around the end portion of the groove-shaped recess, whereby the end portion of the groove-shaped recess is formed sharply. That is, also at the stage that the finish slant face is dug, the material flow component in the width direction of the groove-shaped recess is greater around the end portion of the groove-shaped recess, whereby around the end portion of the groove-shaped recess the partitions can be formed sharply in a sense that their thickness is included.

The fine forging method according to the invention may be such that a first tentative formed face and a second tentative formed face are formed in the material plate by the first slant face and the second slant face, respectively, in the tentative forming by the first punch, and that the finish forming by the second punch is performed after a tip point of the finish slant face of the second punch touches the first tentative formed face. In this case, plastic deformation is effected as the tip point of the second punch is pressed against the first tentative formed face that is deeper than the second tentative formed face in the depth direction of the groove-shaped recess and that is more distant from the end of the groove-shaped recess in the longitudinal direction of the groove-shaped recess than the second tentative formed face is. Therefore, the finish forming by the second punch is performed in such a manner as to cause almost no influence on the end portion of the groove-shaped recess in terms of the material movement, whereby the end portion of the groove-shaped recess is formed sharply. Since the inclination angle of the finish slant face of the second punch is set small, the material just under the first tentative formed face is pressed into the inside of the material plate, which prevents what is called a rebound. Therefore, each partition between the groove-shaped recesses can be formed correctly including its portions adjacent to the end portions of the groove-shaped recesses.

In the fine forging method according to the invention, as a result of the finish forming by the second punch an end portion of each of the groove-shaped recesses may be formed with a final finish face that consists of at least the second tentative formed face and a finish formed face that has been formed by the finish forming. In this case, the finish forming is performed by the finish slant face of the second punch whose inclination angle is smaller than the inclination angles of the first tentative formed face and the second tentative formed face. Therefore, even after the first tentative formed face has disappeared as a result of the pressing by the finish slant face, the finish slant face is not brought into surface contact with the second tentative formed face and the finish slant face moves, in the pressing direction, the material at the end portion of the second tentative formed face. Therefore, at least the second tentative formed face and a finish formed face that is continuous with the second tentative formed face can be formed reliably at the end portion of the groove-shaped recess. A shape of end portion of the groove-shaped recess can thus be formed correctly.

In the fine forging method according to the invention, the end portion of each of the groove-shaped recesses may be formed with a final finish face that consists of the second tentative formed face, part of the first tentative formed face, and the finish formed face that has been formed by the finish forming. In this case, the finish forming is performed by the finish slant face of the second punch whose inclination angle is smaller than the inclination angle of the first tentative formed face. Therefore, the finish slant face is not brought into surface contact with the first tentative formed face and the finish slant face moves, in the pressing direction, the material at the end portion of the first tentative formed face. Part of the first tentative formed face remains after this material movement, whereby a finish formed face consisting of the second tentative formed face, part of the first tentative formed face, and a finish formed face that is continuous with the part of the first tentative formed face is formed reliably at the end portion of the groove-shaped recess. A shape of the end portion of the groove-shaped recess can thus be formed correctly.

In the fine forging method according to the invention, each of the projection strips of the first punch and the second punch may be formed with a wedge-shaped tip portion that is formed by slant faces of a mountain shape and two side surfaces of the projection strip are connected smoothly to the respective slant faces at boundaries. In this case, since the lower portions of the groove-shaped recesses are given a V-shape, the volume of the groove-shaped recesses is maximized and the rigidity of the base portions of the partitions is increased to stabilize the strength of the partitions.

In the fine forging method according to the invention, a pitch of the projection strips of the second punch may be longer than that of the first punch. In this case, a final finish shape can be obtained smoothly and reliably at the time of the finish formed by the second punch. There is a phenomenon that a material plate that is released from the first punch because of its retreat after the pressure forming (tentative forming) by the projection strips of the first punch is slightly increased in dimensions. Because of this phenomenon, the pitch of groove-shaped recesses formed by the first punch is slightly increased from the pitch of the projection strips of the first punch. In view of this, the pitch of the projection strips of the second punch is set equal to the thus-increased pitch of the groove-shaped recesses. As a result, correct finish forming can be performed smoothly and reliably by the projection strips of the second punch whose pitch matches the dimensions obtained by the tentative forming, without causing forced deformation of the material plate. The pitch of the projection strips of the second punch may be set shorter than or equal to 0.3 mm, in which case even preferable finishing can be attained in, for example, working for producing a component of a liquid ejection head.

To attain the above objects, the invention provides a manufacturing method of a liquid ejection head that has a metal chamber formation plate in which groove-shaped recesses to serve as pressure generation chambers are arrayed and a communication hole is formed at one end of each of the groove-shaped recesses so as to penetrate through the chamber formation plate in a thickness direction, a metal nozzle plate in which nozzle orifices are formed at positions corresponding to the respective communication holes, and a metal sealing plate that closes openings of the groove-shaped recesses and in which a liquid supply hole is formed at a position corresponding to the other end of each of the groove-shaped recesses, and in which the sealing plate is joined to a groove-shaped-recess-side surface of the chamber formation plate and the nozzle plate is joined to an opposite surface of the chamber formation plate, characterized in that the groove-shaped recesses of the chamber formation plate are formed by the fine forging method as set forth in any one of claims 1 to 14.

Therefore, the groove-shaped recesses are formed in a material plate of the chamber formation plate by making good use of the advantageous workings and effects of the fine forging method of the invention. Exemplary manners of forming the chamber formation plate that are based on the above advantageous workings and effects will be described below.

That is, the groove-shaped recesses of the chamber formation plate of the liquid ejection head are formed by the fine forging method of the invention. For example, first, tentative forming by the first punch forms a material plate to such a stage that a final shape has not been obtained. Subsequently, finish forming is performed by using the second punch. Since plastic working is performed sequentially, that is, gradually, by using the first punch and the second punch, a desired formed shape can be obtained correctly even if it is minute without causing any problems, that is, without producing an abnormal shape or causing a crack in the material plate. In general, anisotropic etching is employed to form such minute structures. However, anisotropic etching requires a large number of working steps and hence is disadvantageous in manufacturing cost. In contrast, the above-described fine forging method greatly decreases the number of working steps and hence is very advantageous in cost. Further, capable of forming recesses having uniform volumes, the above-described fine forging method is very effective in, for example, stabilizing the discharge characteristics of a liquid ejection head in, for example, a case of forming pressure generation chambers of the liquid ejection head.

The above manufacturing method of a liquid ejection head may be such that an end portion, in a longitudinal direction, of each of the projection strips of the first punch may be formed with slant faces having chamfering shapes of different angles, that the slant faces are a first slant face that is close to a tip portion of the projection strip and a second slant face that is distant from the tip portion of the projection strip, and that an inclination angle, with respect to a pressing direction of the first punch, of the first slant face is set larger than that of the second slant face. In this case, the first slant face having the larger inclination angle is dug into the chamber formation plate at a position that is distant from the end of the groove-shaped recess being formed, whereby initial formation of the groove-shaped recess is started in a state that the influence of a flow of the material on the end portion of the groove-shaped recess is small. Therefore, at this initial stage, around the end portion of the groove-shaped recess, the degree of movement of the material in the longitudinal direction is low and instead the movement of the material is promoted in the width direction of the groove-shaped recess.

As the first slant face is further dug into the chamber formation plate, the second slant face having the smaller inclination angle and being closer to the end of the groove-shaped recess being formed comes to be dug into the material plate. Therefore, this time, the material is moved toward the end portion of the groove-shaped recess more than in the width direction of the groove-shaped recess. At this time, since the inclination angle of the second slant face is small, the amount of material that is moved in the longitudinal direction of the groove-shaped recess is made as small as possible and the amount of material moved is reduced around the end portion of the groove-shaped recess, whereby the end portion of the groove-shaped recess is formed sharply. That is, also at the stage that the second slant face is dug, the material flow component in the width direction of the groove-shaped recess is greater around the end portion of the groove-shaped recess, whereby around the end portion of the groove-shaped recess the partitions can be formed sharply in a sense that their thickness is included. Therefore, each partition between the groove-shaped recesses can be formed correctly including its portions adjacent to the end portions of the groove-shaped recesses, whereby precisely finished shapes of the pressure generation chambers can be obtained.

The above manufacturing method of a liquid ejection head may be such that a first tentative formed face and a second tentative formed face are formed in the chamber formation plate by the first slant face and the second slant face, respectively, in the tentative forming by the first punch, and that the finish forming by the second punch is performed after a tip point of the finish slant face of the second punch touches the first tentative formed face. In this case, plastic deformation is effected as the tip point of the second punch is pressed against the first tentative formed face that is deeper than the second tentative formed face in the depth direction of the groove-shaped recess and that is more distant from the end of the groove-shaped recess in the longitudinal direction of the groove-shaped recess than the second tentative formed face is. Therefore, the finish forming by the second punch is performed in such a manner as to cause almost no influence on the end portion of the groove-shaped recess in terms of the material movement, whereby the end portion of the groove-shaped recess is formed sharply. Therefore, each partition between the groove-shaped recesses can be formed correctly including its portions adjacent to the end portions of the groove-shaped recesses, whereby precisely finished shapes of the pressure generation chambers can be obtained.

The invention provides a second manufacturing method of a liquid ejection head that has a metal chamber formation plate in which groove-shaped recesses to serve as pressure generation chambers are arrayed and a communication hole is formed at one end of each of the groove-shaped recesses so as to penetrate through the chamber formation plate in a thickness direction, a metal nozzle plate in which nozzle orifices are formed at positions corresponding to the respective communication holes, and a metal sealing plate that closes openings of the groove-shaped recesses and in which a liquid supply hole is formed at a position corresponding to the other end of each of the groove-shaped recesses, and in which the sealing plate is joined to a groove-shaped-recess-side surface of the chamber formation plate and the nozzle plate is joined to an opposite surface of the chamber formation plate, characterized by comprising a first step of forming groove-shaped recesses by using a first punch so that an end portion, in a longitudinal direction, of each of the groove-shaped recesses is formed with at least one slant formed face; and a second step of pressure-digging a second punch past the slant formed face after execution of the first step.

As described above, the manufacturing method comprises the first step of forming groove-shaped recesses by using a first punch so that an end portion, in a longitudinal direction, of each of the groove-shaped recesses is formed with at least one slant formed face, and the second step of pressure-digging a second punch past the slant formed face after execution of the first step. The second punch is pressure-dug past the slant formed face. Therefore, the forming by the second punch is performed so as to cause almost no influence on the end portion of the groove-shaped recess in terms of the material movement, whereby the end portion of the groove-shaped recess is formed sharply. The material just under the slant formed face is pressed into the inside of the material plate, which prevents what is called a rebound. Therefore, each partition between the groove-shaped recesses can be formed correctly including its portions adjacent to the end portions of the groove-shaped recesses. Since in this manner final finish shapes of the end portions of the groove-shaped recesses are formed uniformly without rebounds, the volumes and the shapes of the respective pressure generation chambers can be made constant and the ink discharge characteristics can be kept constant. Further, by virtue of the shapes without rebounds, no disturbance occurs in an ink flow and bubbles do not pile up in the end portions of the groove-shaped recesses.

In the above manufacturing method of a liquid ejection head, the first punch that is used in the first step may be provided with projection strips for forming groove-shaped recesses and gap portions for forming partitions between the groove-shaped recesses. In this case, various dimensions such as the width, length, and depth and the shape of long and narrow groove-shaped recesses can be obtained precisely. A desired formed shape of each partition can be obtained correctly even if it is thin without causing any problems, that is, without producing an abnormal shape or causing a crack in the material plate.

The above manufacturing method of a liquid ejection head may be such that an end portion, in the longitudinal direction, of each of projection strips of the first punch is formed with a slant face having a chamfering shape and a slant formed face is formed by the slant face in the first step, and that the second punch is pressure-dug past the slant formed face in the second step. In this case, a formed shape of the end portion of each groove-shaped recess can be obtained correctly by optimizing the amount and the range of the material that is caused to flow by the end portion, in the longitudinal direction, of each projection strip by properly setting the angle of the slant face.

The above manufacturing method of a liquid ejection head may be such that an end portion, in the longitudinal direction, of each of projection strips of the first punch is formed with slant faces having chamfering shapes of different angles and a plurality of slant formed faces are formed by the respective slant faces in the first step, and that the second punch is pressure-dug past one of the slant formed faces in the second step. In this case, a formed shape of the end portion of each groove-shaped recess can be obtained correctly by optimizing the amount and the range of the material that is caused to flow by the end portion, in the longitudinal direction, of each projection strip by properly setting the angles of the slant faces. The material flow is such that the material flow component in the width direction of each groove-shaped recess is greater around the end portion of the groove-shaped recess, whereby around the end portion of the groove-shaped recess the partitions can be formed sharply in a sense that their thickness is included.

The above manufacturing method of a liquid ejection head may be such that the slant faces are a first slant face that is close to a tip portion of the projection strip and a second slant face that is distant from the tip portion of the projection strip, and that an inclination angle, with respect to a pressing direction of the first punch, of the first slant face is set larger than that of the second slant face. In this case, the first slant face having the larger inclination angle is dug into the material plate at a position that is distant from the end of the groove-shaped recess being formed, whereby initial formation of the groove-shaped recess is started in a state that the influence of a flow of the material on the end portion of the groove-shaped recess is small. Therefore, at this initial stage, around the end portion of the groove-shaped recess, the degree of movement of the material in the longitudinal direction is low and instead the movement of the material is promoted in the width direction of the groove-shaped recess.

As the first slant face is further dug into the material plate, the second slant face having the smaller inclination angle and being closer to the end of the groove-shaped recess being formed comes to be dug into the material plate. Therefore, this time, the material is moved toward the end portion of the groove-shaped recess more than in the width direction of the groove-shaped recess. At this time, since the inclination angle of the second slant face is small, the amount of material that is moved in the longitudinal direction of the groove-shaped recess is made as small as possible and the amount of material moved is reduced around the end portion of the groove-shaped recess, whereby the end portion of the groove-shaped recess is formed sharply. That is, also at the stage that the second slant face is dug, the material flow component in the width direction of the groove-shaped recess is greater around the end portion of the groove-shaped recess, whereby around the end portion of the groove-shaped recess the partitions can be formed sharply in a sense that their thickness is included.

The above manufacturing method of a liquid ejection head may be such that in the first step a first slant formed face and a second slant formed face are formed in a material plate by the first slant face and the second slant face of the first punch, respectively, and that in the second step the second punch is pressure-dug past the first slant formed face. In this case, a formed shape of the end portion of each groove-shaped recess can be obtained correctly by optimizing the amount and the range of the material that is caused to flow by the end portion, in the longitudinal direction, of each projection strip. The material flow is such that the material flow component in the width direction of each groove-shaped recess is greater around the end portion of the groove-shaped recess, whereby around the end portion of the groove-shaped recess the partitions can be formed sharply in a sense that their thickness is included.

The above manufacturing method of a liquid ejection head may be such that the second punch that is used in the second step is provided with projection strips for forming groove-shaped recesses and gap portions for forming partitions between the groove-shaped recesses, and that groove-shaped recesses are formed tentatively in a material plate by the first punch in the first step and finish forming is performed on the tentatively formed groove-shaped recesses in the second step. In this case, first, tentative forming by the first punch forms a material plate to such a stage that a final shape has not been obtained. Subsequently, finish forming is performed by using the second punch. Since plastic working is performed sequentially, that is, gradually, by using the first punch and the second punch, a desired formed shape can be obtained correctly even if it is minute without causing any problems, that is, without producing an abnormal shape or causing a crack in the material plate. In general, anisotropic etching is employed to form such minute structures. However, anisotropic etching requires a large number of working steps and hence is disadvantageous in manufacturing cost. In contrast, the above-described fine forging method greatly decreases the number of working steps and hence is very advantageous in cost. Further, capable of forming recesses having uniform volumes, the above-described fine forging method is very effective in, for example, stabilizing the discharge characteristics of a liquid ejection head in, for example, a case of forming pressure generation chambers of the liquid ejection head.

In the above manufacturing method of a liquid ejection head, a depth of digging of the second punch into the material plate in the second step may be greater than that of the first punch into the material plate in the first step. In this case, since the digging depth of the second punch is greater than that of the first punch, the finish forming can reliably deform a shape that has been formed tentatively by the first punch and hence a desired shape can be obtained reliably.

The manufacturing method of a liquid ejection head may be such that an end portion, in the longitudinal direction, of each of the projection strips of the second punch is formed with a finish slant face having a chamfering shape, and that an inclination angle, with respect to a pressing direction of the second punch, of the finish slant face is set smaller than that of the second slant face. In this case, since the inclination angle of the finish slant face is small, the material movement toward the end portion of the groove-shaped recess at the stage of a finish pressing stroke is minimized. Therefore, the amount of material that is moved in the longitudinal direction of the groove-shaped recess is reduced around the end portion of the groove-shaped recess, whereby the end portion of the groove-shaped recess is formed sharply. That is, also at the stage that the finish slant face is dug, the material flow component in the width direction of the groove-shaped recess is greater around the end portion of the groove-shaped recess, whereby around the end portion of the groove-shaped recess the partitions can be formed sharply in a sense that their thickness is included.

In the manufacturing method of a liquid ejection head, as a result of the finish forming by the second punch an end portion of each of the groove-shaped recesses is formed with a finish face that consists of at least the second tentative formed face and a finish formed face that has been formed by the finish forming. In this case, the finish forming is performed by the finish slant face of the second punch whose inclination angle is smaller than the inclination angles of the first tentative formed face and the second tentative formed face. Therefore, even after the first tentative formed face has disappeared as a result of the pressing by the finish slant face, the finish slant face is not brought into surface contact with the second tentative formed face and the finish slant face moves, in the pressing direction, the material at the end portion of the second tentative formed face. Therefore, at least the second tentative formed face and a finish formed face that is continuous with the second tentative formed face can be formed reliably at the end portion of the groove-shaped recess. A shape of the end portion of the groove-shaped recess can thus be formed correctly.

In the manufacturing method of a liquid ejection head, the end portion of each of the groove-shaped recesses is formed with a finish face that consists of the second tentative formed face, part of the first tentative formed face, and the finish formed face that has been formed by the finish forming. In this case, the finish forming is performed by the finish slant face of the second punch whose inclination angle is smaller than the inclination angle of the first tentative formed face. Therefore, the finish slant face is not brought into surface contact with the first tentative formed face and the finish slant face moves, in the pressing direction, the material at the end portion of the first tentative formed face. Part of the first tentative formed face remains after this material movement, whereby a finish formed face consisting of the second tentative formed face, part of the first tentative formed face, and a finish formed face that is continuous with the part of the first tentative formed face is formed reliably at the end portion of the groove-shaped recess. A shape of the end portion of the groove-shaped recess can thus be formed correctly.

The manufacturing method of a liquid ejection head may be such that the second punch that is used in the second step is a boring punch for forming communication holes, and that in the second step communication holes are formed in the groove-shaped recesses that have been formed in the first step. In this case, since each communication hole is formed by pressure-digging the boring punch past the slant formed face, the formation of each communication hole is performed so as to cause almost no influence on the end portion of the groove-shaped recess in terms of the material movement, whereby the end portion of the groove-shaped recess is formed sharply. The material just under the slant formed face is pressed into the inside of the material plate, which prevents what is called a rebound. Therefore, each partition between the groove-shaped recesses can be formed correctly including its portions adjacent to the end portions of the groove-shaped recesses. Since in this manner finish shapes around the communication holes at the end portions of the groove-shaped recesses are formed uniformly without rebounds, no disturbance occurs in an ink flow and bubbles do not pile up around the communication holes and hence the ink discharge characteristics can be kept constant.

The above manufacturing method of a liquid ejection head may be such that in the first step groove-shaped recesses are formed tentatively in a material plate by a tentative working punch in which projection strips for forming groove-shaped recesses are arranged and then finish forming is performed by using a finish working punch in which projection strips for forming groove-shaped recesses in the tentatively formed groove-shaped recesses are arranged, and that in the second step communication holes are formed, by a boring punch, in the groove-shaped recesses that have been formed in the first step. In this case, first, the tentative forming by the first punch forms a material plate to such a stage that a final shape has not been obtained. The finish forming is performed subsequent to the tentative forming. Since plastic working is performed sequentially, that is, gradually, a desired formed shape can be obtained correctly even if it is minute without causing any problems, that is, without producing an abnormal shape or causing a crack in the material plate. In general, anisotropic etching is employed to form such minute structures. However, anisotropic etching requires a large number of working steps and hence is disadvantageous in manufacturing cost. In contrast, the above-described fine forging method greatly decreases the number of working steps and hence is very advantageous in cost. Further, capable of forming recesses having uniform volumes, the above-described fine forging method is very effective in, for example, stabilizing the discharge characteristics of a liquid ejection head in, for example, a case of forming pressure generation chambers of the liquid ejection head.

Since each communication hole is formed by pressure-digging the boring punch past the slant formed face, the formation of each communication hole is performed so as to cause almost no influence on the end portion of the groove-shaped recess in terms of the material movement, whereby the end portion of the groove-shaped recess is formed sharply. The material just under the slant formed face is pressed into the inside of the material plate, which prevents what is called a rebound. Therefore, each partition between the groove-shaped recesses can be formed correctly including its portions adjacent to the end portions of the groove-shaped recesses. Since in this manner finish shapes around the communication holes at the end portions of the groove-shaped recesses are formed uniformly without rebounds, no disturbance occurs in an ink flow and bubbles do not pile up around the communication holes and hence the ink discharge characteristics can be kept constant.

In the above manufacturing method of a liquid ejection head, a depth of digging of the finish working punch into the material plate may be greater than that of the tentative working punch into the material plate. In this case, since the digging depth of the finish working punch is greater than that of the tentative working punch, the finish forming can reliably deform a shape that has been formed by the tentative working punch and hence a desired shape can be obtained reliably.

In the above manufacturing method of a liquid ejection head, an end portion, in the longitudinal direction, of each of the projection strips of the tentative working punch may be formed with slant faces having chamfering shapes of different angles. In this case, a formed shape of the end portion of each groove-shaped recess can be obtained correctly by optimizing the amount and the range of the material that is caused to flow by the end portion, in the longitudinal direction, of each projection strip by properly setting the angles of the slant faces. The material flow is such that the material flow component in the width direction of each groove-shaped recess is greater around the end portion of the groove-shaped recess, whereby around the end portion of the groove-shaped recess the partitions can be formed sharply in a sense that their thickness is included.

The above manufacturing method of a liquid ejection head may be that the slant faces are a first slant face that is close to a tip portion of the projection strip and a second slant face that is distant from the tip portion of the projection strip, and that an inclination angle, with respect to a pressing direction of the tentative working punch, of the first slant face is set larger than that of the second slant face. In this case, the first slant face having the larger inclination angle is dug into the material plate at a position that is distant from the end of the groove-shaped recess being formed, whereby initial formation of the groove-shaped recess is started in a state that the influence of a flow of the material on the end portion of the groove-shaped recess is small. Therefore, at this initial stage, around the end portion of the groove-shaped recess, the degree of movement of the material in the longitudinal direction is low and instead the movement of the material is promoted in the width direction of the groove-shaped recess.

As the first slant face is further dug into the material plate, the second slant face having the smaller inclination angle and being closer to the end of the groove-shaped recess being formed comes to be dug into the material plate. Therefore, this time, the material is moved toward the end portion of the groove-shaped recess more than in the width direction of the groove-shaped recess. At this time, since the inclination angle of the second slant face is small, the amount of material that is moved in the longitudinal direction of the groove-shaped recess is made as small as possible and the amount of material moved is reduced around the end portion of the groove-shaped recess, whereby the end portion of the groove-shaped recess is formed sharply. That is, also at the stage that the second slant face is dug, the material flow component in the width direction of the groove-shaped recess is greater around the end portion of the groove-shaped recess, whereby around the end portion of the groove-shaped recess the partitions can be formed sharply in a sense that their thickness is included.

The above manufacturing method of a liquid ejection head may be such that an end portion, in the longitudinal direction, of each of the projection strips of the finish working punch is formed with a finish slant face having a chamfering shape, and that an inclination angle, with respect to a pressing direction of the finish working punch, of the finish slant face is set smaller than that of the second slant face. In this case, since the inclination angle of the finish slant face is small, the material movement toward the end portion of the groove-shaped recess at the stage of a finish pressing stroke is minimized. Therefore, the amount of material that is moved in the longitudinal direction of the groove-shaped recess is reduced around the end portion of the groove-shaped recess, whereby the end portion of the groove-shaped recess is formed sharply. That is, also at the stage that the finish slant face is dug, the material flow component in the width direction of the groove-shaped recess is greater around the end portion of the groove-shaped recess, whereby around the end portion of the groove-shaped recess the partitions can be formed sharply in a sense that their thickness is included.

The above manufacturing method of a liquid ejection head may be such that a first tentative formed face and a second tentative formed face are formed in the material plate by the first slant face and the second slant face, respectively, in the tentative forming by the tentative working punch, and that the finish forming by the finish working punch is performed after a tip point of the finish slant face of the finish working punch touches the first tentative formed face. In this case, plastic deformation is effected as the tip point of the finish working punch is pressed against the first tentative formed face that is deeper than the second tentative formed face in the depth direction of the groove-shaped recess and that is more distant from the end of the groove-shaped recess in the longitudinal direction of the groove-shaped recess than the second tentative formed face is. Therefore, the finish forming by the finish working punch is performed in such a manner as to cause almost no influence on the end portion of the groove-shaped recess in terms of the material movement, whereby the end portion of the groove-shaped recess is formed sharply. Since the inclination angle of the finish slant face of the finish working punch is set small, the material just under the first tentative formed face is pressed into the inside of the material plate, which prevents what is called a rebound. Therefore, each partition between the groove-shaped recesses can be formed correctly including its portions adjacent to the end portions of the groove-shaped recesses.

In the above manufacturing method of a liquid ejection head, as a result of the finish forming by the finish working punch an end portion of each of the groove-shaped recesses may be formed with a finish face that consists of the second tentative formed face, part of the first tentative formed face, and the finish formed face that has been formed by the finish forming. In this case, the finish forming is performed by the finish slant face of the finish working punch whose inclination angle is smaller than the inclination angle of the first tentative formed face. Therefore, the finish slant face is not brought into surface contact with the first tentative formed face and the finish slant face moves, in the pressing direction, the material at the end portion of the first tentative formed face. Part of the first tentative formed face remains after this material movement, whereby a finish formed face consisting of the second tentative formed face, part of the first tentative formed face, and a finish formed face that is continuous with the part of the first tentative formed face is formed reliably at the end portion of the groove-shaped recess. A shape of the end portion of the groove-shaped recess can thus be formed correctly.

In the above manufacturing method of a liquid ejection head, in the second step the boring punch may be dug past one of the second tentative formed face, the part of the first tentative formed face, and the finish formed face of the finish face that has been formed at the end portion of each of the groove-shaped recesses in the first step. In this case, since each communication hole is formed by pressure-digging the boring punch past the slant formed face, the formation of each communication hole is performed so as to cause almost no influence on the end portion of the groove-shaped recess in terms of the material movement, whereby the end portion of the groove-shaped recess is formed sharply. The material just under the slant formed face is pressed into the inside of the material plate, which prevents what is called a rebound. Therefore, each partition between the groove-shaped recesses can be formed correctly including its portions adjacent to the end portions of the groove-shaped recesses. Since in this manner finish shapes around the communication holes at the end portions of the groove-shaped recesses are formed uniformly without rebounds, no disturbance occurs in an ink flow and bubbles do not pile up around the communication holes and hence the ink discharge characteristics can be kept constant.

Further, to attain the above objects, the invention provides a liquid ejection head that has a metal chamber formation plate in which groove-shaped recesses to serve as pressure generation chambers are arrayed and a communication hole is formed at one end of each of the groove-shaped recesses so as to penetrate through the chamber formation plate in a thickness direction, a metal nozzle plate in which nozzle orifices are formed at positions corresponding to the respective communication holes, and a metal sealing plate that closes openings of the groove-shaped recesses, and in which the sealing plate is joined to a groove-shaped-recess-side surface of the chamber formation plate and the nozzle plate is joined to an opposite surface of the chamber formation plate, characterized in that an end portion, in a longitudinal direction, of each of the groove-shaped recesses is formed with a slant portion and a formed surface that is continuous with the slant portion has an inclination angle that is different from an inclination angle of the slant portion.

As described above, an end portion, in a longitudinal direction, of each of the groove-shaped recesses is formed with a slant portion and a formed surface that is continuous with the slant portion has an inclination angle that is different from an inclination angle of the slant portion. Therefore, the metal flows smoothly during pressing by the punch and hence the dimensional accuracy of the end portion of even a very minute groove-shaped recess can be increased. The partitions can be given a sufficient height. At the end portion of each pressure generation chamber, a liquid flows along the slant portion and the formed face without stagnation. Therefore, stay of bubbles can be prevented at the end portion, and bubbles that have entered into the pressure generation chamber can be ejected reliably being carried by a liquid flow.

In the liquid ejection head according to the invention, the formed face may be steeper than the slant face. In this case, stay of bubbles can be prevented effectively at the end portion of each pressure generation chamber, and bubbles that have entered into the pressure generation chamber can be ejected reliably being carried by a liquid flow.

In the liquid ejection head according to the invention, the slant portion may consist of two slant faces having different inclination angles. In this case, at the end portion of each pressure generation chamber, a liquid flows along the two slant faces and the formed face without stagnation. Therefore, stay of bubbles can be prevented at the end portion, and bubbles that have entered into the pressure generation chamber can be ejected reliably being carried by a liquid flow.

The liquid ejection head according to the invention may be such that the two slant faces having the different inclination angles are a first slant face that is close to a bottom portion of the groove-shaped recess and a second slant face that is distant from the bottom portion of the groove-shaped recess and the formed face is continuous with the first slant face. In this case, at the end portion of each pressure generation chamber, a liquid flows along the first and second slant faces and the formed face without stagnation. Therefore, stay of bubbles can be prevented at the end portion, and bubbles that have entered into the pressure generation chamber can be ejected reliably being carried by a liquid flow.

In the liquid ejection head according to the invention, the second slant face may be steeper than the first slant face. In this case, the slant face that is close to the groove bottom portion is inclined relatively gently, the load imposed on the second punch is light when the second punch is dug past part of that slant face. This makes it possible to dig the second punch adjacent to the bottom end of an end face while maintaining the durability of the second punch. Since the second punch is dug past the slant face, no flat face that is parallel with the groove bottom portion is formed between the slant face formed by the first punch and the slant face formed by the second punch, stay of bubbles that have entered into the pressure generation chamber can be prevented. Further, since the slant face that is close to the groove opening is relatively steep, the volume of the end portion of the groove-shaped recess can be made as small as possible and hence the degree of stagnation of a liquid can be reduced there.

In the liquid ejection head according to the invention, the formed face that is continuous with the slant portion may be an end face of the pressure generation chamber. In this case, stay of bubbles can be prevented at the end portion of the pressure generation chamber, and bubbles that have entered into the pressure generation chamber can be ejected reliably being carried by a liquid flow.

In the liquid ejection head according to the invention, the formed face that is continuous with the slant portion may be part of the communication hole. In this case, stay of bubbles can be prevented at the portion from the end portion of the pressure generation chamber to the communication hole, and bubbles that have entered into the pressure generation chamber can be ejected reliably being carried by a liquid flow.

The liquid ejection head may be a liquid ejection head in which liquid channels that reach nozzle orifices via pressure generation chambers are formed in a channel unit, and that can discharge liquid ejects from the nozzle orifices by causing pressure generating elements to generate pressure variations in liquids in the pressure generation chambers, characterized in:

that the channel unit comprises:

a metal chamber formation plate in which a plurality of groove-shaped recesses to serve as the pressure generation chambers are arrayed in a groove width direction and that is formed with communication holes each of which penetrates through the chamber formation plate in a thickness direction from a bottom portion at one end, in a longitudinal direction, of the groove-shaped recess;

a sealing plate that is joined to one surface of the chamber formation plate and closes openings of the groove-shaped recesses; and a nozzle plate that is formed with the nozzle orifices and is joined to the other surface of the chamber formation plate; and that an end portion, in the longitudinal direction, of each of the groove-shaped recesses is formed with a slant portion and the communication hole is formed so as to be continuous with the slant portion.

The liquid ejection head may be configured such that a communication-hole-side end face of the slant portion is a slant face that is inclined so that a length of the groove-shaped recess increases as the position goes toward a groove opening and the communication hole is formed adjacent to a bottom end of the communication-hole-side end face.

The liquid ejection head may be configured such that an slope angle, with respect to a groove bottom portion, of the communication-hole-side end face is set larger than or equal to 45° and smaller than 90°.

The term "slope angle" means an slope angle with respect to a reference line that extends outward in the groove longitudinal direction parallel with the groove bottom portion.

The liquid ejection head may be configured such that the communication-hole-side end face is a series of slant faces having different slope angles with respect to the groove bottom portion.

The liquid ejection head may be configured such that the communication-hole-side end face is a series of slant faces whose slope angle with respect to the groove bottom portion increases as the position goes away from the groove bottom portion.

The liquid ejection head may be configured such that the communication-hole-side end face is a curved slant face whose slope angle with respect to the groove bottom portion increases as the position goes away from the groove bottom portion.

The liquid ejection head may be configured such that a distance from a top end of the communication-hole-side end face to a slant-portion-side opening edge of the communication hole is shorter than a depth of the groove-shaped recesses.

The liquid ejection head may be configured such that a supply-side end face of each of the groove-shaped recesses that is opposite to the communication-hole-side end face in the longitudinal direction is a slant face that is inclined so that a length of the groove-shaped recess increases toward the groove opening.

The liquid ejection head may be configured such that an slope angle, with respect to a groove bottom portion, of the supply-side end face is set larger than or equal to 45° and smaller than 90°.

The liquid ejection head may be configured such that the supply-side end face is a series of slant faces having different slope angles with respect to the groove bottom portion.

The liquid ejection head may be configured such that the supply-side end face is a series of slant faces whose slope angle with respect to the groove bottom portion increases as the position goes away from the groove bottom portion.

The liquid ejection head may be configured such that the supply-side end face is a curved slant face whose slope angle with respect to the groove bottom portion increases as the position goes away from the groove bottom portion.

BRIEF DESCRIPTION OF THE DRAWINGS

FIG. 5 illustrates the chamber formation plate in which

FIG. 7 illustrates the elastic plate in which

FIG. 12 shows a first punch and a second punch in a first embodiment of the invention in which

FIG. 15 illustrates a second embodiment of the invention in which

FIG. 16 illustrates a third embodiment of the invention in which FIGS. 16A and 16B show how a groove-shaped recess is formed in a first step and FIGS. 15C and 15D show how a communication hole is formed in a second step;

FIG. 17 shows a groove-shaped recess according to a fourth embodiment of the invention in which

FIG. 18 illustrates a groove-shaped recesses forming step in which

FIG. 19 illustrates the groove-shaped recesses forming step in which

FIG. 20 illustrates a communication holes forming step in which

FIG. 21 illustrates a communication holes forming step in which

DETAILED DESCRIPTION OF THE INVENTION

Embodiments of the present invention will be hereinafter described with reference to the drawings.

As described above, liquid ejection heads as subjects of manufacture in the invention can function for various liquids. The illustrated embodiments are directed to ink jet recording heads as typical examples of liquid ejection heads. The invention can similarly be applied to other liquid ejection heads such as colorant ejection heads, electrode material ejection heads, and bioorganic material ejection heads.

Figure 1:
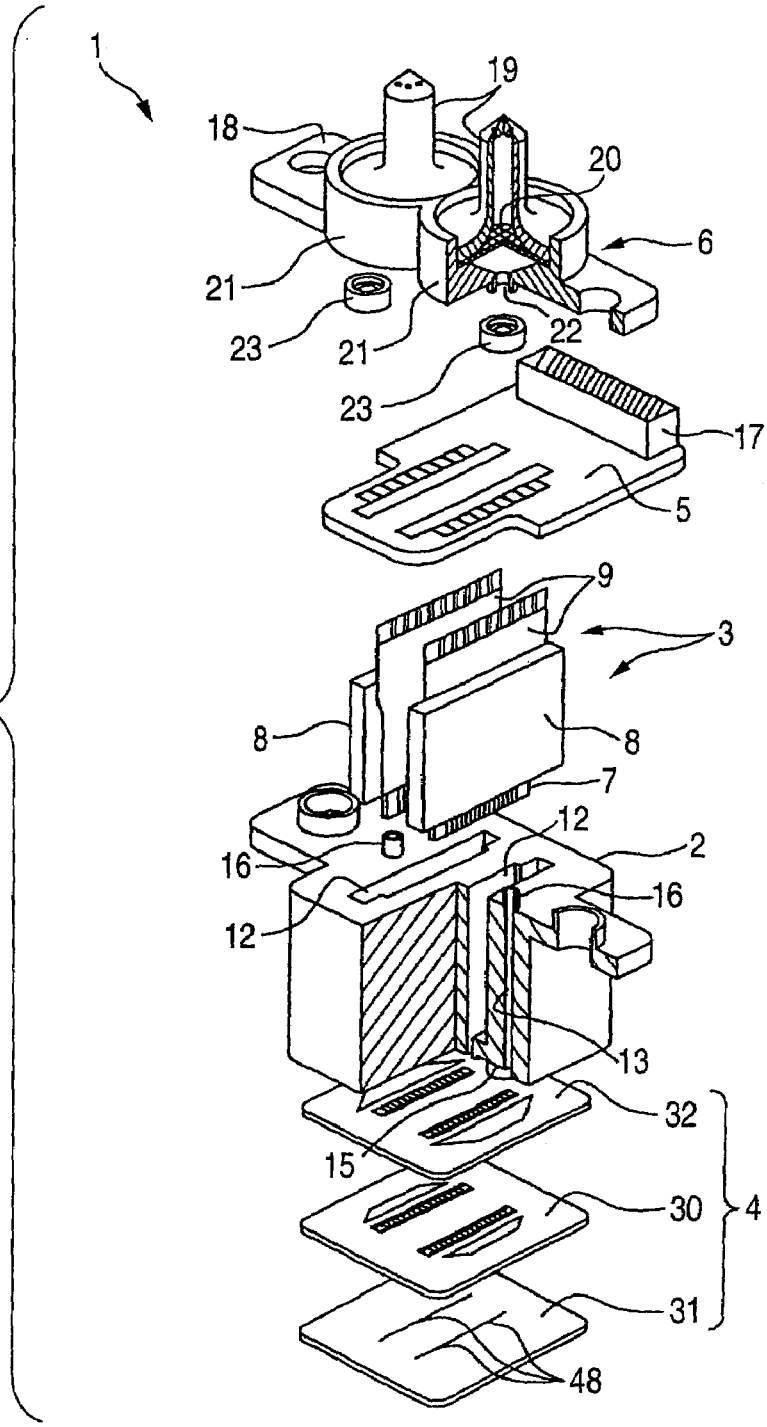
FIG. 1 is an exploded perspective view of an ink jet recording head.
Figure 2:
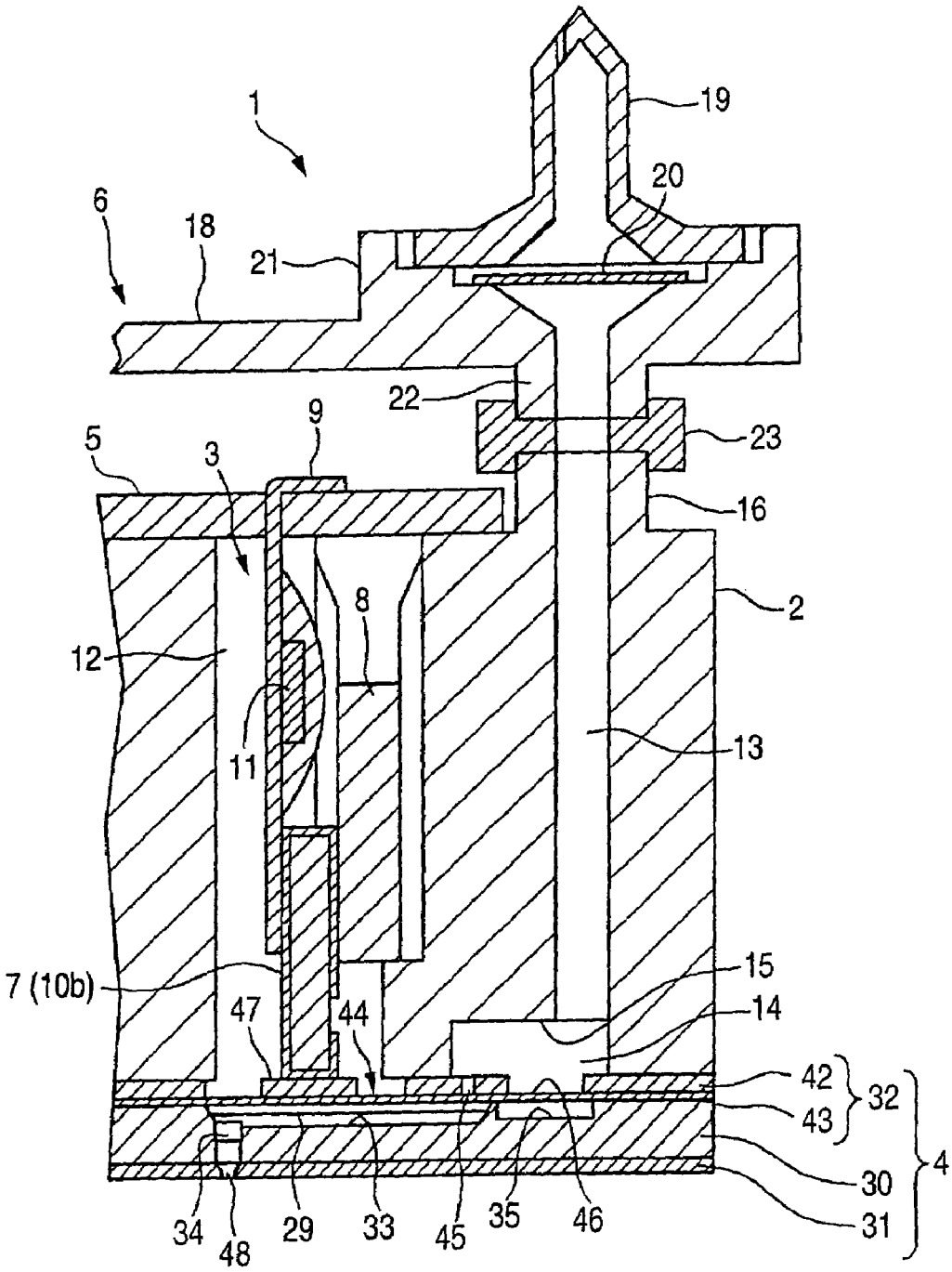
FIG. 2 is a sectional view of the ink jet recording head.

As shown in FIGS. 1 and 2, a recording head 1 is generally composed of a case 2, vibrator units 3 that are housed in the case 2, a channel unit 4 that is joined to the front end face of the case 2, a connection board 5 that is placed on the attachment face, opposed to the front end face, of the case 2, a supply needle unit 6 that is disposed on the attachment face side of the case 2 and attached to the case 2, and other components.

Figure 3A:
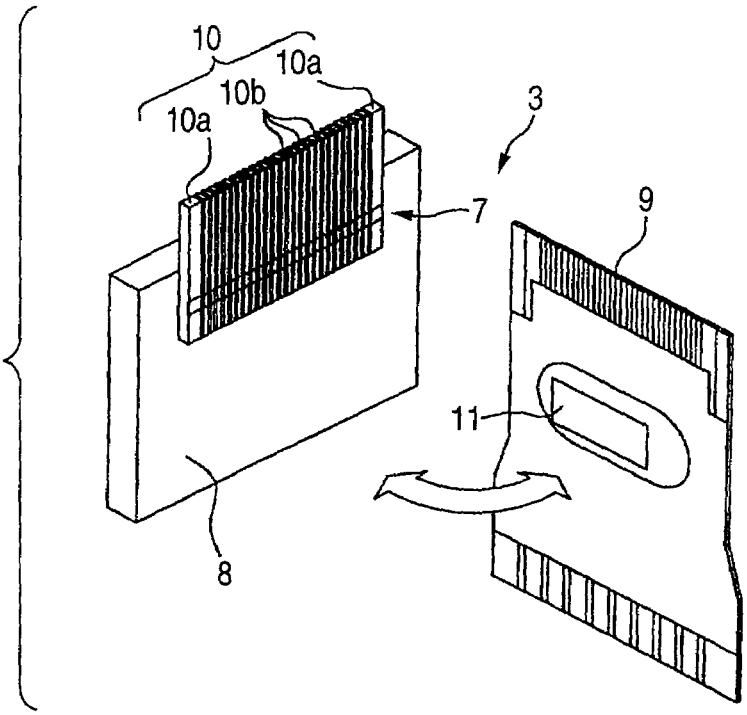
FIGS. 3A and 3B illustrate a vibrator unit.
Figure 3B:
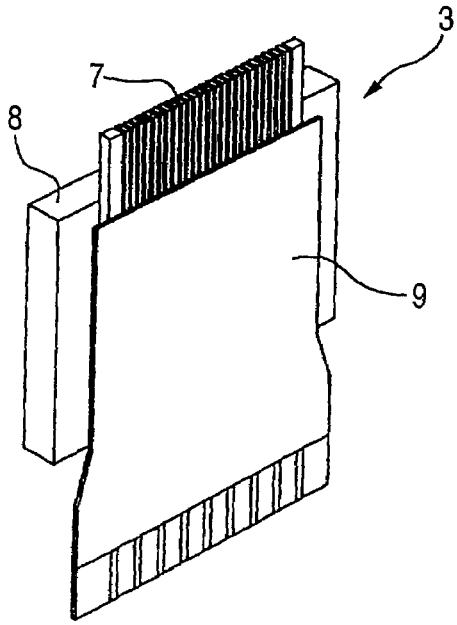

As shown in FIG. 3, each vibrator unit 3 is generally composed of a piezoelectric vibrator unit 7 consisting of pectinated piezoelectric vibrators 10, a fixing plate 8 to which the piezoelectric vibrator unit 7 is joined, and a flexible cable 9 for supplying drive signals to the piezoelectric vibrator unit 7.

The piezoelectric vibrator unit 7 consists of a plurality of piezoelectric vibrators 10 that are arrayed. Each piezoelectric vibrator 10 is a kind of pressure generating element and a kind of electromechanical conversion element. The piezoelectric vibrators 10 are a pair of dummy vibrators 10*a* that are located on both ends of the line and a plurality of driving vibrators 10*b* that are located between the dummy vibrators 10*a*. The driving vibrators 10*b* are separated, by cutting, into pectinated shapes that are as very narrow as about 50 to 100 μm. In this example, 180 driving vibrators 10*b* are provided per unit. The dummy vibrators 10*a* are sufficiently wider than the driving vibrators 10*b* and have a protection function of protecting the driving vibrators 10*b* from impact or the like and a guide function of positioning the vibrator unit 3 at a prescribed position.

A fixed end portion of each piezoelectric vibrator 10 is joined to the fixing plate 8 and a free end portion projects outward from the front end face of the fixing plate 8. That is, each piezoelectric vibrator 10 is supported by the fixing plate 8 in a cantilevered manner. The free end portion of each piezoelectric vibrator 10, which is formed by laminating a piezoelectric body and internal electrodes one on another, expands and contracts in the element longitudinal direction when a voltage difference is given between the electrodes that are opposed to each other.

The flexible cable 9 is a flexible, tape-shaped wiring member for supplying drive signals to the piezoelectric vibrators 10. The flexible cable 9 is electrically connected to the side surfaces, opposed to the fixing plate 8, of the fixed end portions of the piezoelectric vibrators 10. A control IC 11 for controlling driving etc. of the piezoelectric vibrators 10 is mounted on a surface of the flexible cable 9. The fixing plate 8 for supporting the piezoelectric vibrators 10 is a plate-shaped member that is rigid enough to receive reaction force from the piezoelectric vibrators 10. The fixing plate 8 is preferably a metal plate such as a stainless steel plate.

For example, the case 2 is a block-shaped member that is molded with a thermosetting resin such as an epoxy resin. The reasons why the case 2 is molded with a thermosetting resin are that thermosetting resins are mechanically stronger than general resins and that they have smaller linear expansion coefficients and hence are deformed less due to a variation in environment temperature than general resins. The case 2 is formed inside with accommodation spaces 12 capable of accommodating the vibrator units 3 and ink supply passages 13 each of which is part of an ink channel. The front end face of the case 2 is formed with front recesses 15 to serve as common ink chambers (i.e., reservoirs) 14.

Each accommodation space 12 is a space that is large enough to accommodate a vibrator unit 3. In a front end portion of the accommodation space 12, a case inner wall partially projects sideways. The top face of the projected portion serves as a fixing plate contact face. The vibrator unit 3 is accommodated in the accommodation space 17 in such a manner that the front end faces of the respective piezoelectric vibrators 24 appear in the front end opening of the accommodation space 12. The vibrator unit 3 is accommodated in the accommodation space 12 and fixed to the fixing plate 8 in the state that the front end faces of the respective piezoelectric vibrators 10 appear in the front end opening of the accommodation space 12. In this accommodation state, the front end face of the fixing plate 8 is bonded to the case 2 in a state that the former is in contact with the fixing plate contact face. In this accommodation state, the front end faces of the piezoelectric vibrators 10 are joined to islands 47 of the channel unit 4, respectively. Therefore, as the piezoelectric vibrators 10 expand or contract, the islands 47 are pushed or pulled and diaphragm portions 44 are deformed.

The front recesses 15 are formed by partially denting the front end face of the case 2. As described later, the top recesses 15 serve as the reservoirs (common ink chambers) 14 when sealed by an elastic plate 32 of the channel unit 4. The front ends of the ink supply passages 13 communicate with the respective front recesses 15. The front recesses 15 of this embodiment are generally trapezoidal recesses that are formed outside, that is, on the right and left of, the respective accommodation spaces 12 in such a manner that the trapezoid bottom bases are located on the side of the accommodation spaces 12.

The ink supply passages 13 penetrate through the case 2 in its height direction and communicate with the respective front recesses 15. The attachment-side ends of the ink supply passages 13 are formed through connection ports 16, respectively, that project from the attachment face.

The connection board 5 is a wiring board on which an electric wiring for various signals to be supplied to the recording head 1 is formed and to which a connector 17 is attached to which a signal cable can be connected. The connection board 5 is placed on the attachment surface of the case 2, and the electric wirings of the flexible cables 9 are connected to the connection board 5 by soldering or the like. The tip of a signal cable from a controller (not shown) is inserted into the connector 17.

The supply needle unit 6 is a unit to which ink cartridges (not shown) are to be connected in each of which ink (liquid ink; a kind of liquid as used in the invention) is stored. The supply needle unit 6 is generally composed of a needle holder 18 and ink supply needles 19, and filters 20.

Each ink supply needle 19 is a portion to be inserted into an ink cartridge and serves to introduce the ink stored in the ink cartridge. The tip portion of the ink supply needle 19 is pointed like a cone so as to be easily inserted into an ink cartridge. The tip portion is formed with a plurality of ink introduction holes that communicate with the inside and the outside of the ink supply needle 19. Capable of discharging two kinds of inks, the recording head 1 according to the embodiment has two ink supply needles 19.

The needle holder 18 is a member to which the ink supply needles 19 are attached. Two pedestals 21 to which the base portions of the ink supply needles 19 are tied up are formed on a surface of the needle holder 18 so as to be arranged in the longitudinal direction. The pedestals 21 has a circular shape that conforms to a bottom shape of the ink supply needles 19. Ink ejection holes 22 are formed approximately at the centers of the bottoms of the pedestals 21, respectively, so as to penetrate through the needle holder 18 in its thickness direction. Flanges of the needle holder 18 project sideways.

The filters 20 are members for preventing passage of foreign matter in ink such as dust and burrs that were produced at the time of molding, and are fine-mesh metal nets, for example. The filters 20 are bonded to filter holding grooves that are formed in the pedestals 21, respectively.

As shown in FIG. 2, the supply needle unit 6 is placed on the attachment face of the case 2. In a state that the supply needle unit 6 is thus placed, the ink ejection holes 22 of the supply needle unit 6 and the holes of the connection ports 16 of the case 2 communicate with each other via packings 23, respectively, in a liquid-tight manner.

In the recording head 1 having the above configuration, ink stored in each ink cartridge is introduced into the ink supply passage 13 via the ink supply needle 19. The ink fills in the common ink chamber 14, the pressure generation chambers 29, and the communication holes 34. When a piezoelectric vibrator 10 expands or contracts in the element longitudinal direction, the diaphragm portion 44 is deformed and the volume of the pressure generation chamber 29 is varied. The volume variation causes a pressure variation in the ink that is stored in the pressure generation chamber 29, whereby an ink droplet is ejected from the nozzle orifice 48. For example, if a pressure generation chamber 29 that is in an intermediate volume state is expanded and then contracted rapidly, ink is supplied from the common ink chamber 14 to the pressure generation chamber 29 because of pressure reduction due to the expansion and then an ink droplet is ejected from the nozzle orifice 48 because of pressure increase due to the contraction.

Next, the channel unit 4 will be described. The channel unit 4 is configured in such a manner that a nozzle plate 31 is joined to one surface of a chamber formation plate 30 and an elastic plate 32 is joined to the other surface of the chamber formation plate 30.

The channel unit 4 is a member that is formed inside with ink channels (each being a kind of liquid channel of the invention) each of which consists of an ink supply hole 45 (a kind of liquid supply hole), the pressure generation chamber 29, and the nozzle orifice 48 that are arranged in this order. The channel unit 4 is composed of the metal chamber formation plate 30 that is formed with groove-shaped recesses 33 to serve as the pressure generation chambers 29 and the communication hole 34, the metal nozzle plate 31 that is formed with a plurality of nozzle orifices 48, and the elastic plate 32 (a kind of sealing plate of the invention) that is formed with the diaphragm portions 44 and the ink supply holes 45.

The channel unit 4 is formed by joining the elastic plate 32 to one surface of the chamber formation plate 30 and joining the nozzle plate 31 to the other surface of the chamber formation plate 30. The members 30-32 are joined to each other preferably with a sheet-shaped adhesive, for example. When the members 30-32 are joined to each other, the openings (hereinafter referred to as "recess openings") of the groove-shaped recesses 33 are sealed by the diaphragm portions 44 of the elastic plate 32 and the pressure generation chambers 29 are defined, respectively. The communication holes 34 connect one end portions of the pressure generation chambers 29 to the nozzle orifices 48, respectively, and the ink supply holes 45 communicate with the other end portions of the pressure generation chambers 29, respectively.

The channel unit 4 is joined to the front end face of the case 2 with a sheet-shaped adhesive, for example, in a state that the elastic plate 32 is located on the case 2 side. As a result, the common ink chambers 14 are defined and come to communicate with the pressure generation chambers 29 via the ink supply holes 45.

Figure 4:
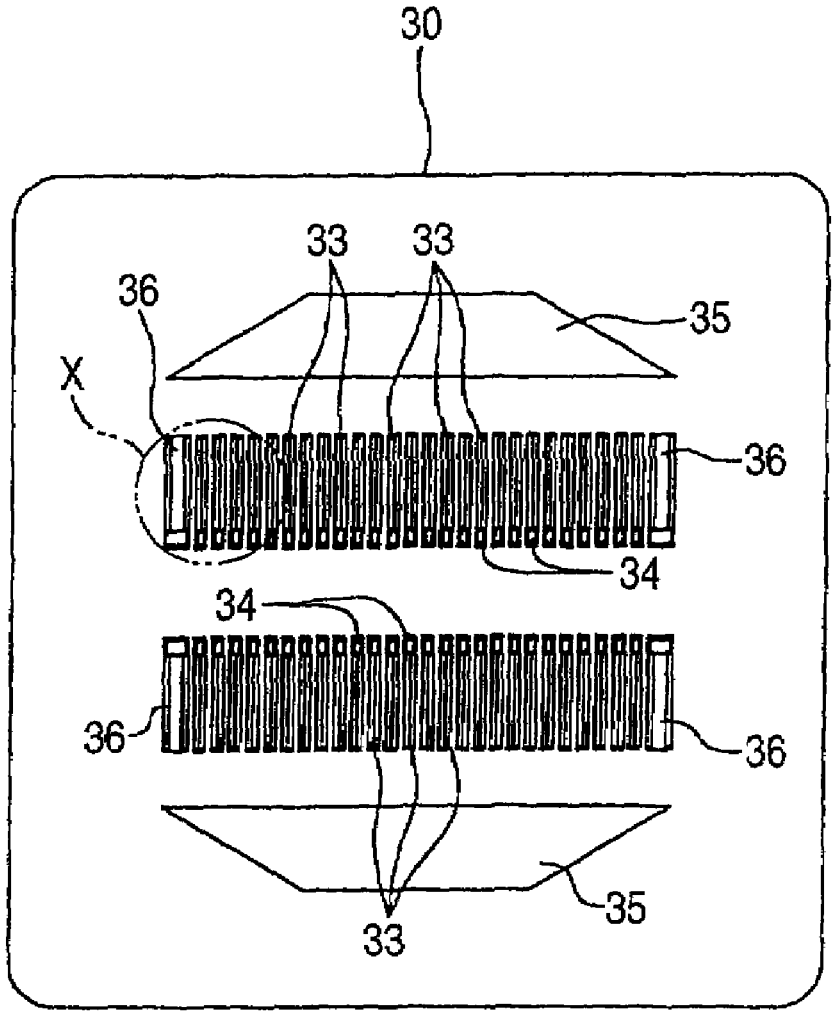
FIG. 4 is a plan view of a chamber formation plate.

As shown in FIG. 4, the chamber formation plate 30 is a metal plate-shaped member that is formed with the groove-shaped recesses 33, the communication holes 34, and escape recesses 35. In this embodiment, the chamber formation plate 30 is formed by performing plastic working on a 0.35-mm-thick nickel substrate.

The reasons why nickel is selected as a substrate material will be described below. A first reason is that the linear expansion coefficient of nickel is approximately equal to that of a metal (in this embodiment, stainless steel (described later)) of which the main parts of the nozzle plate 31 and the elastic plate 32 are made. That is, if the linear expansion coefficients of the chamber formation plate 30, the elastic plate 32, and the nozzle plate 31 which constitute the channel unit 4 are approximately the same, the members 30-32 expand uniformly when they are heat-bonded to each other. Therefore, mechanical stress such as a warp due to differences between the expansion coefficients is unlikely to occur. As a result, the members 30-32 can be bonded to each other without causing any problems even if the bonding temperature is set high. Further, even when the piezoelectric vibrators 10 heat during operation of the recording head 1 and the channel unit 4 is thereby heated, the members 30-32 which constitute the channel unit 4 expand uniformly. Even if heating due to operation of the recording head 1 and cooling due to suspension of operation are repeated, no problems such as peeling likely occur in the members 30-32 constituting the channel unit 4.

A second reason is superior rust resistance. Since this kind of recording head 1 preferably uses an aqueous ink, it is important that the substrate material not change in quality (e.g., not rust) even if it is brought in contact with water for a long time. Nickel is superior in rust resistance like stainless steel and hence is not prone to change in quality (e.g., not prone to rust).

A third reason is superior malleability. In this embodiment, the chamber formation plate 30 is formed by plastic working (described later; e.g., forging). The groove-shaped recesses 33 and the communication holes 34 that are formed in the chamber formation plate 30 are very minute and are required to be high in dimensional accuracy. The use of a nickel substrate which is superior in malleability makes it possible to form the groove-shaped recesses 33 and the communication holes 34 with high dimensional accuracy even by plastic working.

The chamber formation plate 30 may be made of a metal other than nickel as long as it satisfies the requirements relating to the linear expansion coefficient, the rust resistance, and the malleability.

Figure 5A:
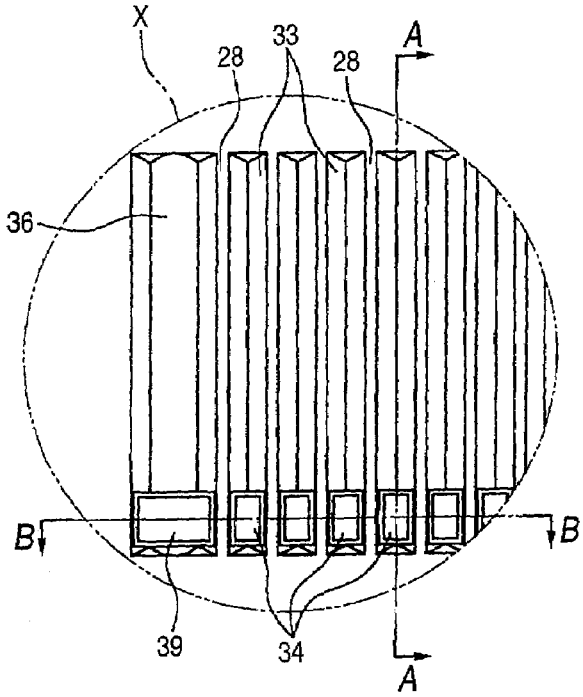
FIG. 5A is an enlarged view of part X in FIG. 4.
Figure 5B:
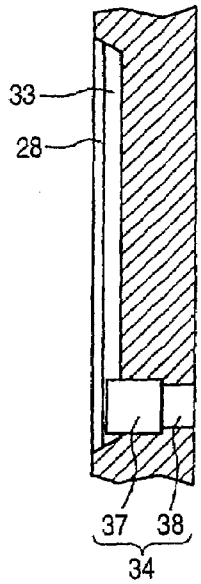
FIG. 5B is a sectional view taken along line A-A in FIG. 5A.
Figure 5C:
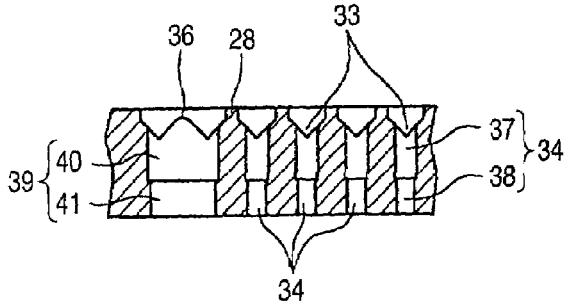
FIG. 5C is a sectional view taken along line B-B in FIG. 5A.

As shown in FIG. 5 in an enlarged manner, the groove-shaped recesses 33 to serve as the pressure generation chambers 29 are linear grooves. In this embodiment, 180 grooves each measuring about 0.1 mm in width, about 1.5 mm in length, and about 0.1 mm in depth are arranged in the groove width direction. The bottom face of each groove-shaped recess 33 decreases in width as the position goes deeper; that is, the bottom face assumes a V-shape. The reason why the bottom face assumes a V-shape is to increase the rigidity of partitions 28 that divide the adjoining pressure generation chambers 29. That is, the bottom faces assuming a V-shape increase the thickness of the bottom portions of the partitions 28 and hence increase the rigidity of the partitions 28.

The highly rigid partitions 28 are less prone to be influenced by pressure variations in the adjacent pressure generation chambers 29. That is, variations in ink pressure are less prone to be transmitted from the adjacent pressure generation chambers 29 to each partition 28. Further, as described later, the bottom faces assuming a V-shape allow the groove-shaped recesses 33 to be formed with high dimensional accuracy by plastic working. The angle of the V-shape is set according to working conditions and is set to about 90°, for example. Since the top portions of the partitions 28 are very thin, a necessary volume can be secured even if the pressure generation chambers 29 are formed densely.

In this embodiment, both end portions, in the longitudinal direction, of each groove-shaped recess 33 are inclined so that their interval decreases as the position goes deeper, that is, they have chamfering shapes. This is also to form the groove-shaped recesses 33 with high dimensional accuracy by plastic working. A process of forming the groove-shaped recesses 33 by plastic working and the shape of each groove-shaped recess 33 will be described later in detail.

One dummy recess 36 that is wider than the groove-shaped recesses 33 is formed adjacent to each of the end groove-shaped recesses 33, respectively. The dummy recesses 36 are groove-shaped recesses to serve as dummy pressure generation chambers that are irrelevant to discharge of ink ejects. Each dummy recess 36 of this embodiment is a groove measuring about 0.2 mm in width, about 1.5 mm in length, and about 0.1 mm in depth. The bottom face of each dummy recess 36 assumes a W-shape. This is also to increase the rigidity of the associated partitions 28 and to form the dummy recesses 36 with high dimensional accuracy by plastic working.

The groove-shaped recesses 33 and the pair of dummy recesses 36 constitute an array of recesses. In this embodiment, two arrays of recesses are formed parallel with each other.

The communication holes 34 are through-holes that penetrate through the chamber formation plate 30 in its thickness direction from one ends of the groove-shaped recesses 33, respectively (i.e., the communication holes 34 are formed for the respective groove-shaped recesses 33). Each array of recesses has 180 communication holes 34. Each of the communication holes 34 of this embodiment has rectangular openings and consists of a first communication hole 37 that extends from the groove-shaped recess 33 of the chamber formation plate 30 to an intermediate position in the thickness direction and a second communication hole 38 that extends from the surface opposite to the groove-shaped recess 33 to the intermediate position.

The first communication hole 37 and the second communication hole 38 have different cross-sections; the inner dimensions of the second communication hole 38 are slightly smaller than those of the first communication hole 37. This results from the fact that the communication holes 34 are formed by press working. More specifically, since the chamber formation plate 30 is formed by working on a 0.35-mm-thick nickel plate, the communication holes 34 are as long as 0.25 mm or more even if the depth of the groove-shaped recesses 33 is deducted. Since the width of the communication holes 34 need to be smaller than the groove width of the groove-shaped recesses 33, it is set smaller than 0.1 mm. Therefore, if it is attempted to punch out each communication hole 34 by one stroke, the punch would buckle or encounter like trouble because of the aspect ratio. In view of this, in this embodiment, each communication hole 34 is formed by two strokes. A first communication hole 37 is formed by the first stroke to an intermediate position in the thickness direction and a second communication hole 38 is formed by the second stroke. A working procedure for forming the communication holes 34 will be described later.

Dummy communication holes 40 are formed for the respective dummy recesses 36. Like each communication hole 34, each dummy communication hole 39 consists of a first dummy communication hole 40 and a second dummy communication hole 41. The inner dimensions of the second dummy communication hole 41 are smaller than those of the first dummy communication hole 40.

In this embodiment, the communication holes 34 and the dummy communication holes 39 are through-holes having rectangular openings. However, the invention is not limited to such a case. For example, they may be through-holes having circular openings.

The escape recesses 35 form operating spaces of compliance portions of the common ink chambers 14, respectively. In this embodiment, the escape recesses 35 are trapezoidal recesses having approximately the same shape as the front recesses 15 of the case 2 and being the same in depth as the groove-shaped recesses 33. The escape recesses 35 may be replaced by through-holes that penetrate through the chamber formation plate 30 in its thickness direction.

Next, the elastic plate 32 will be described. For example, the elastic plate 32, which is a kind of sealing plate, is formed by working on a double-layer composite material (a kind of metal material of the invention) in which an elastic film 43 is laid on a support plate 42. In this embodiment, a stainless steel plate is used as the support plate 42 and a PPS (poly(phenylene sulfide)) film is used as the elastic film 43.

Figure 6:
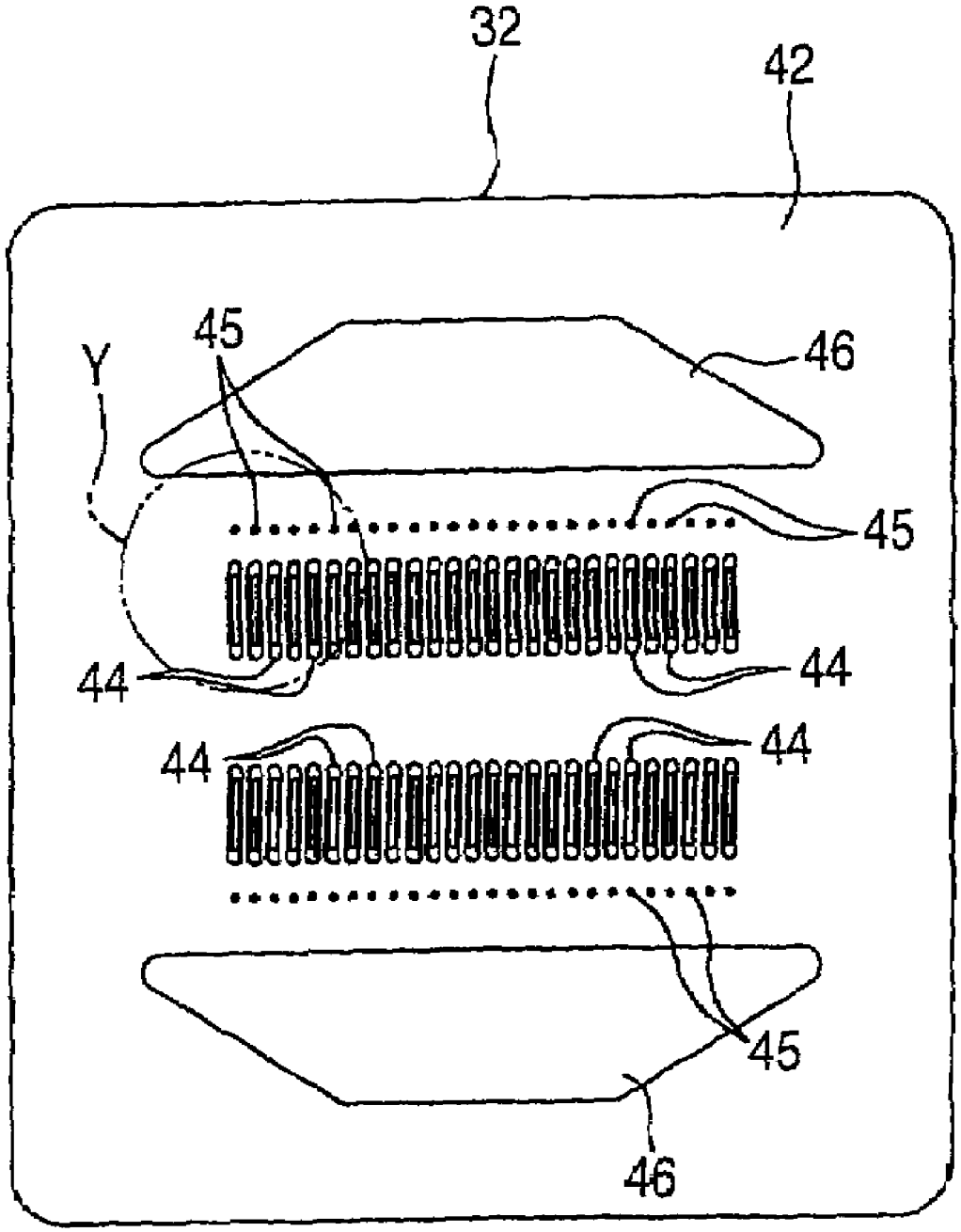
FIG. 6 is a plan view of an elastic plate.

As shown in FIG. 6, diaphragm portions 44, ink supply holes 45, and compliance portions 46 are formed in the elastic plate 32.

Each diaphragm portion 44 is a portion that is deformed as the piezoelectric vibrator 10 is expanded or contracted (i.e., deformed) and that defines a portion of the pressure generation chamber 29. That is, the diaphragm portion 44 closes the opening of the groove-shaped recess 33 and thereby defines portions of the groove-shaped recess 33 and the pressure generation chamber 29. As shown in FIG. 7A, the diaphragm portions 44 each have a long and narrow shape corresponding to the groove-shaped recess 33 and are formed in the respective sealing regions for sealing of the groove-shaped recesses 33, that is, formed for the respective groove-shaped recesses 33. More specifically, the width of the diaphragm portions 44 is set approximately equal to the groove width of the groove-shaped recesses 33 and the length of the diaphragm portions 44 is set somewhat smaller than that of the groove-shaped recesses 33. In this embodiment, the length of the diaphragm portions 44 is set at about ⅔ of the length of the groove-shaped recesses 33. As for the positions of formation of the diaphragm portions 44, as shown in FIG. 2, one end of each diaphragm portion 44 is made flush with the corresponding end (i.e., the end on the side of the communication hole 34) of the groove-shaped recess 33.

Figure 7B:
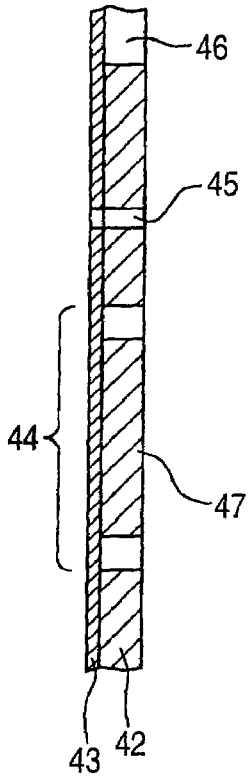
FIG. 7B is a sectional view taken line C-C in FIG. 7A.
Figure 7A:
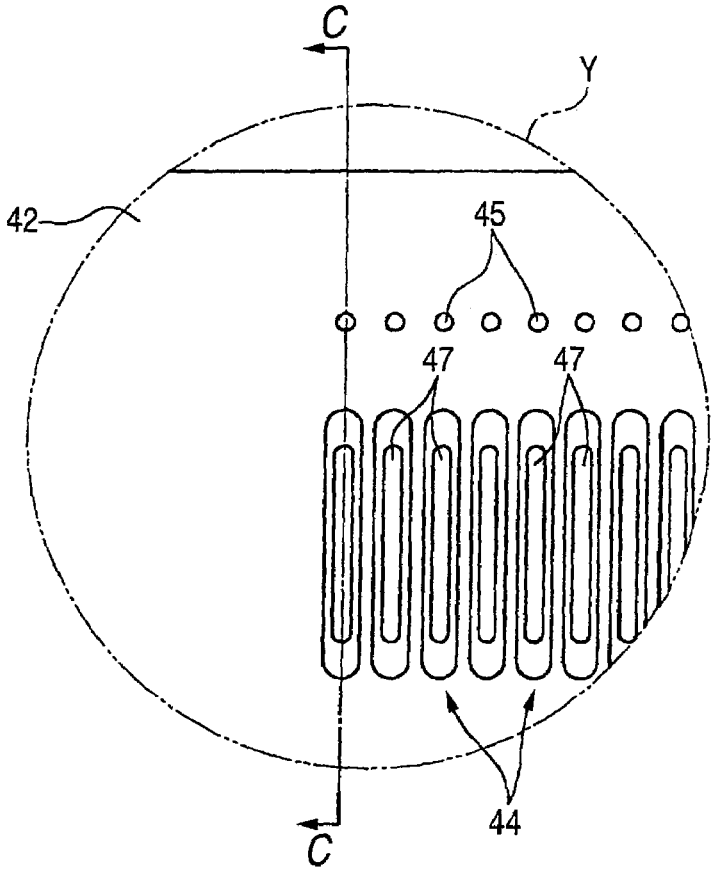
FIG. 7A is an enlarged view of part Y in FIG. 6

As shown in FIG. 7B, each diaphragm portion 44 is formed by, for example, etching away a annular portion of the support plate 42 in a region corresponding to the groove-shaped recess 33, leaving only the elastic film 43 there. An island 47 is formed inside the ring. That is, the island 47 as a rigid portion is surrounded by the elastic film 43 as a deformable portion. As described above, the front end face of the piezoelectric vibrator 10 is joined to the island 47. As the piezoelectric vibrator 10 expands or contracts, the island 47 is moved and the elastic film 43 is deformed, as a result of which the pressure generation chamber 29 is expanded or contracted.

The ink supply holes 45 are holes that connect the pressure generation chambers 29 to the common ink chamber 14 and that penetrate through the elastic plate 32 in its thickness direction. Like the diaphragm portions 44, the ink supply holes 45 are formed at positions corresponding to the respective groove-shaped recesses 33, that is, formed for the respective groove-shaped recesses 33. As shown in FIG. 2, the ink supply holes 45 are formed at positions corresponding to the ends of the groove-shaped recesses 33 opposite to the communication holes 34, respectively. The diameter of the ink supply holes 45 is set sufficiently smaller than the groove width of the groove-shaped recesses 33. In this embodiment, the ink supply holes 45 are very narrow through-holes having a diameter of 23 μm.

The reason why the ink supply holes 45 are very narrow through-holes is to provide a sufficiently large channel resistance between the pressure generation chambers 29 and the common ink chamber 14. In the recording head 1, ink ejects are discharged by utilizing pressure variations that are applied to the ink in the pressure generation chambers 29. Therefore, to eject ink droplets efficiently, it is important to minimize part of the ink pressure in the pressure generation chambers 29 that escapes to the common ink chamber 14. In view of this, in this embodiment, the ink supply holes 45 are formed as very narrow through-holes.

Forming the ink supply holes 45 as through-holes as in this embodiment provides advantages that working for their formation is easy and they can be formed with high dimensional accuracy, for the following reason. Through-holes as the ink supply holes 45 can be formed by laser processing. Therefore, even the ink supply holes 45 having a very small diameter can be formed with high dimensional accuracy by easy work.

The compliance portions 46 define portions of the common ink chambers, respectively. That is, the compliance portions 46 and the front recesses 15 define the respective common ink chambers 14. The compliance portions 46 has a trapezoidal shape that is approximately the same as the shape of the openings of the front recesses 15. The compliance portions 46 are formed by, for example, etching away portions of the support plate 42 to leave only the elastic film 43. Each compliance portion 46 is deformed in accordance with the ink pressure in the common ink chamber 14 and hence has a function of absorbing pressure fluctuations.

The support plate 42 and the elastic film 43 which constitute the elastic plate 32 are not limited to the ones in the above example. For example, the elastic film 43 may be a of polyimide film. As a further alternative, the elastic plate 32 may be formed only by a metal plate. For example, the elastic plate 32 may be such that a metal plate having thick portions that are hard to deform and thin portions that are thin enough to be elastic is used and that the thick portions serve as islands 47 of the diaphragm portions 44 and the thin portions serve as the deformable portions of the diaphragm portions 44 and the compliance portions 46.

Next, the nozzle plate 31 will be described. The nozzle plate 31 is a metal plate-shaped member that is formed with arrays of nozzle orifices 48. In this embodiment, the nozzle plate 31 is a stainless steel plate and is formed with a plurality of nozzle orifices 48 at a pitch corresponding to a dot forming density. Two nozzle arrays are formed parallel with each other, each array consisting of 180 nozzle orifices 48. When the nozzle plate 31 is joined to the surface of the chamber formation plate 30 that is opposite to the elastic plate 32, the nozzle orifices 48 communicate with the respective communication holes 34.

When the elastic plate 32 is joined to the surface of the chamber formation plate 30 that is formed with the groove-shaped recesses 33, the diaphragm portions 44 close the openings of the groove-shaped recesses 33 and the pressure generation chambers 29 are thereby defined. At the same time, the openings of the dummy recesses 36 are closed and the dummy pressure generation chambers are defined. When the nozzle plate 31 is joined to the surface of the chamber formation plate 30, the nozzle orifices 48 communicate with the respective communication holes 34. If a piezoelectric vibrator 10 that is joined to the island 47 expands or contracts in this state, the portion of the elastic film 43 around the island 47 is deformed and the island 47 is pushed toward or pulled away from the groove-shaped recess 33. As the elastic film 43 is deformed in this manner, the pressure generation chamber 29 is expanded or contracted, whereby the ink in the pressure generation chamber 29 is given a pressure variation.

Further, when the elastic plate 32 (i.e., the channel unit 4) is joined to the case 2, the compliance portions 46 seal the respective front recesses 15. Each compliance portion 46 absorbs a pressure variation of the ink that is stored in the common ink chamber 14. That is, the related portion of the elastic film 43 is expanded or contracted in accordance with the pressure of the stored ink. Each escape recess 35 forms a space into which the related portion of the elastic film 43 enters when it is expanded.

The above-configured recording head 1 has common ink channels that extend from the ink supply needles 19 to the common ink chambers 14, respectively, and individual ink channels each set of which extends from the common ink chamber 14 to the nozzle orifices 48 past the pressure generation chambers 29, respectively. Ink that is stored in each ink cartridge is introduced into the common ink channel via the ink supply needle 19 and then stored in the common ink chamber 14. Ink that is stored in the common ink chamber 14 is introduced to the nozzle orifices 48 through the individual ink channels and then discharged from the nozzle orifices 48.

For example, when a piezoelectric vibrator 10 is contracted, the diaphragm portion 44 is pulled toward the vibrator unit 3 and the pressure generation chamber 29 is thereby expanded. Since a negative pressure occurs in the expanded pressure generation chamber 29, ink flows from the common ink chamber 14 to the pressure generation chamber 29 past the ink supply hole 45. When the piezoelectric vibrator 10 is thereafter expanded, the diaphragm portion 44 is pushed toward the chamber formation plate 30 and the pressure generation chamber 29 is thereby contracted. The ink pressure in the contracted pressure generation chamber 29 increases, whereby an ink droplet is ejected from the corresponding nozzle orifice 48.

In this recording head 1, the bottom faces of the pressure generation chambers 29 (i.e., the groove-shaped recess 33) are dented in a V-shape. Therefore, the bottom portion of each partition 28 that defines the adjacent pressure generation chambers 29 is thicker than its top portion. This structure makes the rigidity of the partitions 28 higher than in the conventional case. Therefore, even if the ink pressure in a pressure generation chamber 29 varies when an ink droplet is ejected, the pressure variation is less prone to be transmitted to the adjacent pressure generation chambers 29. As a result, what is called "adjoining chamber crosstalk" can be prevented and the discharge of ink ejects can be stabilized.

In this embodiment, since the ink supply holes 45 which connect the common ink chambers 14 to the pressure generation chambers 29 are very narrow holes that penetrate through the elastic plate 32 in its thickness direction, they can be formed easily with high dimensional accuracy by laser processing or the like. This makes it possible to provide a high level of conformity of the characteristics of ink inflow into the pressure generation chambers 29 (e.g., inflow speeds and inflow amounts). In addition, the ink supply holes 45 can be formed easily working using laser light is employed.

In this embodiment, the dummy pressure generation chambers (i.e., the cavities defined by the dummy recesses 36 and the elastic plate 32) which are irrelevant to discharge of ink ejects are formed adjacent to the end pressure generation chambers 29. The adjacent pressure generation chamber 29 and a dummy pressure generation chamber 36 are formed on the respective sides of each end pressure generation chamber 29. Therefore, the rigidity of the partitions that define each end pressure generation chamber 29 can be made equal to that of the partitions of the other, that is, intermediate, pressure generation chambers 29. As a result, the ink jet discharge characteristics of all the pressure generation chambers 29 belonging to each array can be made uniform.

The width of the dummy pressure generation chambers in the chamber arrayed direction is set greater than the width of the pressure generation chambers 29. In other words, the dummy recesses 36 are wider than the groove-shaped recesses 33. This makes it possible to equalize the discharge characteristics of the end pressure generation chambers 29 with those of the intermediate pressure generation chambers 29 with high accuracy.

Further, in this embodiment, the front recesses 15 are formed by partially denting the front end face of the case 2 and the common ink chambers 14 are defined by the front recesses 15 and the elastic plate 32. This makes it unnecessary to use members dedicated to formation of the common ink chambers 14, which contributes to simplification of the configuration. In addition, since the case 2 is formed by resin molding, the front recesses 15 can be formed relatively easily.

Next, a manufacturing method of the recording head 1 will be described. Since this manufacturing method is characterized by a manufacturing process of the chamber formation plate 30, the following description will be focused on the manufacturing process of the chamber formation plate 30. The chamber formation plate 30 is formed by forging that uses progressive dies. A band plate as a material plate of the chamber formation plate 30 is made of nickel.

The manufacturing process of the chamber formation plate 30 consists of a groove-shaped recesses forming process for forming the groove-shaped recesses 33 and a communication holes forming process for forming the communication holes 34 and is executed by using progressive dies. A method for forming the end portions, in the longitudinal direction, of the groove-shaped recesses 33 will be described later.

Figure 8A:
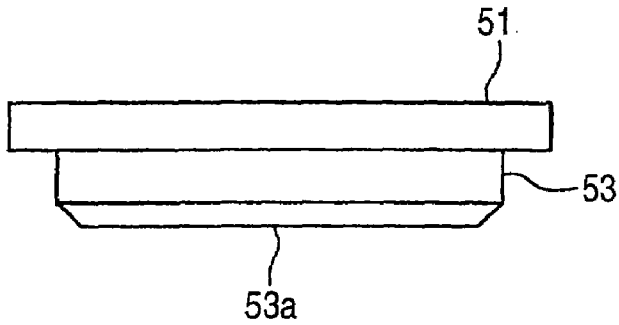
FIGS. 8A and 8B illustrate a male die that is used for forming groove-shaped recesses.
Figure 8B:
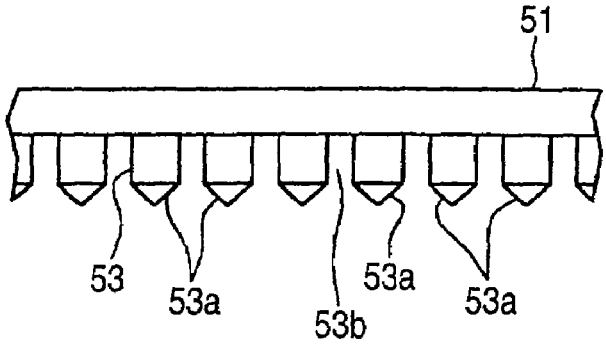
Figure 9A:
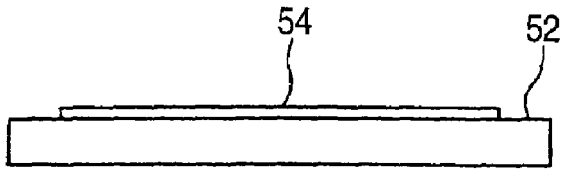
FIGS. 9A and 9B illustrate a female die that is used for forming the groove-shaped recesses.
Figure 9B:
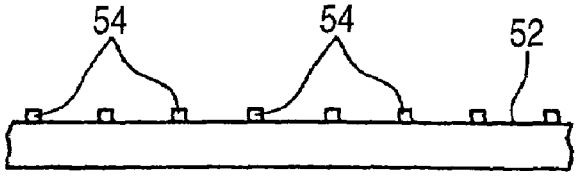

The groove-shaped recesses forming process uses a male die 51 shown in FIG. 8 and a female die 52 shown in FIG. 9. The male die 51 is a die for forming the groove-shaped recesses 33. Projection strips 53 for forming the groove-shaped recesses 33 are arrayed on the male die 51 in the same number as the number of groove-shaped recesses 33. Dummy projection strips (not shown) for forming the dummy recesses 36 are provided adjacent to the projection strips 53 that are located at both ends in the projection arrayed direction. A tip portion 53*a* of each projection strip 53 is chamfered into a mountain shape. For example, as shown in FIG. 8B, each projection strip 53 is chamfered so as to form an angle of about 45° with the center line in the width direction. That is, the wedge-shaped tip portion 53*a* is formed by the chamfered tip end faces of the projection strip 53. As a result, the projection strip 53 has a V-shaped cross-section and has a sharp edge extending in the longitudinal direction. As shown in FIG. 8A, both end portions, in the longitudinal direction, of the tip portion 53*a* are chamfered at an angle of about 45°. Therefore, the tip portion 53*a* of the projection strip 53 has a shape that is obtained by chamfering a triangular prism at both ends.

A plurality of striped projections 54 are formed on the top surface of the female die 52. The striped projections 54 are to assist formation of the partitions 28 each of which defines the adjacent pressure generation chambers 29, and each of the striped projections 54 is located between the groove-shaped recesses 33 to be formed. The striped projections 54 assume a rectangular prism shape and their width is set slightly smaller than the internal between the adjoining pressure generation chambers 29 (i.e., the thickness of the partitions 28). The height of the striped projections 54 is approximately the same as their width. The length of the striped projections 54 is set approximately the same as the length of the groove-shaped recesses 33 (i.e., projection strips 53).

Figure 10A:
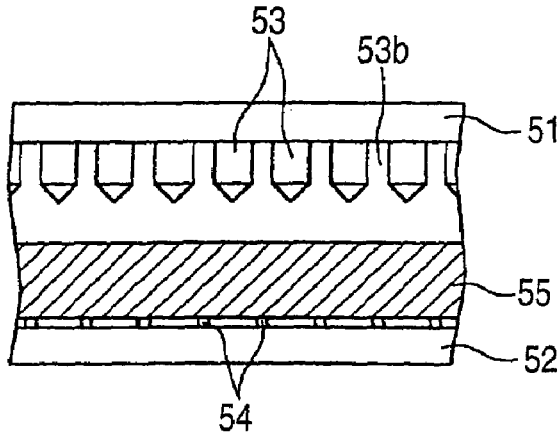
FIGS. 10A-10C are schematic views illustrating how the groove-shaped recesses are formed.
Figure 10B:
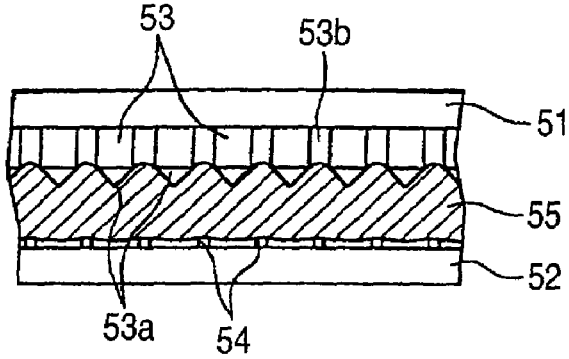
Figure 10C:
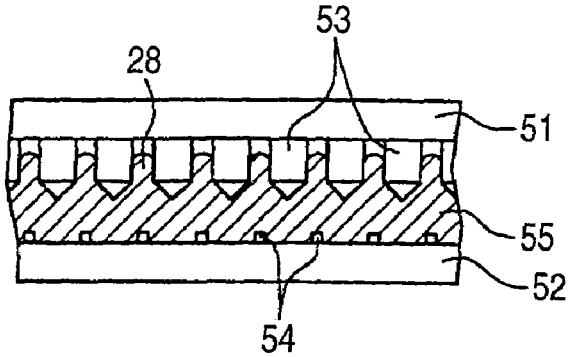

In the groove-shaped recesses forming process, first, as shown in FIG. 10A, a band plate 55 as a material plate of a chamber formation plate 30 is placed on the female die 52 and the male die 51 is disposed over the band plate 55. Then, as shown in FIG. 10B, the male die 51 is lowered, whereby the tip portions 53*a* of the projection strips 53 are dug into the band plate 55. At this time, since the tip portions 53*a* of the projection strips 53 are sharpened in a V-shape, the tip portions 53*a* can reliably be dug into the band plate 55 without causing buckling of the projection strips 53. As shown in FIG. 10C, the projection strips 53 are dug to an intermediate position in the thickness direction of the band plate 55.

As the projection strips 53 are dug, parts of the band plate 55 flow to form groove-shaped recesses 33. Incidentally, since the tip portions 53*a* of the projection strips 53 are sharpened in a V-shape, even minute groove-shaped recesses 33 can be formed with high dimensional accuracy. That is, parts of the band plate 55 that are pushed by the tip portions 53*a* flow smoothly and hence groove-shaped recesses 33 are shaped so as to conform to the projection strips 53. At this time, the material that is pushed aside by the tip portions 53*a* and thereby rendered flowable goes into gap portions 53*b* between the projection strips 53, whereby partitions 28 are formed. Since each tip portion 53*a* is chamfered at both ends in the longitudinal direction, nearby parts of the band plate 55 also flow smoothly. Therefore, the groove-shaped recesses 33 can be formed with high dimensional accuracy also at both ends in the longitudinal direction.

Since the digging of the projection strips 53 is stopped halfway, a thicker band plate 55 can be used than in a case of forming through-holes. As a result, the rigidity of the chamber formation plate 30 can be increased and the ink ejection characteristics can be improved. In addition, the handling of the chamber formation plate 30 can be made easier.

When pressed by the projection strips 53, parts of the band plate 55 rise into the gap portions between the adjoining projection strips 53. At this time, the striped projections 54 of the female die 52 assist the flow of the parts of the band plate 55 into the gap portions because they are located at the positions corresponding to the middle positions between the projection strips 53. This makes it possible to efficiently introduce parts of the band plate 55 into the gap portions between the projection strips 53 and thereby form high elevated portions.

The method for forming the groove-shaped recesses 33 that is the base of the invention is basically as described above. A first embodiment of the invention will be described below on that basis.

The accuracy of formation of the groove-shaped recesses 33, in particular, the accuracy of the processing for forming the end portions, in the longitudinal direction, of the groove-shaped recesses 33, is important in forming the end portions of the partitions 28 sharply. In view of this, in the invention, the working process concerned is divided into a tentative forming step (one embodiment of a first step of the invention) and a finish forming step (one embodiment of a second step of the invention) and the end portions of the projection strips 53 are chamfered in a special shape that is suitable for the tentative forming step and the finish forming step.

FIGS. 11-14 show embodiments of such a fine forging method, manufacturing method of a liquid ejection head, and a liquid ejection head. Components having the same serves as components described above are given the same reference symbols as the latter in the drawings.

The above-described plastic working on a band plate (material plate) 55 using the male die 51 and the female die 52 should be performed at ordinary temperature. Likewise, it is assumed that plastic working that will be described below is performed at ordinary temperature.

Figure 12A:
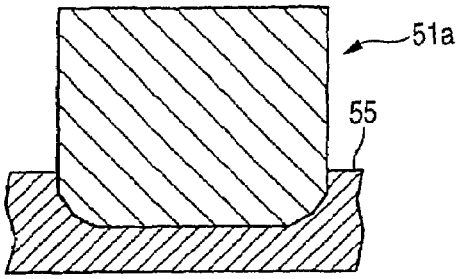
FIG. 12A is a sectional view showing a state that the first punch is dug into the material plate.

Many tentative forming punches 51*b* are arranged in a tentative forming male die 51*a*, that is, a first punch. To form the groove-shaped recesses 33, the tentative forming punches 51*b* are deformed into long and narrow projection strips 53*c*. To form the partitions 28, gap portions 53*b* (see FIGS. 8 and 10) are provided between the tentative forming punches 51*b*. FIG. 12A shows a state that the first punch 51*a* is dug into a chamber formation plate 55 as a material plate.

Figure 11:
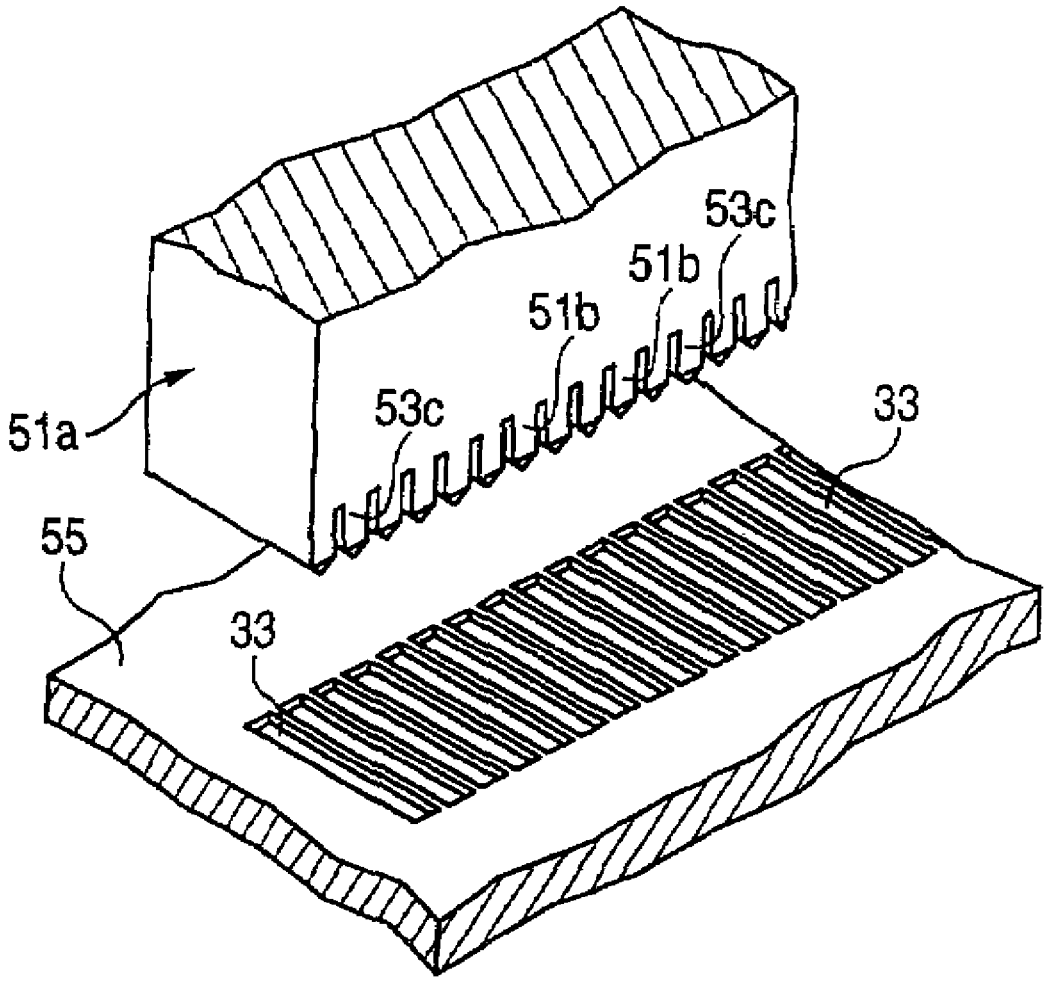
FIG. 11 is a perspective view showing a relationship between a first punch and a material plate.
Figure 12B:
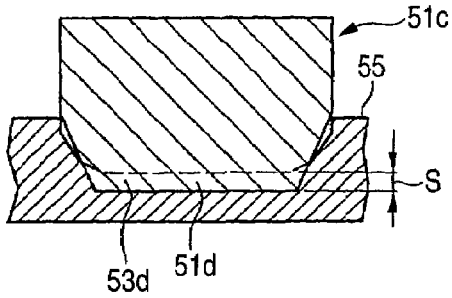
FIG. 12B is a sectional view showing a state that the second punch is dug into the material plate.
Figure 12C:
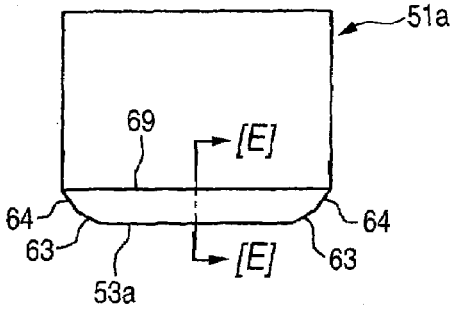
FIG. 12C is a side view of the first punch.
Figure 12D:
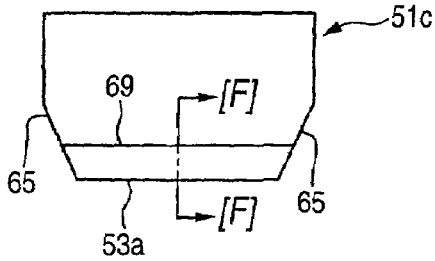
FIG. 12D is a side view of the second punch.
Figure 12E:
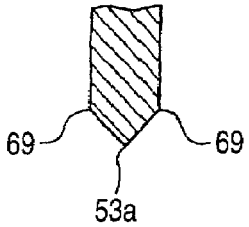
FIG. 12E is a sectional view taken along line E-E in FIG. 12C.
Figure 12F:
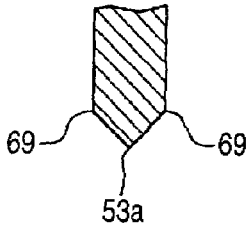
FIG. 12F is a sectional view taken along line F-F in FIG. 12D.

On the other hand, although not shown in the perspective views such as FIG. 11, as shown in FIG. 12B many finish forming punches 51*d* are arranged in a finish forming male die 51*c*, that is, a second punch, in the same manner as the tentative forming punches 51*b* are arranged in the tentative forming male die 51*a*. To finish-form the groove-shaped recesses 33, the finish forming punches 51*d* are deformed into long and narrow projection strips 53*d*. To form the partitions 28, gap portions 53*e* (not shown) are provided between the finish forming punches 51*d*. FIG. 12B shows a state that the second punch 51*c* is dug into the chamber formation plate 55 as the material plate. As indicated by symbol S in FIG. 12B, the digging depth of the second punch 51*c* is set greater than that of the first punch 51*a* by a length S.

The projection strips 53*c* of the first punch 51*a* and the projection strips 53*d* of the second punch 51*c* are approximately the same in width and length.

Figure 13A:
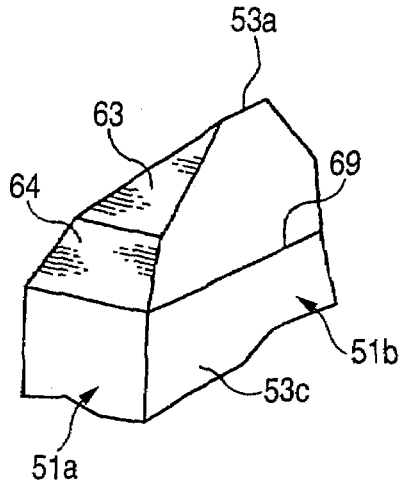
FIG. 13 is perspective views showing the shapes of end portions of projection strips of a tentative forming punch or a finish forming punch.
Figure 14A:
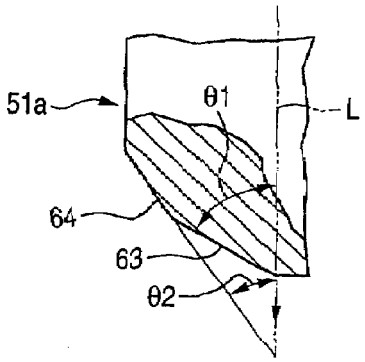
FIG. 14 is vertical sectional/side views showing slant faces of each projection strip and manners of deformation of the material plate.

Slant faces having chamfering shapes of different angles are formed at both ends, in the longitudinal direction, of each projection strip 53*c* of the first punch 51*a*. Each slant face is such that as shown in FIG. 13A a first slant face 63 that is close to the edge of the tip portion 53*a* and a second slant face 64 that is distant from the edge of the tip portion 53*a* are continuous with each other. As shown in FIG. 14A, let θ1 and θ2 represent the inclination angles of the first slant face 63 and the second slant face 64 with respect to the pressing direction (pressing direction line L) of the first punch 51*a*, respectively; then the angles θ1 and θ2 have a relationship of θ1>θ2.

Figure 13B:
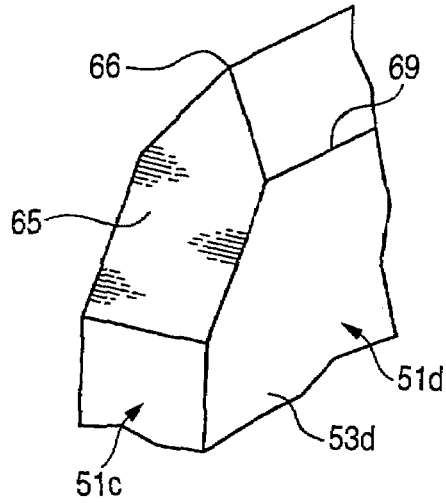

On the other hand, finish slant faces 65 having a chamfering shape are formed at both ends, in the longitudinal direction, of each projection strip 53*d* of the finish forming second punch 51*c*. As indicated by a dashed chain line in FIG. 14B, let θ3 represent the inclination angle of each finish slant face 65 with respect to the pressing direction (pressing direction line L) of the second punch 51*c*; then the angles θ2 and θ3 have a relationship of θ2>θ3. Therefore, the respective inclination angles θ1, θ2, and θ3 of the first slant face 63, the second slant face 64, and the finish slant face 65 have a relationship of θ1>θ2>θ3. As shown in FIGS. 13A and 13B, the first slant face 63, the second slant face 64, and the finish slant face 65 are flat faces and are parallel with the thickness direction of the projection strip 53*c* or 53*d*.

Figure 14B:
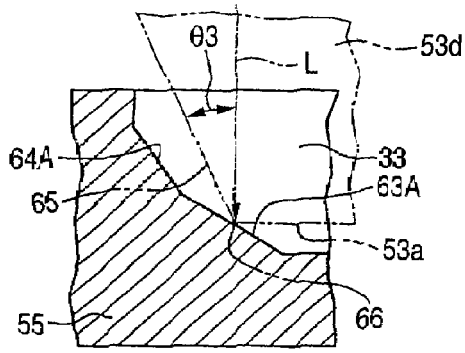

The first punch 51*a* is dug into a nickel material plate 55 as tentative forming and then retreated, whereby a first tentative formed face 63A and a second tentative formed face 64A are formed as shown in FIG. 14B etc. The finish slant face 65 and the tip edge intersect at a tip point 66 of the finish slant face 65. As shown in FIG. 14B, the positional relationship between the first tentative formed face 63A and the tip point 66 is set so that the tip point 66 is first pressed against the first tentative formed face 63A when the second punch 51*c* is lowered as a finish stroke.

Next, working operations of the first punch 51*a* and the second punch 51*c* on a material plate 55 will be described.

First, tentative forming by the first punch 51*a* forms the material plate 55 to such a stage that a final shape has not been obtained. Subsequently, finish forming is performed by using the second punch 51*c*. Since plastic working is performed sequentially, that is, gradually, by using the first punch 51*a* and the second punch 51*c*, a desired formed shape can be obtained correctly even if it is minute without causing any problems, that is, without producing an abnormal shape or causing a crack in the material plate 55. In general, anisotropic etching is employed to form such minute structures. However, anisotropic etching requires a large number of working steps and hence is disadvantageous in manufacturing cost. In contrast, the above-described fine forging method greatly decreases the number of working steps and hence is very advantageous in cost. Further, capable of forming recesses having uniform volumes, the above-described fine forging method is very effective in, for example, stabilizing the discharge characteristics of a liquid ejection head in, for example, a case of forming pressure generation chambers of the liquid ejection head.

In the tentative forming step, when the first punch 51*a* is dug into the material plate 55, parts of the material plate 55 flow into the gap portions 53*b* between the tentative forming punches 51*b*, whereby partitions 28 are formed tentatively. In the subsequent finish forming step, the parts of the material plate 55 flow into the gap portions 53*e* between the finish forming punches 51*d*, whereby the partitions 28 are finished. Also in the formation of the partitions 28, first, tentative forming by the first punch 51*a* forms the material plate 55 to such a stage that the final shape of the partitions 28 has not been obtained yet. Subsequently, finish forming is performed by using the second punch 51*c*. Since plastic working is performed sequentially, that is, gradually, by using the first punch 51*a* and the second punch 51*c*, a desired formed shape can be obtained correctly even for the thin partitions 28 without causing any problems, that is, without producing an abnormal shape or causing a crack in the material plate 55.

In the above forming operations, as shown in FIG. 12B, the operation stroke of the second punch 51*c* is set so that the depth of digging of the second punch 51*c* into the material plate 55 in the finish forming is greater than that of the first punch 51*a* into the material plate 55 in the tentative forming by the length S. The tentative forming punches 51*b* (i.e., parallel projection strips 53*c*) of the first punch 51*a* and the finish forming punches 51*d* (i.e., parallel projection strips 53*d*) of the second punch 51*c* are dug into the material plate 55. The projection strips 53*c* of the first punch 51*a* and the projection strips 53*d* of the second punch 51*c* are approximately the same in width and length.

Therefore, parallel groove-shaped recesses 33 are formed by the projection strips 53*c* and 53*d*. Since the digging depth of the second punch 51*c* in the finish forming is greater than that of the first punch 51*a* in the tentative forming, a shape obtained by the tentative forming by the first punch 51*a* can reliably be deformed by the finish forming. Further, since the tentative forming by the first punch 51*a* and the subsequent finish forming by the second punch 51*c* are performed by the projection strips 53*c* and 53*d* having approximately the same dimensions, a shape obtained by the tentative forming is re-processed by the finish forming without being deformed abnormally: precise groove-shaped recesses 33 are obtained finally.

On the other hand, the pitch of the projection strips 53*d* of the second punch 51*c* is set longer than that of the projection strips 53*c* of the first punch 51*a*. There is a phenomenon that the material plate 55 that is released from the first punch 51*a* because of its retreat after the pressure forming (tentative forming) by the projection strips 53*c* of the first punch 51*a* is slightly increased in dimensions. Because of this phenomenon, the pitch of groove-shaped recesses 33 formed by the first punch 51*a* is slightly increased from the pitch of the projection strips 53*c* of the first punch 51*a*. In view of this, the pitch of the projection strips 53*c* of the second punch 51*c* is set equal to the thus-increased pitch of the groove-shaped recesses 33. As a result, correct finish forming can be performed smoothly and reliably by the projection strips 53*d* of the second punch 51*c* whose pitch matches the dimensions obtained by the tentative forming, without causing forced deformation of the material plate 55.

The pitch of the projection strips 53*d* of the second punch 51*c* may be set at 0.3 mm or less, in which case even preferable finishing can be attained in, for example, working for producing a component of a liquid ejection head. It is preferable that this pitch be 0.2 mm or less, and it is even preferable that this pitch be 0.15 mm or less.

In the tentative forming by the first punch 51*a*, first, the slant face consisting of the first slant face 63 that is close to the edge of the tip portion 53*a* of each projection strip 53*c* and the second slant face that is distant from the edge of the tip portion 53*a* is pressed against the material plate 55 when the first punch 51*a* is lowered. At this time, since the inclination angle θ1 of the first slant face 63 is set larger than the slant angle θ2 of the second slant face 64, the first slant face 63 having the larger inclination angle is dug into the material plate 55 at the position that is distant from the end of the groove-shaped recess 33 being formed, whereby initial formation of the groove-shaped recess 33 is started in a state that the influence of a flow of part of the material plate 55 on the end portion of the groove-shaped recess 33 is small. Therefore, at this initial stage, around the end portion of the groove-shaped recess 33, the degree of movement of the material in the longitudinal direction is low and instead the movement of the material is promoted in the width direction of the groove-shaped recess 33.

As the first slant face 63 is further dug into the material plate 55, the second slant face 64 having the smaller inclination angle and being closer to the end of the groove-shaped recess 33 being formed comes to be dug into the material plate 55. Therefore, this time, the material is moved toward the end portion of the groove-shaped recess 33 more than in the width direction of the groove-shaped recess 33. At this time, since the inclination angle θ2 of the second slant face 64 is small, the amount of part of the material plate 55 that is moved in the longitudinal direction of the groove-shaped recess 33 is made as small as possible and the amount of the material 55 moved is reduced around the end portion of the groove-shaped recess 33, whereby the end portion of the groove-shaped recess 33 is formed sharply. That is, also at the stage that the second slant face 64 is dug, the material flow component in the width direction of the groove-shaped recess 33 is greater around the end portion of the groove-shaped recess 33, whereby around the end portion of the groove-shaped recess 33 the partitions 28 are formed sharply in a sense that their thickness is included.

In the tentative forming by the first punch 51*a*, a first tentative formed face (a specific form of a first slant formed face of the invention) 63A and a second tentative formed face (a specific form of a second slant formed face of the invention) 64A are formed on the material plate 55 by the first slant face 63 and the second slant face 64. The finish forming by the second punch 51*c* is performed after the tip point 66 of the finish slant face 65 of the second punch 51*c* touches the first tentative formed face 63A. In this operation, plastic deformation occurs as the tip point 66 of the second punch 51*c* is pressed against the first tentative formed face 63A that is deeper than the second tentative formed face 64A in the depth direction of the groove-shaped recess 33 and that is more distant from the end of the groove-shaped recess 33 in the longitudinal direction of the groove-shaped recess 33 than the second tentative formed face 64A is.

Therefore, the finish forming by the second punch 51*c* is performed in such a manner as to cause almost no influence on the end portion of the groove-shaped recess 33 in terms of the material movement, whereby the end portion of the groove-shaped recess 33 is formed sharply. Since the inclination angle θ3 of the finish slant face 65 is set smaller than the inclination angles of the second tentative formed face 64A and the first tentative formed surface (equal to the above-mentioned angles θ2 and θ1, respectively), the amount of part of the material plate 55 that is moved in the longitudinal direction of the groove-shaped recess 33 because of the digging displacement of the finish slant face 65 can be made very small, which is effective in forming the end portion of the groove-shaped recess 33 correctly.

Figure 14C:
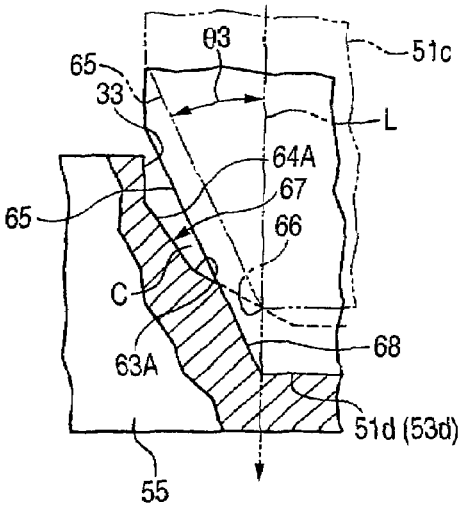
Figure 14D:
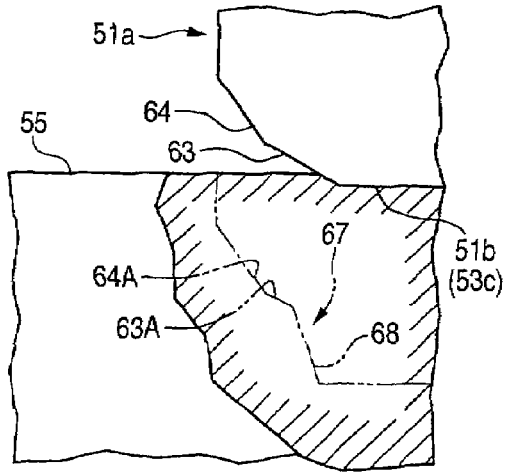

As shown in FIGS. 14B and 14C, as the tip point 66 of the second punch 51*c* is further dug past the first tentative formed surface 63A and the deformation progresses further, a final finish face 67 is formed that consists of the second tentative formed face 64A, (part of the first tentative formed face 63A), and a finish formed face 68 that has been formed by the finish slant face 65. Since the finish forming is performed by the finish slant face 65 of the second punch 51*c* whose inclination angle θ3 is smaller than the inclination angle θ1 of the first tentative formed face 63A, the finish slant face 65 is not brought into surface contact with the first tentative formed face 63A and the finish slant face 65 moves, in the pressing direction, that part of the material plate 55 which is located at the end portion of the first tentative formed face 63A. Therefore, where the first tentative formed face 63A disappears as a result of the digging of the finish slant face 65, at least the second tentative formed face 64A and the finish formed face 68 that is continuous with the second tentative formed face 64A are formed reliably at the end of the groove-shaped recess 33.

Where part of first tentative formed face 63A remains that is continuous with the second tentative formed face 64A, the second tentative formed face 64A, the part of the first tentative formed face 63A, and the finish formed face 68 constitute the final finish face 67. In this manner, the end portion of the groove-shaped recess 33 can be formed correctly by virtue of the fact that the inclination angle θ3 of the finish slant face 65 is set smallest.

A space C (see FIG. 14C) is formed after the pressing of the second punch 51*c* has completed, because the inclination angle θ3 of the finish slant face 65 is set smaller than the inclination angle θ2 of the second tentative formed face 64A. This is favorable for correct finishing of the shape of the end portion of the groove-shaped recess 33 because there does not occur force that moves the opening-side end portion of the groove-shaped recess 33 outward in the longitudinal direction of the groove-shaped recess 33.

When the finish slant face 65 is dug past the first tentative formed face 63A in the above-described manner, the part of the material plate 55 just under the first tentative formed face 63A is pressed into the inside of the material plate 55. Therefore, when the second punch 51*c* is retreated, the end portion of the groove-shaped recess 33 is shaped so as not to suffer from a rebound.

Figure 13C:
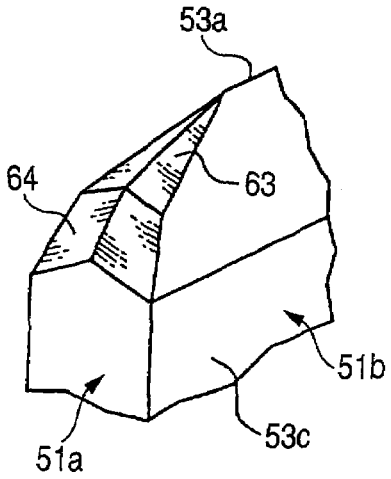
Figure 13D:
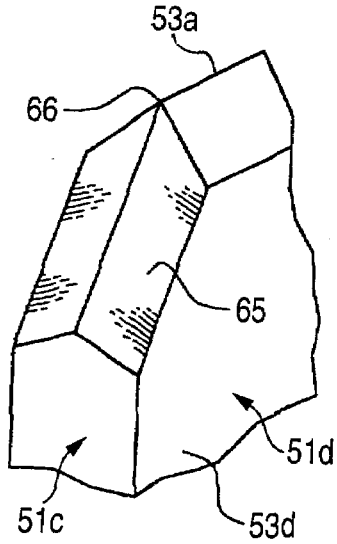

As shown in FIGS. 13C and 13D, each of the first slant face 63, the second slant face 64, and the finish slant face 65 may be given a mountain shape, in which case the end portion of the groove-shaped recess 33 can be shaped precisely by moving as large an amount of material as possible in the width direction of the groove-shaped recess 33. Although each illustrated mountain shape is formed by slant faces and a ridge, similar advantages can be obtained by employing a rounded, convex surface.

Each of the projection strips 53*c* of the first punch 51*a* and each of the projection strips 53*d* of the second punch 51*c* are formed with the wedge-shaped tip portion 53*a* by the tip slant faces, and the side surfaces of the projection strip 53*c* or 53*d* are connected to the above slant faces by rounded, smooth boundary portions 69, respectively. This allow the material to flow into the gap portions 53*b* or 53*e* smoothly and thereby makes it possible to obtain the desired shape of the partitions 28 easily. Further, since the lower portions of the groove-shaped recesses 33 are given a V-shape, the volume of the groove-shaped recesses 33 is maximized and the rigidity of the base portions of the partitions 28 is increased to stabilize the strength of the partitions 28.

Next, a manufacturing method of a liquid ejection head using the above fine forging method will be described.

The manufacturing method of a liquid ejection head according to the invention is a manufacturing method of a liquid ejection head 1 that has a metal chamber formation plate 30 in which groove-shaped recesses 33 to serve as pressure generation chambers 29 are arrayed and a communication hole 34 is formed at one end of each groove-shaped recess 33 so as to penetrate through the chamber formation plate 30 in the thickness direction, a metal nozzle plate 31 in which nozzle orifices 48 are formed at positions corresponding to the respective communication holes 34, and a metal sealing plate that closes the openings of the groove-shaped recesses and in which an ink supply hole 45 is formed at a position corresponding to the other end of each groove-shaped recess 33, and in which the sealing plate is joined to a surface, located on the side of the groove-shaped recesses 33, of the chamber formation plate 30 and the nozzle plate 31 is joined to the opposite surface of the chamber formation plate 30. The manufacturing method is characterized in that the groove-shaped recesses 33 of the chamber formation plate 30 are formed by the above-described fine forging method.

Therefore, the groove-shaped recesses 33 are formed in a material plate of the chamber formation plate 30 by making good use of the advantageous workings and effects of the above-described fine forging method. Exemplary manners of formation of the chamber formation plate 30 based on the above-described advantageous workings and effects are as follows.

For example, tentative forming by the first punch 51*a* is performed first to a stage that a final shape has not been obtained and finish forming is performed subsequently by using the second punch 51*c*. Since plastic working is performed sequentially, that is, gradually, by using the first punch 51*a* and the second punch 51*c*, each groove-shaped recess 33 is given a desired formed shape correctly even if it is minute without causing any problems, that is, without producing an abnormal shape or causing a crack in the material. In general, anisotropic etching is employed to form such minute structures. However, anisotropic etching requires a large number of working steps and hence is disadvantageous in manufacturing cost. In contrast, the above fine forging method greatly decreases the number of working steps and hence is very advantageous in cost. Further, capable of forming the groove-shaped recesses 33 so that they have uniform volumes, the above-described fine forging method is very effective in, for example, stabilizing the discharge characteristics of the liquid ejection head 1.

Slant faces having chamfering shapes of different angles are formed at both ends, in the longitudinal direction, of each projection strip 53*c* of the first punch 51*a*. Each slant face consists of the first slant face 63 that is close to the edge of the tip portion 53*a* of the projection strip 53*c* and the second slant face 64 that is distant from the edge of the tip portion 53*a*. The inclination angles θ1 and θ2 of the first slant face 63 and the second slant face 64 with respect to the pressing direction of the first punch 51*a* are set such that θ1 is larger than θ2. Since the first slant face 63 having the larger inclination angle is dug into the chamber formation plate 30 at the position that is distant from the end of the groove-shaped recess 33 being formed, initial formation of the groove-shaped recess 33 is started in a state that the influence of a flow of the material on the end portion of the groove-shaped recess 33 is small. Therefore, at this initial stage, around the end portion of the groove-shaped recess 33, the degree of movement of the material in the longitudinal direction is low and instead the movement of the material is promoted in the width direction of the groove-shaped recess 33.

When the first slant face 63 is further dug into the chamber formation plate 30, the second slant face 64 having the smaller inclination angle θ2 and being closer to the end of the groove-shaped recess 33 being formed comes to be dug into the material plate (30). Therefore, this time, the material is moved toward the end portion of the groove-shaped recess 33 more than in the width direction of the groove-shaped recess 33. At this time, since the inclination angle θ2 of the second slant face 64 is small, the amount of part of the material (30) that is moved in the longitudinal direction of the groove-shaped recess 33 is made as small as possible and the movement of the material (30) is suppressed around the end portion of the groove-shaped recess 33, whereby the end portion of the groove-shaped recess 33 is formed sharply. That is, also at the stage that the second slant face 64 is dug, the material flow component in the width direction of the groove-shaped recess 33 is greater around the end portion of the groove-shaped recess 33, whereby around the end portion of the groove-shaped recess 33 the partitions 28 are formed sharply in a sense that their thickness is included. As a result, the partitions 28 between the groove-shaped recesses 33 are formed correctly including their portions adjacent to the end portions of the groove-shaped recesses 33 and the partitions 28 are finished precisely.

In the tentative forming by the first punch 51*a*, the first tentative formed face 63A and the second tentative formed face 64A are formed in the chamber formation plate 30 by the first slant face 63 and the second slant face 64, respectively. The finish forming is performed by the second punch 51*c* after the tip point 66 of the finish slant face 65 of the second punch 51*c* touches the first tentative formed face 63A. In this case, plastic deformation occurs as the tip point 66 of the second punch 51*c* is pressed against the first tentative formed face 63A that is deeper than the second tentative formed face 64A in the depth direction of the groove-shaped recess 33 and that is more distant from the end of the groove-shaped recess 33 in the longitudinal direction of the groove-shaped recess 33 than the second tentative formed face 64A is. Therefore, the finish forming by the second punch 51*c* is performed in such a manner as to cause almost no influence on the end portion of the groove-shaped recess 33 in terms of the material movement, whereby the end portion of the groove-shaped recess 33 is formed sharply. As a result, the partitions 28 between the groove-shaped recesses 33 are formed correctly including their portions adjacent to the end portions of the groove-shaped recesses 33 and the partitions 28 are finished precisely.

Next, a liquid ejection head produced by the above-described fine forging method will be described.

A liquid ejection head 1 according to the invention is such that groove-shaped recesses 33 are formed in a chamber formation plate 30 so as to be arranged at a prescribed pitch, and is formed by tentatively forming groove-shaped recesses 33 in the chamber formation plate 30 and then performing finish forming on the tentatively formed groove-shaped recesses 33 by using a second punch 51 in which finish forming punches 51*d* are arranged.

Therefore, as described in the above fine forging method and manufacturing method of a liquid ejection head, each minute groove-shaped recess 33 is given a desired formed shape correctly without causing any problems, that is, without producing an abnormal shape or causing a crack in the material plate 55. Further, this method advantageous in terms of manufacturing cost because it is simper than the anisotropic etching method that is employed ordinarily.

Further, since the groove-shaped recesses 33 can be formed so as to have uniform volumes, the local accuracy of each pressure generation chamber 29 is increased greatly, which is very effective in, for example, stabilizing the discharge characteristics of the liquid ejection head 1. Where the chamber formation plate 30 is made of nickel, for example, the chamber formation plate 30, the elastic plate 32, and the nozzle plate 31 which constitute the channel unit have approximately the same linear expansion coefficients and hence the members 30-32 expand uniformly when they are heat-bonded to each other. Therefore, mechanical stress such as a warp due to differences between the expansion coefficients is unlikely to occur. As a result, the members 30-32 can be bonded to each other without causing any problems even if the bonding temperature is set high. Further, even when the piezoelectric vibrators 7 heat during operation of the recording head 1 and the channel unit is thereby heated, the members 30-32 which constitute the channel unit expand uniformly. Even if heating due to operation of the recording head 1 and cooling due to suspension of operation are repeated, no problems such as peeling likely occur in the members 30-32 constituting the channel unit.

In the finish forming, plastic deformation is effected as the tip point 66 of the second punch 51*c* is pressed against the first tentative formed face 63A that is deeper than the second tentative formed face 64A in the depth direction of the groove-shaped recess 33 and that is more distant from the end of the groove-shaped recess 33 in the longitudinal direction of the groove-shaped recess 33 than the second tentative formed face 64A is. Therefore, the finish forming by the second punch 51*c* is performed in such a manner as to cause almost no influence on the end portion of the groove-shaped recess 33 in terms of the material movement, whereby the end portion of the groove-shaped recess 33 is formed sharply. Since the inclination angle θ3 of the finish slant face 65 of the second punch 51*c* is set small, the part of the material plate (30) just under the first tentative formed face 63A is pressed into the inside of the material plate (30), which prevents what is called a rebound. Therefore, each partition between the groove-shaped recesses can be formed correctly including its portions adjacent to the end portions of the groove-shaped recesses.

Since the final finish faces 67 at the ends of the respective groove-shaped recesses 33 are formed uniformly without rebounds, the pressure generation chambers 29 can be given a constant volume and the ink discharge characteristics can be kept constant. Without rebounds, no disturbance occurs in ink flows at the end portions of the groove-shaped recesses 33 and bubbles do not pile up.

With the above-described settings of the inclination angles θ1, θ2, and θ3, in the finish forming by the second punch 51*c*, the final finish face 67 is formed at the end of the groove-shaped recess 33 by at least the second tentative formed face 64A and the finish formed face 68. The final finish face 67 may consist of the above formed faces 64A and 68 and part of the first tentative formed face 63A. The final finish faces 67 are uniform by virtue of the settings of the above inclination angles, which is effective in increasing the quality of the shapes formed of the end portions of the groove-shaped recesses 33 and thereby stabilizing the ink jet discharge characteristics.

Since as described above the groove-shaped recesses 33 are formed in the chamber formation plate 30 by the working method in which importance is attached to the material movement in the width direction of the groove-shaped recesses 33, the degree of the material plate deformation in the thickness direction of the chamber formation plate 30 is made as low as possible. Therefore, the surface flatness of the chamber formation plate 30 formed is very high, which provides a liquid ejection head that is simplified in polishing of final finishing and hence is advantageous in cost.

In the above liquid ejection head, the end faces of each groove-shaped recess 33 are slant faces whose interval increases toward the opening of the groove-shaped recess 33. Therefore, at one end portion of each pressure generation chamber 29, a liquid flows along the slant face without stagnation and hence stay of bubbles can be prevented at the one end portion. And bubbles that have entered into the pressure generation chamber 29 can be ejected reliably being carried by a liquid flow. Since the end faces of each groove-shaped recess 33 are to be formed as slant faces whose interval increases toward the opening of the groove-shaped recess 33, the metal flows smoothly during pressing by the punch and hence the dimensional accuracy of the end faces of even a very minute groove-shaped recess 33 can be increased. The partitions 28 can be given a sufficient height.

Since after the working by the first punch 51*a* each end face of each groove-shaped recess 33 takes the form of a series of slant faces whose slope angle with respect to the bottom face of the groove-shaped recess 33 increases as the position goes away from the bottom face, the slant face closest to the bottom face is inclined relatively gently. Therefore, when the second punch 51*c* is dug past part of that slant face, the load imposed on the second punch 51*c* is light. This contributes to maintaining the durability of the second punch 51*c*. Since the slant face closest to the opening of the groove-shaped recess 33 is relatively steep, the volume of one end portion of the groove-shaped recess 33 can be made as small as possible and hence the degree of stagnation of a liquid can be reduced there.

Alternatively, each end face may be a curved slant face whose slope angle with respect to the bottom face of the groove-shaped recess 33 increases as the position goes away from the bottom face. In this case, a portion of the slant face that is closest to the bottom face is inclined relatively gently. Therefore, when the punch is dug past at least part of that portion of the slant face in forming a communication hole, the load imposed on the punch is light. This contributes to maintaining the durability of the second punch 51*c*. Since a portion of the slant face that is closest to the opening of the groove-shaped recess 33 is relatively steep, the volume of one end portion of the groove-shaped recess 33 can be made as small as possible and hence the degree of stagnation of a liquid can be reduced there.

Next, a second embodiment of the invention will be described. The groove-shaped recesses 33 as the base of discussion are basically the same as in the above-described first embodiment.

The second embodiment is characterized in that groove-shaped recesses 33 are formed in a first step and communication holes 34 are formed by boring punches in a second step.

Figure 15A:
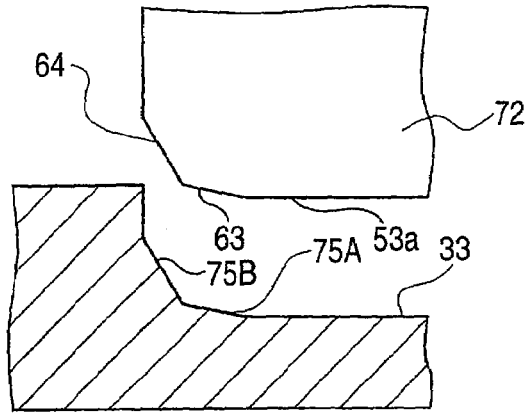
FIG. 15A shows how a groove-shaped recess is formed in a first step and FIGS. 15B and 15C show how a communication hole is formed in a second step.

As shown in FIG. 15A, slant faces having chamfering shapes of different angles are formed at both ends, in the longitudinal direction, of each projection strip 53*c* of a first punch 72. Each slant face is such that a first slant face 63 that is close to the edge of a tip portion 53*a* and a second slant face 64 that is distant from the edge of the tip portion 53*a* are continuous with each other. The inclination angle θ1 of the first slant face 63 with respect to the pressing direction of the first punch 72 is set larger than the inclination angle θ2 of the second slant face 64.

In the first step, groove-shaped recesses 33 are formed by digging the first punch 72 into a material plate. Each end face of each groove-shaped recess 33 formed by digging the first punch 72 into the material plate in the first step is a series of slant faces, that is, a first slant formed face 75A and a second slant formed face 75B, whose slope angle increases as the position goes away from the bottom face of the groove-shaped recess 33.

Figure 15B:
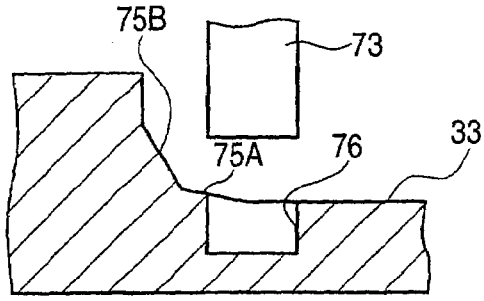
Figure 15C:
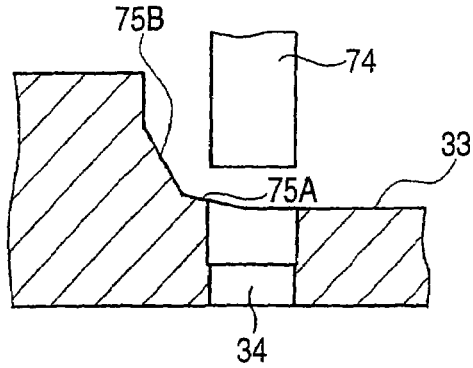

In the second step, as shown in FIG. 15B, a recess 76 is formed by digging a boring punch-A 73 into the material plate to an intermediate position in the thickness direction in such a manner that the end of the boring punch-A 73 hits the first slant formed face 75A. Then, as shown in FIG. 15C, a communication hole 34 is formed by digging a boring punch-B 74 into the bottom portion of the recess 76. As such, the boring of the second step includes the case that a communication hole 34 is formed by the two-step working.

The end face thus formed of each groove-shaped recess 33 at the side of which the communication hole 34 is formed consists of the slant faces that are inclined outward and the communication hole 34 is formed adjacent to the bottom end of end face. Therefore, at the end portion of the pressure generation chamber 29 at the side of which the communication hole 34 is formed, a liquid flows from the end face (i.e., along the slant faces) into the communication hole 34 without stagnation. As a result, stay of bubbles in this end portion can be prevented and bubbles that have entered into the pressure generation chamber 29 can be ejected reliably being carried by a liquid flow.

Since each end face at the side of which the communication hole 34 is formed consists of the slant faces that are inclined outward, the metal flows smoothly during digging of the boring punch 73 or 74. Therefore, the dimensional accuracy of the end face of even a very minute groove-shaped recess 33 can be increased. The partitions 28 can be given a sufficient height.

Since each end face at the side of which the communication hole 34 is formed is a series of slant faces whose slope angle with respect to the bottom face of the groove-shaped recess 33 increases as the position goes away from the bottom face, the slant face closest to the bottom face is inclined relatively gently. Therefore, when the boring punch-A 73 is dug past part of that slant face in forming a communication hole 34, the load imposed on the boring punch-A 73 is light. This makes it possible to form a communication hole 34 adjacent to the bottom end of the end face while maintaining the durability of the second punch 51*c*. Since the slant face closest to the opening of the groove-shaped recess 33 is relatively steep, the volume of the end portion of the groove-shaped recess 33 at the side of which the communication hole 34 is formed can be made as small as possible and hence the degree of stagnation of a liquid can be reduced there.

Alternatively, each end face at the side of which the communication hole 34 is formed may be a curved slant face whose slope angle with respect to the bottom face of the groove-shaped recess 33 increases as the position goes away from the bottom face. In this case, a portion of the slant face that is closest to the bottom face is inclined relatively gently. Therefore, when the boring punch-A 73 is dug past at least part of that portion of the slant face in forming a communication hole 34, the load imposed on the punch is light. This makes it possible to form a communication hole 34 adjacent to the bottom end of the end face while maintaining the durability of the boring punch-A 73. Since a portion of the slant face that is closest to the opening of the groove-shaped recess 33 is relatively steep, the volume of the end portion of the groove-shaped recess 33 at the side of which the communication hole 34 is formed can be made as small as possible and hence the degree of stagnation of a liquid can be reduced there.

Although in the second embodiment only the characteristics of the end portion of each groove-shaped recess 33 at the side of which the communication hole 34 is formed have been described, the same working is performed on the opposite end portion, that is, the end portion at the side of which the supply hole 45 is formed, of each groove-shaped recess 33 and the same shape is thereby formed, whereby the same characteristics as of the end portion at the side of which the communication hole 34 is formed can be obtained.

Next, a third embodiment of the invention will be described. The groove-shaped recesses 33 as the base of discussion are basically the same as in the above-described first embodiment.

The third embodiment is characterized in that groove-shaped recesses 33 are formed two-step working, that is, tentative working and finish working, in a first step in the same manner as in the first embodiment and communication holes 34 are formed by boring punches in a second step.

Figure 16A:
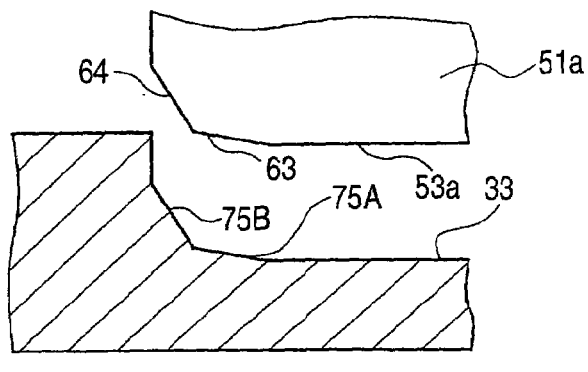
Figure 16B:
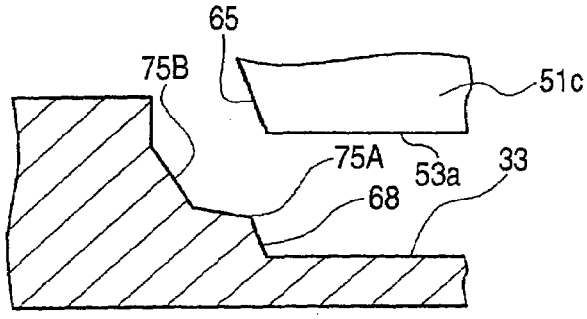

In the first step, groove-shaped recesses 33 are formed by performing tentative forming using a first punch 51*a* as shown in FIG. 16A and then performing finish forming using a second punch 51*c* as shown in FIG. 16B. The first punch 51*a* and the second punch 51*c* are basically the same as described in the first embodiment.

That is, slant faces having chamfering shapes of different angles are formed at both ends, in the longitudinal direction, of each projection strip 53*c* of the first punch 51*a*. Each slant face is such that a first slant face 63 that is close to the edge of a tip portion 53*a* and a second slant face 64 that is distant from the edge of the tip portion 53*a* are continuous with each other. The inclination angle θ2 of the second slant face 64 with respect to the pressing direction of the first punch 51*a* is set smaller than the inclination angle θ1 of the first slant face 63.

In the tentative forming of the first step, groove-shaped recesses 33 are formed by digging the first punch 51*a* into a material plate. Each end face of each groove-shaped recess 33 formed by digging the first punch 51*a* into the material plate in the tentative forming step is a series of slant faces, that is, a first slant formed face 75A and a second slant formed face 75B, whose slope angle increases as the position goes away from the bottom face of the groove-shaped recess 33.

Finish slant faces 65 having a chamfering shape are formed at both ends, in the longitudinal direction, of each projection strip 53*d* of the second punch 51*c*. The inclination angle θ3 of the finish slant face 65 with respect to the pressing direction of the second punch 51*c* is set smaller than the inclination angle θ2 of the second slant face. Therefore, the inclination angles θ1, θ2, and θ3 of the first slant face 63, the second slant face 64, and the finish slant face 65 have a relationship of θ1>θ2>θ3.

The finish forming of the first step is performed on the first slant formed face 75A and the second slant formed face 75B that were formed in the material plate by the first punch 51*a*. That is, the finish forming by the second punch 51*c* is performed after a tip point 66 of the finish slant face 65 of the second punch 51*c* touches the first slant formed face 75A.

The tentative forming (working) and the finish forming (working) of the first step are performed in the same manners as described in the first embodiment.

Figure 16C:
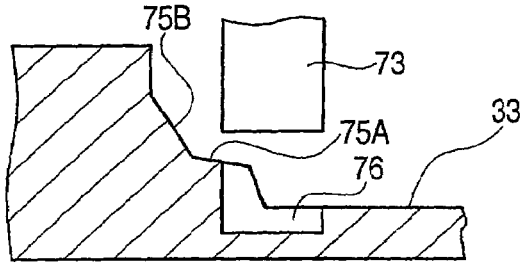
Figure 16D:
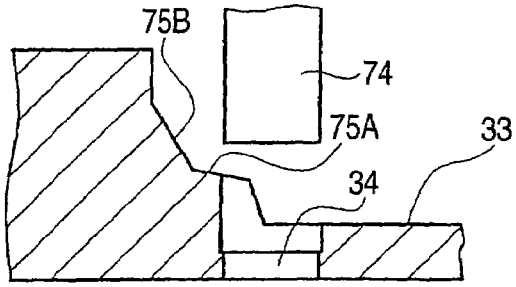

In the second step, as shown in FIG. 16C, a recess 76 is formed by digging a boring punch-A 73 into the material plate to an intermediate position in the thickness direction in such a manner that the end of the boring punch-A 73 hits the first slant formed face 75A. Then, as shown in FIG. 16D, a communication hole 34 is formed by digging a boring punch-B 74 into the bottom portion of the recess 76. As such, the boring of the second step includes the case that a communication hole 34 is formed by the two-step working.

The end face thus formed of each groove-shaped recess 33 at the side of which the communication hole 34 is formed consists of the slant faces that are inclined outward and the communication hole 34 is formed adjacent to the bottom end of the end face. Therefore, at the end portion of the pressure generation chamber 29, a liquid flows from the end face (i.e., along the slant faces) into the communication hole 34 without stagnation. As a result, stay of bubbles in this end portion can be prevented and bubbles that have entered into the pressure generation chamber 29 can be ejected reliably being carried by a liquid flow.

Since each end face at the side of which the communication hole 34 is formed consists of the slant faces that are inclined outward, the metal flows smoothly during digging of the boring punch 73 or 74. Therefore, the dimensional accuracy of the end face of even a very minute groove-shaped recess 33 can be increased. The partitions 28 can be given a sufficient height.

Since each end face at the side of which the communication hole 34 is formed is a series of slant faces whose slope angle with respect to the bottom face of the groove-shaped recess 33 increases as the position goes away from the bottom face, the slant face closest to the bottom face is inclined relatively gently. Therefore, when the boring punch-A 73 is dug past part of that slant face in forming a communication hole 34, the load imposed on the boring punch-A 73 is light. This makes it possible to form a communication hole 34 adjacent to the bottom end of end face while maintaining the durability of the second punch 51*c*. Since the slant face closest to the opening of the groove-shaped recess 33 is relatively steep, the volume of the end portion of the groove-shaped recess 33 at the side of which the communication hole 34 is formed can be made as small as possible and hence the degree of stagnation of a liquid can be reduced there.

Alternatively, each end face at the side of which the communication hole 34 is formed may be a curved slant face whose slope angle with respect to the bottom face of the groove-shaped recess 33 increases as the position goes away from the bottom face. In this case, a portion of the slant face that is closest to the bottom face is inclined relatively gently. Therefore, when the boring punch-A 73 is dug past at least part of that portion of the slant face in forming a communication hole 34, the load imposed on the punch is light. This makes it possible to form a communication hole 34 adjacent to the bottom end of the end face while maintaining the durability of the boring punch-A 73. Since a portion of the slant face that is closest to the opening of the groove-shaped recess 33 is relatively steep, the volume of the end portion of the groove-shaped recess 33 at the side of which the communication hole 34 is formed can be made as small as possible and hence the degree of stagnation of a liquid can be reduced there.

Although in the third embodiment only the characteristics of the end portion of each groove-shaped recess 33 at the side of which the communication hole 34 is formed have been described, the same working is performed on the opposite end portion, that is, the end portion at the side of which the supply hole 45 is formed, of each groove-shaped recess 33 and the same shape is thereby formed, whereby the same characteristics as of the end portion at the side of which the communication hole 34 is formed can be obtained.

Next, a fourth embodiment of the invention will be described. The groove-shaped recesses 33 as the base of discussion are basically the same as in the above-described first embodiment.

Figure 17A:
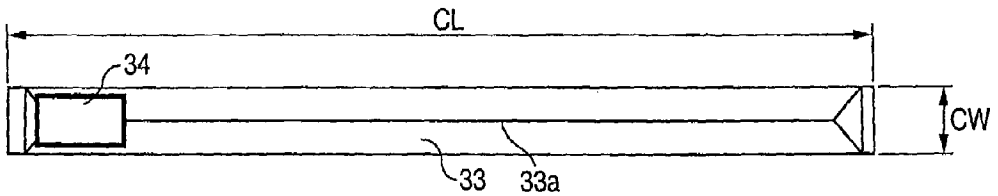
FIG. 17A is a view as viewed from the groove opening side.

As shown in FIG. 17A, groove-shaped recesses 33 to serve as pressure generation chambers 29 are grooves having a rectangular opening. In this embodiment, two recess arrays are provided in each of which 180 grooves each measuring about 0.1 mm in width CW, about 1.6 mm in length CL, and about 0.1 mm in depth CD are arranged parallel in the groove width direction. As shown in FIG. 17C, the bottom face of each groove-shaped recess 33 decreases in width as the position goes deeper; that is, the bottom face assumes a V-shape. That is, each groove-shaped recess 33 has a generally homeplate-shaped pentagonal cross-section. The bottom face is dented like a V-shape because the groove-shaped recesses 33 are formed by plastic working (press working) using a punch. Sharpening the tip portion of the punch into a mountain shape promotes a nickel flow and thereby makes it possible to form the groove-shaped recesses 33 with high dimensional accuracy. In each groove-shaped recess 33, the bottom line 33*a* of the V-shaped valley is the deepest portion of the groove-shaped recess 33 and corresponds to a groove bottom line of the invention.

Figure 17B:
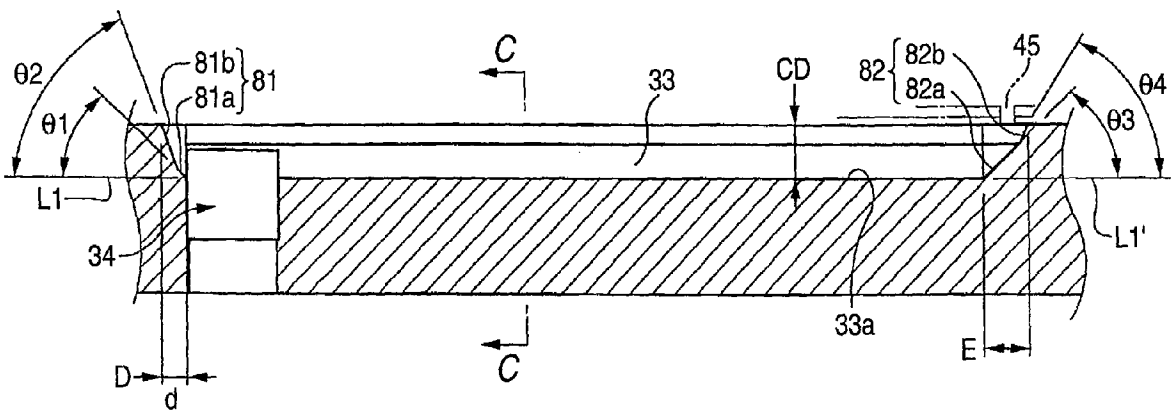
FIG. 17B is a sectional view taken along the groove longitudinal direction.
Figure 17C:
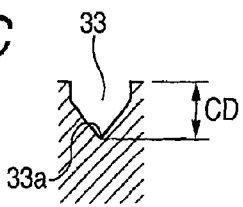
FIG. 17C is a sectional view taken along line C-C in FIG. 17B.

As shown in FIG. 17B, in each groove-shaped recess 33, each of an end face 81 that is close to a communication hole 34 and an end face 82 that is close to an ink supply hole 45 consists of slant faces and the interval between the end faces 81 and 82 increases toward the opening of the groove-shaped recess 33, that is, the slant faces constitute a downhill whose height decreases as the position goes inward in the longitudinal direction. In this embodiment, each of the end faces 81 and 82 consists of two slant faces whose slope angle with respect to the bottom line 33*a* of the V-shaped valley increases as the position goes away from the bottom line 33*a*. More specifically, each of the end faces 81 and 82 consists of a lower slant face 81*a* that is close to the bottom line 33*a* and is inclined gently and an upper slant face 81*b* that is close to the opening of the groove-shaped recess 33 and is inclined steeply.

The term "slope angle" means an angle with respect to a reference line L1 that is an extension of the bottom line 33*a* and extends outward in the groove longitudinal direction. The slope angle can also be expressed as an angle (intersecting angle) formed by the reference line L1 and the end face 81.

The communication hole 34 is a through-hole that is formed for each groove-shaped recess 33 at its one end so as to penetrate through a material plate in its thickness direction. Each recess array has 180 communication holes 34. The communication holes 34 of this embodiment have rectangular openings because they are formed by plastic working (press working) like the groove-shaped recesses 33 are done. Since the bottom portion of each groove-shaped recess 33 is thinner than the surrounding portion, forming the communication hole 34 in the groove-shaped recess 33 reduces the load of the punch and thereby prevents its buckling or the like. Although in this embodiment the communication holes 34 are through-holes having rectangular openings, the shape of the communication holes 34 is not limited to such a shape. For example, the communication holes 34 may be through-holes having circular openings.

Each communication hole 34 is located adjacent to the bottom end of the end face 81 that is located at one end, in the longitudinal direction, of the groove-shaped recess 33, more specifically, adjacent to the bottom end of the lower slant face 81*a*. This is to improve the performance of ejecting bubbles from each pressure generation chamber 29 while securing high dimensional accuracy of the plastic working.

Where each communication hole 34 is formed adjacent to the bottom end of the communication-hole-side end face 81, the downhill lower slant face 81*a* is made continuous with the communication hole 34. Therefore, at that portion of the groove-shaped recess 33 which is located outside the communication hole 34 in the groove longitudinal direction, the width of the channel decreases continuously toward the communication hole 34, whereby ink flows without stagnation. In the following description, the above portion of the groove-shaped recess 33 in a range indicated by symbol D in FIG. 17B (i.e., a range from the outside edge of the opening of the communication hole 34 to the top end of the end face 81 will be called "outside extended portion."

Since ink flow without stagnation in the outside extended portion, bubbles can be prevented from staying there. Should bubbles enter into the pressure generation chamber 29, the bubbles can be prevented from stay and can be ejected being carried by an ink flow.

Since the end face 81 is a downhill whose height decreases as the position goes inward in the groove longitudinal direction, the punch that is used for forming the groove-shaped recesses 33 is chamfered at the corresponding end in the longitudinal direction. Therefore, when the punch is dug into a metal substrate (band plate) to form a groove-shaped recess 33, a part of the metal plate that is brought into contact with the end portion, in the longitudinal direction, of the punch flows smoothly, whereby an end face at the side of which the communication hole is formed can be formed with high dimensional accuracy.

Incidentally, to prevent ink stagnation in each pressure generation chamber 29, it is preferable that the volume of the outside extended portion be as small as possible. In view of this, in this embodiment, the slope angle of the end face 81 with respect to the bottom line 33*a* of the V-shaped valley is set larger than or equal to 45° and smaller than 90°. More specifically, the slope angle θ1 of the lower slant face 81*a* with respect to the bottom line 33*a* is set at 45° and the slope angle θ2 of the upper slant face 81*b* with respect to the bottom line 33*a* is set at 65°. Further, the top end of the lower slant face 81*a* is located below (i.e., closer to the bottom line 33*a* than) the level having a half of the depth CD of the groove-shaped recess 33, more specifically, it is located at a level having about ¼ of the groove depth CD. This minimizes a horizontal distance d from the top end of the communication-hole-side end face 81 to the outside edge of the opening of the communication hole 34. An experiment showed that it is preferable that the distance d be set at ½ or less of the groove depth CD. Therefore, in this embodiment, the distance d is set at 0.05 mm which is ½ of the groove depth CD.

The reason why the slope angle θ1 of the lower slant face 81*a* is set smaller than the slope angle θ2 of the upper slant face 81*b* is to elongate the durability of the punch for forming the communication holes 34. As described later in detail, the communication holes 34 are formed by punching out the bottom portions of the groove-shaped recesses 33 in the thickness direction. However, the forming positions of the end faces 81 have some variation in the groove longitudinal direction.

In view of the above, in forming each communication hole 34, one end (in the groove longitudinal direction) of the punch is located over the lower slant face 81*a* and part of the lower slant face 81*a* is punched away. Since the slope angle θ1 of the lower slant face 81*a* is as small as 45°, the load on the punch is light even if part of the lower slant face 81*a* is punched away, whereby the durability of the punch is elongated.

As described above, in this embodiment, each end face 81 is formed as slant faces to increase the dimensional accuracy. And the slant faces are formed as the relatively gentle lower slant face 81*a* and the relatively steep upper slant face 81*b*, whereby the durability of the punch is elongated to make the formation of communication holes 34 more efficient and the volume of each outside extended portion is minimized to improve the bubble ejection performance.

On the other hand, as described above, each supply-side end face 82 that is opposite to the end face 81 is also a series of slant faces. This is to increase the dimensional accuracy of this portion, to lower the degree of stagnation of ink, and to positively cause ink to flow to the communication hole 34 side of the groove-shaped recess 33.

In this embodiment, the slope angle of the supply-side end face 82 with respect to the bottom line 33*a* of the V-shaped valley is also set larger than or equal to 45° and smaller than 90°. More specifically, the slope angle θ3 of the lower slant face 82*a* with respect to the bottom line 33*a* (i.e., the angle formed by a reference line L1' and the lower slant face 82*a*) is set at 45° and the slope angle θ4 of the upper slant face 82*b* with respect to the bottom line 33*a* is set at 60°. Forming the supply-side end face 82 as slant faces in this manner makes it possible to form the supply-side end faces 82 with high dimensional accuracy, because the metal flows smoothly when the punch is dug into a band plate.

Further, each ink supply hole 45 is located at a position corresponding to the supply-side end face 82, more specifically, in a range indicated by symbol E in FIG. 17 (i.e., a projection range of the supply-side end face 82 as viewed from the groove opening side). Therefore, ink that has entered into the pressure generation chamber 29 from the reservoir 14 flows along the supply-side end face 82, whereby the degree of stagnation of ink can be lowered and the ink can be caused positively to flow to the communication hole 34 side.

The slope angle θ3 of the lower slant face 82*a* which is more distant from the ink supply hole 45 is set smaller than the slope angle θ4 of the upper slant face 82*b* which is closer to the ink supply hole 45. In other words, the inclination of the supply-side end face 82 is set so as to decrease as the position comes closer to the bottom line 33*a* of the groove-shaped recess 33. This also contributes to lowering the degree of stagnation of ink.

Next, a manufacturing method of the recording head 1 will be described. Since this manufacturing method is characterized by a manufacturing process of the chamber formation plate 30, the following description will be centered on the manufacturing process of the chamber formation plate 30. The chamber formation plate 30 is formed by plastic working (press working) that uses progressive dies. A band plate as a material plate of the chamber formation plate 30 is made of nickel as mentioned above.

The manufacturing process of the chamber formation plate 30 generally consists of a groove-shaped recesses forming step for forming the groove-shaped recesses 33 (i.e., an embodiment of a first step of the invention) and a communication holes forming step for forming the communication holes 34 (i.e., a second step of the invention).

Figure 18A:
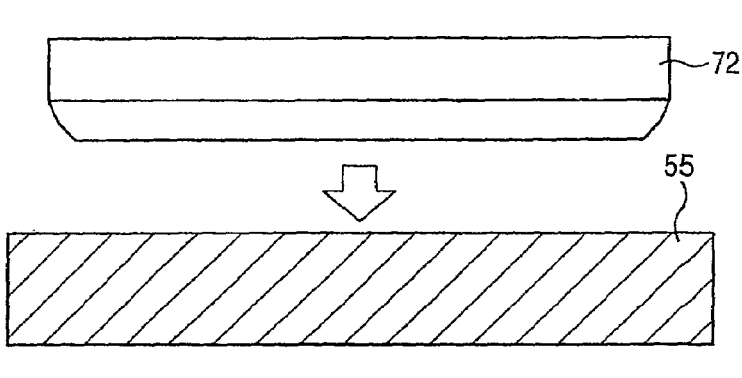
FIGS. 18A-18C illustrate first punching.
Figure 18B:
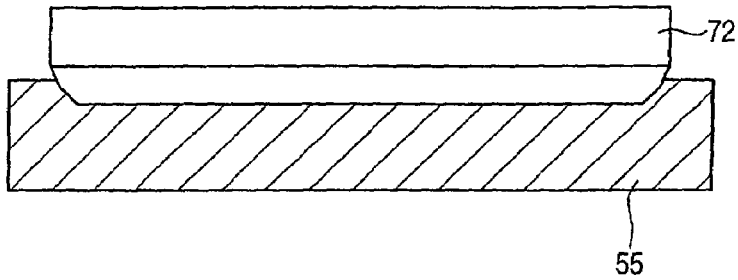
Figure 18C:
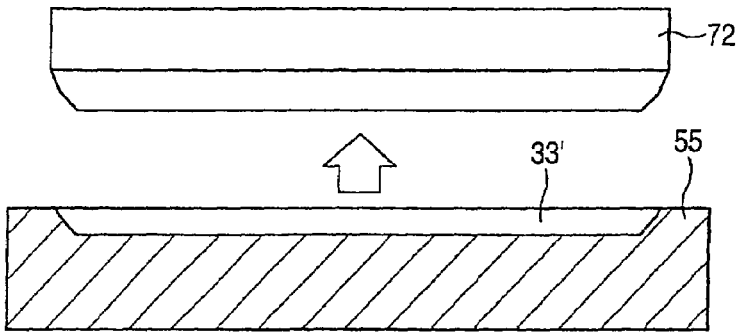
Figure 19A:
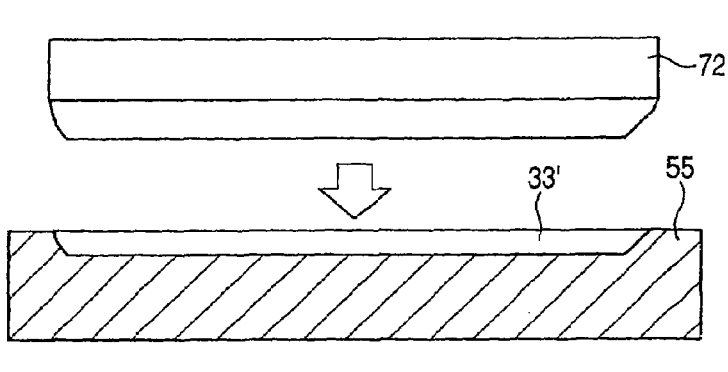
FIGS. 19A-19C illustrate second punching.
Figure 19B:
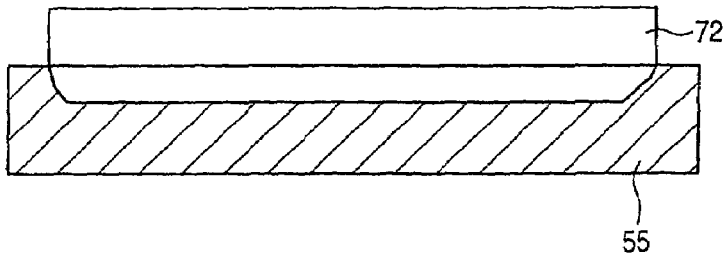
Figure 19C:
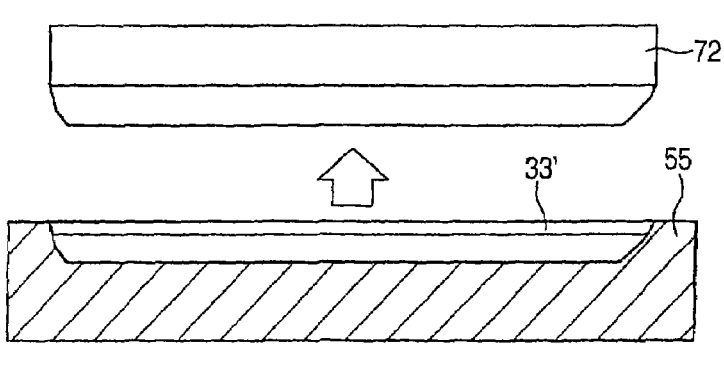

As schematically shown in FIGS. 18 and 19, the groove-shaped recesses forming step is executed by applying a first punch (male die) 72 to the same position twice, the first punch 72 having tip shapes that conform to the groove-shaped recesses 33. First, as shown in FIG. 18, the first punch 72 is dug into a band plate 55 to an intermediate position in the groove depth direction (see FIGS. 18A and 18B). The pressing operation, i.e., the punching, of the first punch 72 causes parts of the band plate 55 to flow and be deformed plastically, whereby shallow grooves 33' are formed that are shallower than the intended groove-shaped recesses.

Since each tip portion of the first punch 72 is sharpened in a V-shape in the width direction, a part that is pressed by the tip portion flows smoothly and a resulting shallow groove 33' is shaped so as to conform to the shape of the tip portion. Further, since the tip portion is chamfered at both ends in the longitudinal direction so as to conform to the end face 81 and the end face 82, parts that are pressed by those portions also flow smoothly. Therefore, both end portions of the shallow groove 33' are also shaped so as to conform to the shapes of the corresponding portions of the tip portion.

Then, after the first punch thus pressed is elevated so as to be separated from the band plate 55 (see FIG. 18C), second punching is performed. That is, a punch having the same shape (for the sake of convenience, called "first punch 72") is pressed against the band plate 55 again at the same position (see FIGS. 19A and 19B). In the second punching, each tip portion of the first punch 72 is dug into the band plate 55 to a position corresponding to the depth CD (see FIG. 17C) of the groove-shaped recess 33.

In this pressing of the first punch 72, the first punch 72 is dug into the shallow grooves 33' that were formed by the first punching, whereby groove-shaped recesses 33 are formed in the band plate 55. Since punching is performed twice, deeper recesses can be formed than in the case where punching is performed only once.

Figure 20A:
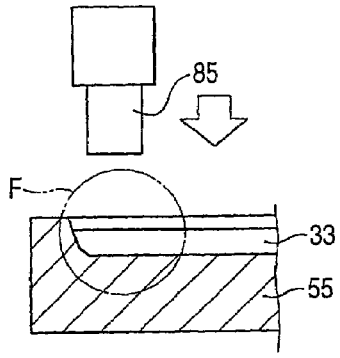
FIGS. 20A-20D illustrate a step of forming an upper half.
Figure 20B:
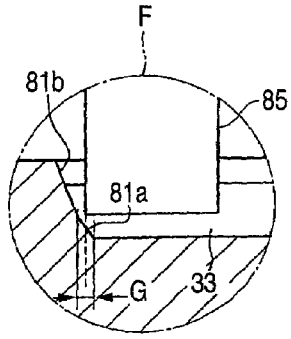
Figure 20C:
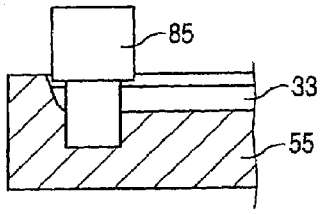
Figure 20D:
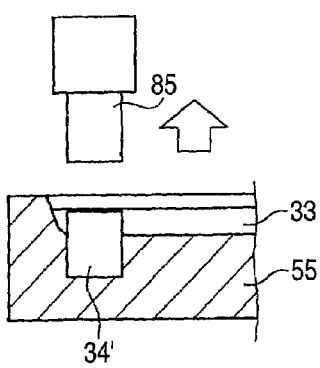

After the groove-shaped recesses 33 have been formed in the above-described manner, a transition is made to the communication holes forming step to form communication holes 34. In the communication holes forming step, as shown in FIG. 20, a second punch 85 as a boring punch having tip shapes that conform to the intended communication holes 34 is applied to the surface of the band plate 55 at the side of which the groove-shaped recess 33 is formed and is dug into the band plate 55 to an intermediate position in the thickness direction, whereby an upper half 34' of the intended communication hole 34 is formed. At this time, as shown in FIG. 20B, the outside end, in the groove longitudinal direction, of each tip portion of the second punch 85 is located over the lower slant face 81*a* (i.e., located in a slant face range indicated by symbol G). Therefore, in the punching by the second punch 85, part of the lower slant face 81*a* is also punched away. Since the slope angle θ1 of the lower slant face 81*a* is 45°, the load of the second punch 85 is light even if part of the lower slant face 81*a* is punched away. As a result, the durability of the second punch 85 can be elongated.

Since part (a bottom part) of the lower slant face 81*a*, which is located in the slant face range G, is punched away by the second punch 85, no flat portion is formed which may cause stay of bubbles even if the forming positions of the faces at the side of which the communication holes are formed are somewhat varied in the groove longitudinal direction. The lower slant face 81*a* having such a function can be expressed as "a slant face having a plastic working portion to be deformed plastically by the second punch 85."

Figure 21A:
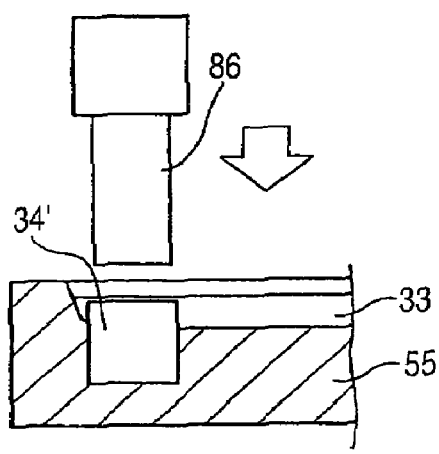
FIGS. 21A-21C illustrate a step of forming a lower half.
Figure 21B:
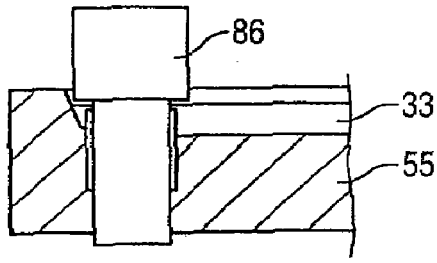
Figure 21C:
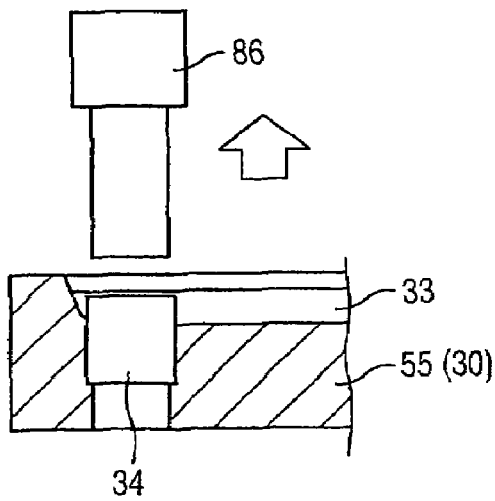

After the upper half 34' of each communication hole 34 has been formed, a lower half of the communication hole 34 is formed by using a third punch 86 having tip shapes that are a size thinner than the tip shapes of the second punch 85. More specifically, as shown in FIG. 21, the third punch 86 is inserted into each upper half 34' that was formed by the second punch 85 and the bottom portion of the upper half 34' is punched out. After communication holes 34 have been formed in the above-described manner, the surface at the side of which the groove-shaped recess 33 is formed and the opposite surface of the band plate 55 is flattened by grinding.

After the chamber formation plate 30 has been formed by the above steps, the channel unit 4 is formed by joining the elastic plate 32 and the nozzle plate 31 that were formed separately to the chamber formation plate 30. In this embodiment, the members 30-32 are joined to each other by bonding. After the formation of the channel unit 4, the channel unit 4 is bonded to the front end face of the case 2 and then the vibrator units 3 are inserted in and fixed to the case 2. After the vibrator units 3 and the channel unit 4 have been joined to the case 2, the flexible cables 9 of the vibrator units 3 are soldered to the connection board 5 and then the supply needle unit 6 is attached.

Incidentally, the invention is not limited to the above embodiments and various modifications are possible without departing from the scope of the claims.

For example, the slope angles, with respect to the bottom line 33*a*, of the slant faces constituting the communication-hole-side end face 81 and the supply-side end face 82 may be changed. The groove-opening-side face of the supply-side end face 82 may be a vertical face that is perpendicular to the bottom line 33*a* of the V-shaped valley.

Figure 22:
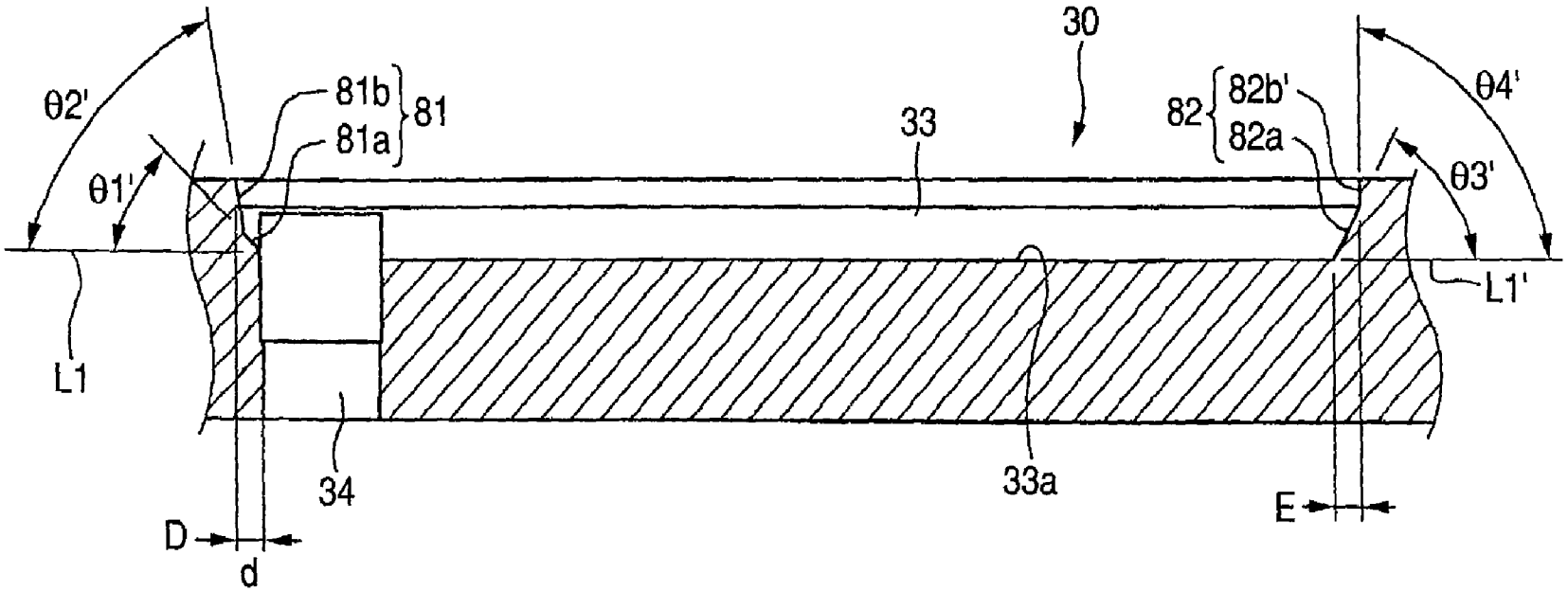
FIG. 22 illustrates a fifth embodiment of the invention.

For example, in a fifth embodiment shown in FIG. 22, the slope angles θ2', with respect to the bottom line 33*a*, of the upper slant face 81*b* that is part of the communication-hole-side end face 81 is set at 80°. With this measure, the volume of the outside extended portion (in the range D) can be made as small as possible. The supply-side end face 82 consists of the lower slant face 82*a* that is close to the bottom line 33*a* and an upper vertical face 82*b'* that extends upward from the top edge of the lower slant face 82*a* and the slope angles θ3' and θ4', with respect to the bottom line 33*a*, of the lower slant face 82*a* and the upper vertical face 82*b'* are set at 60° and 90°, respectively.

Also in the fifth embodiment, the communication hole 34 is formed adjacent to the bottom end of the communication-hole-side end face 81 (i.e., lower slant face 81*a*). Therefore, ink can be made not prone to stagnation and stay of bubbles can be prevented. Further, the volume of the outside extended portion can be made as small as possible. This also contributes to preventing stagnation of ink and makes it possible to reliably eject bubbles even if they have entered into the pressure generation chamber 29.

As for the supply-side end face 82, the ink supply hole 45 is located in the projection range (indicated by symbol E in FIG. 22) of the lower slant face 82*a*, ink coming from the common ink chamber 14 as the reservoir can be caused flow to the communication hole 34 without stagnation.

Figure 23A:
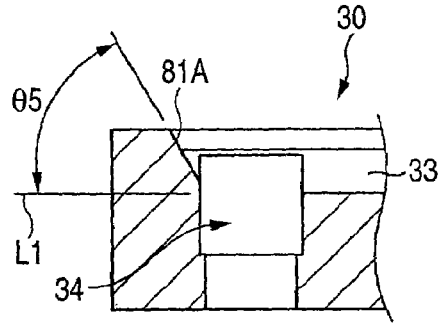
FIGS. 23A-23D illustrate modifications of a communication-hole-side end face.

Each of the end face 81 and the end face 82 is not limited to an end face consisting of two slant faces having different slope angles with respect to the bottom line 33*a*. For example, as shown in FIG. 23A, the end face 81 may be a single slant face 81A. In this example, the end face 81 is the single slant face 81A whose slope angle θ5 with respect to the bottom line 33*a* is set at 60°.

The slope angle θ5 is not limited to 60° and can be set as appropriate. A small slope angle θ5 is preferable from the viewpoint of reduction of the load on the first punch 72, and a large slope angle θ5 is preferable from the viewpoint of reduction of the volume of the outside extended portion. In view of these requirements, it is preferable that the slope angle θ5 be set in a range of 45° to 60°.

Figure 23B:
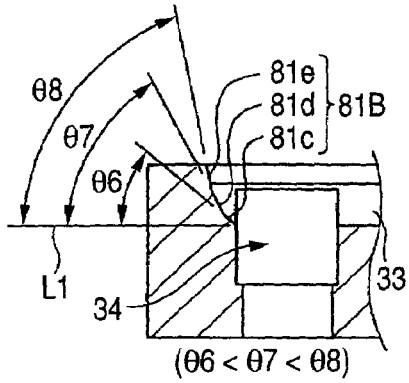

Each of the end face 81 and the end face 82 may consist of three or more slant faces having different slope angles with respect to the bottom line 33*a*. For example, as shown in FIG. 23B, the end face 81 may be an end face 81B consisting of three slant faces whose slope angle with respect to the bottom line 33*a* increases as the position goes up away from the bottom line 33*a*, that is, a lower slant face 81*c* having an slope angle θ6, a middle slant face 81*d* having an slope angle θ7, and an upper slant face 81*e* having an slope angle θ8.

Figure 23C:
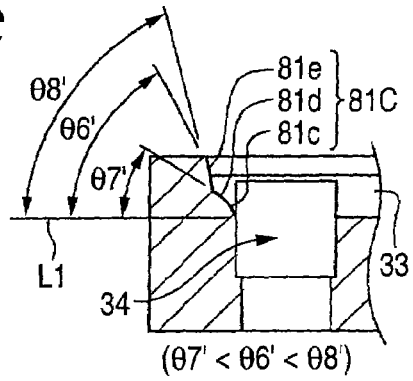

Although in this example the slope angles θ6, θ7, and θ8 are set at 45°, 60°, and 80°, respectively, the invention is not limited to such a case. For example, the slope angles θ6, θ7, and θ8 may be set at 30°, 450°, and 60°, respectively. As a further alternative, as shown in FIG. 23C, the end face 81 may be an end face 81C in which the slope angle θ7' of the middle slant face 81*d* is smaller than the slope angles θ6' and θ8' of the other slant faces (i.e., lower slant face 81*c* and upper slant face 81*d*).

Figure 23D:
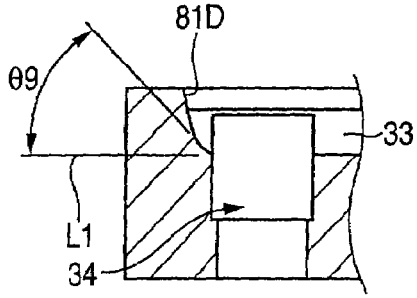

Further, each of the end face 81 and the end face 82 may be curved slant face whose slope angle with respect to the bottom line 33*a* increases as the position goes away from the bottom line 33*a*. For example, as shown in FIG. 23D, the end face 81 may be a curved slant face 81D whose slope angle with respect to the bottom line 33*a* increases gradually as the position goes up away from the bottom line 33*a*. Also in this structure, it is preferable that the slope angle θ9 of a portion that is in contact with the communication hole 34 be larger than or equal to 45°.

The shape of the bottom face of each groove-shaped recess 33 is not limited to the V-shape. For example, the bottom portion of each groove-shaped recess 33 may be dented so as to assume an inverted trapezoid in which the bottom base is shorter than the top base.

The pressure generating element may be an element other than the piezoelectric vibrator 10. For example, the pressure generating element may be an electromechanical conversion element such as an electrostatic actuator or a magnetostrictor, or a heating element.

Each of the above embodiments is directed to the ink jet recording head. However, the liquid ejection head according to the invention is not only for ink for an ink jet recording apparatus, and can discharge glue, a manicure material, a conductive liquid (liquid metal), etc.

Figure 24:
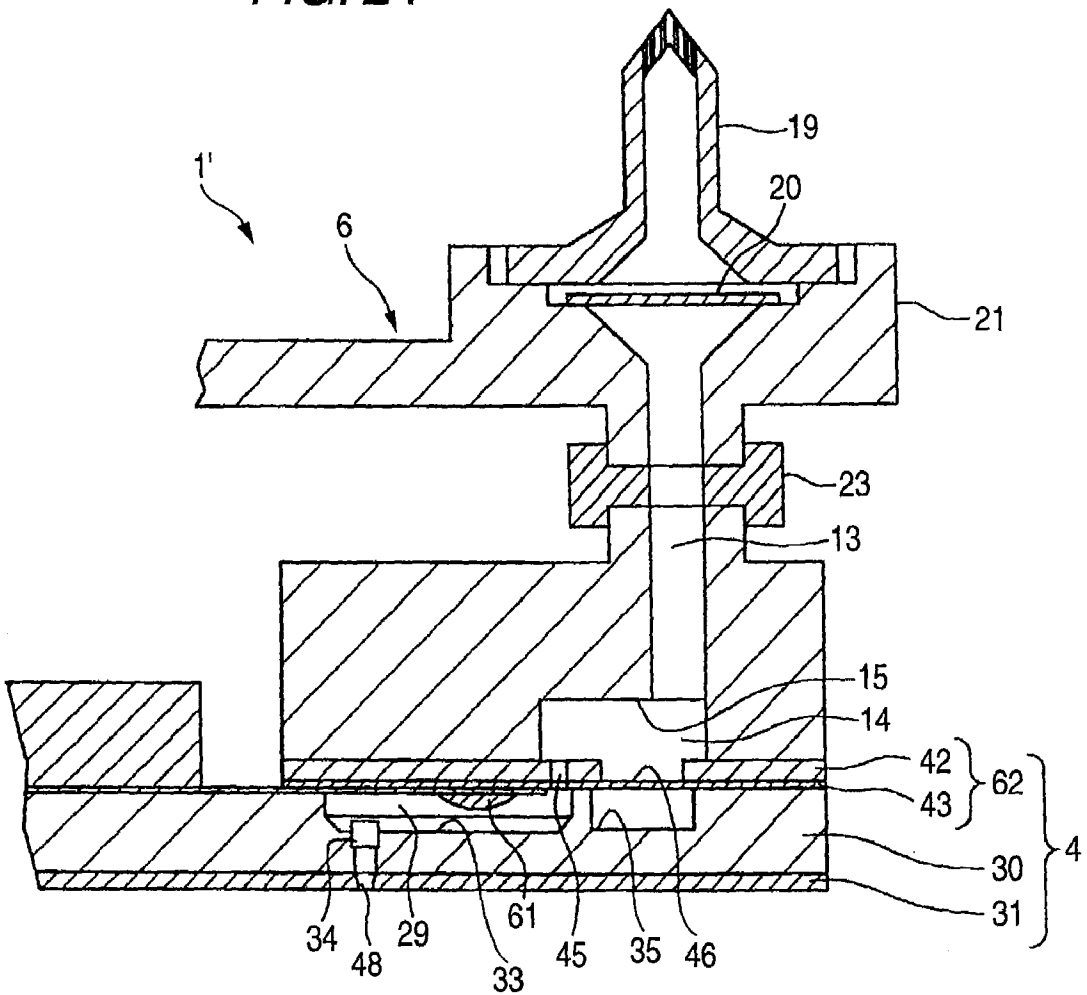
FIG. 24 illustrates an exemplary application to a recording head in which heating elements are used as pressure generating elements.
Figure 25A:
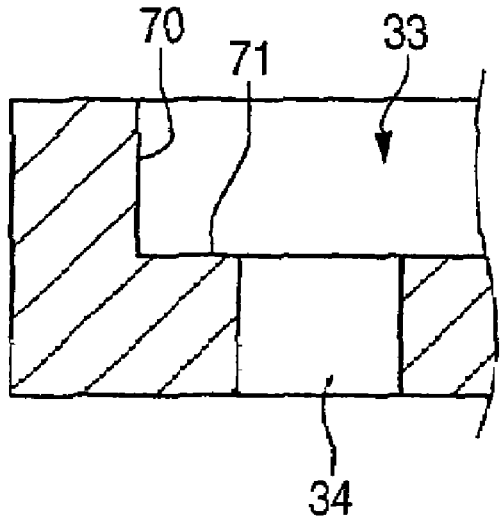
FIGS. 25A and 25B illustrate a conventional technique.
Figure 25B:
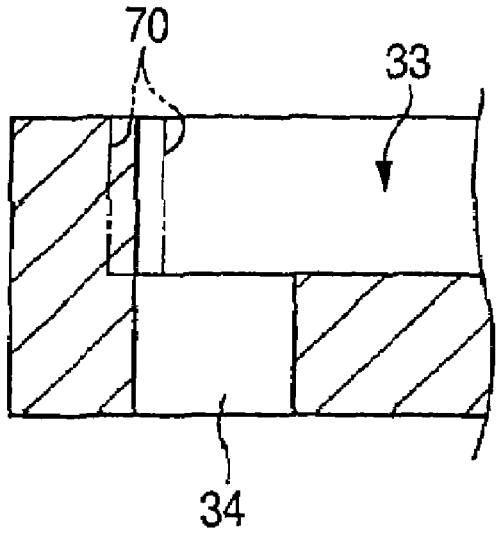

A recording head 1' shown in FIG. 24 is an example to which the invention can be applied in which heating elements 61 are used as the pressure generation elements. In this example, a sealing substrate 62 that is formed with compliance portions 46 and ink supply holes 45 is used instead of the above-described elastic plate 32 and the sealing substrate 62 seals the groove-shaped recesses 33 of the chamber formation plate 30. Further, in this example, the heating elements 61 are attached to the surface of the sealing substrate 62 so as to be provided in the respective pressure generation chambers 29. The heating elements 61 heat when energized via an electric wiring. The other members such as the chamber formation plate 30 and the nozzle plate 31 are the same as in the above embodiments and hence will not be described.

In the recording head 1', when a heating element 61 is energized, the ink in the pressure generation chamber 29 boils suddenly and resulting bubbles pressurize the ink in the pressure generation chamber 29, whereby an ink droplet is ejected from the nozzle orifice 48. Also in this recording head 1', the chamber formation plate 30 is formed by plastically working on a metal plate. Each of the end face 81 and the end face 82 of each groove-shaped recess 33 consists of slant faces that are inclined outward. And the communication hole 34 is formed adjacent to the bottom end of the end face 81. Therefore, the same advantages as in the above embodiments can be obtained.

In the above embodiments, each communication hole 34 is formed at one end of the groove-shaped recess 33. However, the invention is not limited to such a case. For example, a structure is possible that a communication hole 34 is formed approximately at the center, in the longitudinal direction, of each groove-shaped recess 33 and an ink supply hole 45 and a common ink chamber 14 that communicates with the ink supply hole 45 are provided at both ends, in the longitudinal direction, of the groove-shaped recess 44. This structure is preferable because it prevents stagnation of ink in the paths from the ink supply holes 45 to the communication hole 34 in the pressure generation chamber 29.

As described above, in the fine forging method and the manufacturing method of a liquid ejection head according to the invention, first, tentative forming by the first punch forms a material plate to such a stage that a final shape has not been obtained. Subsequently, finish forming is performed by using the second punch. Since plastic working is performed sequentially, that is, gradually, by using the first punch and the second punch, a desired formed shape can be obtained correctly even if it is minute without causing any problems, that is, without producing an abnormal shape or causing a crack in the material plate. In general, anisotropic etching is employed to form such minute structures. However, anisotropic etching requires a large number of working steps and hence is disadvantageous in manufacturing cost. In contrast, the above-described fine forging method greatly decreases the number of working steps and hence is very advantageous in cost. Further, capable of forming recesses having uniform volumes, the above-described fine forging method is very effective in, for example, stabilizing the discharge characteristics of a liquid ejection head in, for example, a case of forming pressure generation chambers of the liquid ejection head.

In the liquid ejection head according to the invention, first, tentative forming by the first punch forms a material plate to such a stage that a final shape has not been obtained. Subsequently, finish forming is performed by using the second punch. Since plastic working is performed sequentially, that is, gradually, by using the first punch and the second punch, a desired formed shape can be obtained correctly even if it is minute without causing any problems, that is, without producing an abnormal shape or causing a crack in the material plate. In general, anisotropic etching is employed to form such minute structures. However, anisotropic etching requires a large number of working steps and hence is disadvantageous in manufacturing cost. In contrast, the above-described liquid ejection head greatly decreases the number of working steps and hence is very advantageous in cost.

Further, since recesses having uniform volumes can be formed, the local accuracy of each pressure generation chamber etc. is increased greatly, which is very effective in, for example, stabilizing the discharge characteristics of a liquid ejection head. Where the chamber formation plate is made of nickel, for example, the chamber formation plate, the elastic plate, and the nozzle plate which constitute the channel unit have approximately the same linear expansion coefficients and hence these members expand uniformly when they are heat-bonded to each other. Therefore, mechanical stress such as a warp due to differences between the expansion coefficients is unlikely to occur. As a result, these members can be bonded to each other without causing any problems even if the bonding temperature is set high. Further, even when the piezoelectric vibrators heat during operation of the recording head and the channel unit is thereby heated, the members constituting the channel unit expand uniformly. Even if heating due to operation of the recording head and cooling due to suspension of operation are repeated, no problems such as peeling likely occur in the members constituting the channel unit.

The invention also provides the following advantages.

Since the end face of each groove-shaped recess is a slant face that is inclined outward and the second punch is dug adjacent to the bottom end of the end face, a liquid flows along the slant face without stagnation at the corresponding end portion of each pressure generation chamber. Therefore, stay of bubbles can be prevented at the end portion, and bubbles that have entered into the pressure generation chamber can be ejected reliably being carried by a liquid flow.

Since the end face of each groove-shaped recess is a slant face that is inclined outward, the metal flows smoothly when the punch is dug. This makes it possible to increase the dimensional accuracy of the communication-hole-side end faces and secure a sufficient height of the partitions even if the groove-shaped recesses are very minute.

Where the end face of each groove-shaped recess is a series of slant faces whose slope angle with respect to the groove bottom portion increases as the position goes away from the groove bottom portion, the slant face that is close to the groove bottom portion is inclined relatively gently. Therefore, the load imposed on the second punch is light when the second punch is dug past part of that slant face. This makes it possible to dig the second punch adjacent to the bottom end of the end face while maintaining the durability of the second punch. Further, since the slant face of the end face that is close to the groove opening is relatively steep, the volume of the end portion of the groove-shaped recess can be made as small as possible and hence the degree of stagnation of a liquid can be reduced there.

Where the end face of each groove-shaped recess is a curved slant face whose slope angle with respect to the groove bottom portion increases as the position goes away from the groove bottom portion, a portion of the curved slant face that is close to the groove bottom portion is inclined relatively gently. Therefore, the load imposed on the second punch is light when the second punch is dug past at least part of that portion. This makes it possible to dig the second punch adjacent to the bottom end of the end face while maintaining the durability of the second punch. Further, since a portion of the end face that is close to the groove opening is relatively steep, the volume of the end portion of the groove-shaped recess can be made as small as possible and hence the degree of stagnation of a liquid can be reduced there.

The invention still provides the following advantages.

Since the communication-hole-side end face of each groove-shaped recess is a slant face that is inclined outward and the communication hole is formed adjacent to the bottom end of the end face at the side of which the communication hole is formed, at the corresponding end portion of the pressure generation chamber a liquid flows without stagnation along the slant face from the end face to the communication hole. Therefore, stay of bubbles can be prevented at this end portion, and bubbles that have entered into the pressure generation chamber can be ejected reliably being carried by a liquid flow.

Since the end face is a slant face that is inclined outward, the metal flows smoothly when the punch is dug. This makes it possible to increase the dimensional accuracy of the end faces and secure a sufficient height of the partitions even if the groove-shaped recesses are very minute.

Where the end face is a series of slant faces whose slope angle with respect to the groove bottom portion increases as the position goes away from the groove bottom portion, the slant face that is close to the groove bottom portion is inclined relatively gently. Therefore, the load imposed on the punch is light when the punch is dug past part of that slant face. This makes it possible to dig the punch adjacent to the bottom end of the end face while maintaining the durability of the punch. Further, since the slant face of the end face that is close to the groove opening is relatively steep, the volume of the end portion of the groove-shaped recess can be made as small as possible and hence the degree of stagnation of a liquid can be reduced there.

Where the end face is a curved slant face whose slope angle with respect to the groove bottom portion increases as the position goes away from the groove bottom portion, a portion of the curved slant face that is close to the groove bottom portion is inclined relatively gently. Therefore, the load imposed on the punch is light when the punch is dug past at least part of that portion. This makes it possible to dig the punch adjacent to the bottom end of the end face while maintaining the durability of the punch. Further, since a portion of the end face that is close to the groove opening is relatively steep, the volume of the end portion of the groove-shaped recess can be made as small as possible and hence the degree of stagnation of a liquid can be reduced there.

What is claimed is:

1. A liquid ejection head, comprising:

at least one metal chamber formation plate forming groove-shaped recesses serving as pressure generation chambers and a communication hole disposed at one end of each of the groove-shaped recesses; and a nozzle plate formed with nozzle orifices are formed at positions corresponding to the respective communication holes, and joined to the chamber formation plate wherein an end portion, in a longitudinal direction, of each of the groove-shaped recesses is formed with a slant portion and a formed surface that is continuous with the slant portion has an inclination angle that is different from an inclination angle of the slant portion.

2. The liquid ejection head as set forth in claim 1, wherein the formed face is steeper than the slant face.

3. The liquid ejection head as set forth in claim 2, wherein the slant portion consists of two slant faces having different inclination angles.

4. The liquid ejection head as set forth in claim 3, wherein the two slant faces having the different inclination angles are a first slant face that is close to a bottom portion of the groove-shaped recess and a second slant face that is distant from the bottom portion of the groove-shaped recess and the formed face is continuous with the first slant face.

5. The liquid ejection head as set forth in claim 4, wherein the second slant face is steeper than the first slant face.

6. The liquid ejection head as set forth in claim 2, wherein the formed face that is continuous with the slant portion is an end face of the pressure generation chamber.

7. The liquid ejection head as set forth in claim 2, wherein the formed face that is continuous with the slant portion is part of the communication hole.

8. A liquid ejection head, comprising:

a channel unit, including liquid channels that reach nozzle orifices via pressure generation chambers, and that can eject liquid from the nozzle orifices by causing pressure generating elements to generate pressure variations in liquids in the pressure generation chambers, the channel unit comprising:

at least one metal chamber formation plate, forming a plurality of groove-shaped recesses serving as the pressure generation chambers, and communication holes disposed at one end, in a longitudinal direction, of each of the groove-shaped recesses; and a nozzle plate that is formed with the nozzle orifices and is joined to the chamber formation plate, wherein an end portion, in the longitudinal direction, of each of the groove-shaped recesses is formed with a slant portion and the communication hole is formed so as to be continuous with the slant portion.

9. The liquid ejection head as set forth in claim 8, wherein a communication-hole-side end face of the slant portion is a slant face that is inclined so that a length of the groove-shaped recess increases as the position goes toward a groove opening and the communication hole is formed adjacent to a bottom end of the communication-hole-side end face.

10. The liquid ejection head as set forth in claim 9, wherein an slope angle, with respect to a groove bottom portion, of the communication-hole-side end face is set larger than or equal to 45° and smaller than 90°.

11. The liquid ejection head as set forth in claim 9, wherein the communication-hole-side end face is a series of slant faces having different slope angles with respect to the groove bottom portion.

12. The liquid ejection head as set forth in claim 9, wherein the communication-hole-side end face is a series of slant faces whose slope angle with respect to the groove bottom portion increases as the position goes away from the groove bottom portion.

13. The liquid ejection head as set forth in claim 9, wherein the communication-hole-side end face is a curved slant face whose slope angle with respect to the groove bottom portion increases as the position goes away from the groove bottom portion.

14. The liquid ejection head as set forth in claim 9, wherein a distance from a top end of the communication-hole-side end face to a slant-portion-side opening edge of the communication hole is shorter than a depth of the groove-shaped recesses.

15. The liquid ejection head as set forth in claim 9, wherein a supply-side end face of each of the groove-shaped recesses that is opposite to the communication-hole-side end face in the longitudinal direction is a slant face that is inclined so that a length of the groove-shaped recess increases toward the groove opening.

16. The liquid ejection head as set forth in claim 15, wherein an slope angle, with respect to a groove bottom portion, of the supply-side end face is set larger than or equal to 45° and smaller than 90°.

17. The liquid ejection head as set forth in claim 15, wherein the supply-side end face is a series of slant faces having different slope angles with respect to the groove bottom portion.

18. The liquid ejection head as set forth in claim 15, wherein the supply-side end face is a series of slant faces whose slope angle with respect to the groove bottom portion increases as the position goes away from the groove bottom portion.

19. The liquid ejection head as set forth in claim 15, wherein the supply-side end face is a curved slant face whose slope angle with respect to the groove bottom portion increases as the position goes away from the groove bottom portion.

* * * * *